US012571285B2

(12) United States Patent
Werries et al.

(10) Patent No.: US 12,571,285 B2
(45) Date of Patent: Mar. 10, 2026

(54) DOWNHOLE VALVE ASSEMBLY WITH CEMENT-ISOLATED FLOWPATH

(71) Applicant: NCS MULTISTAGE INC., Calgary (CA)

(72) Inventors: Michael Werries, Calgary (CA); Brock Gillis, Calgary (CA); Tim Johnson, Calgary (CA); Nick Getzlaf, Calgary (CA)

(73) Assignee: NCS Multistage Inc., Calgary (CA)

( * ) Notice: Subject to any disclaimer, the term of this patent is extended or adjusted under 35 U.S.C. 154(b) by 53 days.

(21) Appl. No.: 18/569,719

(22) PCT Filed: Jun. 17, 2022

(86) PCT No.: PCT/CA2022/050981

§ 371 (c)(1),
(2) Date: Dec. 13, 2023

(87) PCT Pub. No.: WO2022/261786

PCT Pub. Date: Dec. 22, 2022

(65) Prior Publication Data

US 2024/0218759 A1 Jul. 4, 2024

Related U.S. Application Data

(60) Provisional application No. 63/202,648, filed on Jun. 18, 2021.

(51) Int. Cl.
*E21B 34/10* (2006.01)
*E21B 23/00* (2006.01)
(Continued)

(52) U.S. Cl.
CPC ..... *E21B 34/10* (2013.01); *E21B 23/006* (2013.01); *E21B 33/14* (2013.01); *E21B 34/08* (2013.01);
(Continued)

(58) Field of Classification Search
CPC ..... E21B 43/26; E21B 33/146; E21B 33/14
See application file for complete search history.

(56) References Cited

U.S. PATENT DOCUMENTS

2009/0211748 A1 8/2009 Revheim
2013/0048298 A1* 2/2013 Merron ..... E21B 34/14 166/373
2013/0284452 A1 10/2013 Franklin et al.

FOREIGN PATENT DOCUMENTS

WO WO 2016/026024 2/2016

OTHER PUBLICATIONS

International Search Report and Written Opinion for International (PCT) Patent Application No. PCT/CA2022/050981, dated Aug. 30, 2022, 9 pages.

* cited by examiner

*Primary Examiner* — Robert E Fuller
(74) *Attorney, Agent, or Firm* — Sheridan Ross P.C.

(57) ABSTRACT

A valve assembly for integration within a wellbore string has a valve housing with a housing port, a bottom sleeve mounted and slidable within the valve housing between closed and open positions, and a top sleeve mounted within the valve housing and defining an annular region therebetween. The top sleeve has a sleeve port and is slidable within the valve housing between a first position where the top sleeve engages the valve housing and defines an annular chamber within the annular region, and a production position where the sleeve port is in fluid communication with the housing port to define a fluid pathway along which fluids flow from the reservoir through the annular chamber. While in the first position, the annular chamber has an inlet allowing fluid to flow into and pressurize the annular chamber to prevent particulates from flowing into the annular region.

13 Claims, 57 Drawing Sheets

(51) Int. Cl.

| | |
|---|---|
| ***E21B 33/14*** | (2006.01) |
| ***E21B 34/08*** | (2006.01) |
| ***E21B 43/12*** | (2006.01) |

(52) U.S. Cl.
CPC ..... *E21B 34/102* (2013.01); *E21B 43/12* (2013.01); *E21B 2200/06* (2020.05)

DOWNHOLE VALVE ASSEMBLY WITH CEMENT-ISOLATED FLOWPATH

CROSS REFERENCE TO RELATED APPLICATIONS

This application is a national stage application under 35 U.S.C. 371 and claims the benefit of PCT Application No. PCT/CA2022/050981 having an international filing date of 17 Jun. 2022, which designated the United States, and which PCT application claimed the benefit of U.S. Provisional Application No. 63/202,648 filed 18 Jun. 2021, the contents of each of which are incorporated herein by reference in their entireties.

TECHNICAL FIELD

The present disclosure relates to technologies for subterranean operations and, more particularly, to downhole valve assemblies, systems and methods that can be used to inject or produce fluids, and which can be implemented in cemented wellbore completions.

BACKGROUND

Recovering hydrocarbons from an underground formation can be enhanced by fracturing the formation in order to form fractures through which hydrocarbons can flow from the reservoir into a well. Fracturing can be performed prior to primary recovery where hydrocarbons are produced to the surface without imparting energy into the reservoir. Fracturing can be performed in stages along the well to provide a series of fractured zones in the reservoir.

Well completion often includes cementing the wellbore string down the wellbore prior to fractures being formed therein. The frac ports are initially closed during the cementing process, and are open to enable the fracturing of the formation. Valve assemblies can then be provided with various devices and apparatuses to enable the production of reservoir fluids. Due to some of the functionalities of these devices and apparatuses, they are often run downhole on a work string after having cemented the wellbore and fractured the reservoir in order to prevent damaging the devices. Running down work strings to reach valve assemblies dispersed along the wellbore string can be time-consuming and includes inherent costs. There is thus a general need for improvements in providing systems and devices down a wellbore.

SUMMARY

According to an aspect, a valve assembly for integration within a wellbore string disposed along a wellbore defined within a subterranean reservoir is provided. The valve assembly includes a valve housing comprising a top sub, a bottom sub and an outer wall extending between the top and bottom subs, the outer wall defining a central passage therethrough and having a housing port extending through the outer wall for establishing fluid communication between the central passage and the reservoir. The valve assembly also has a bottom sleeve operatively mounted within the valve housing and slidable within the central passage between a closed position where the bottom sleeve occludes the housing port, and an open position where the bottom sleeve is spaced from the housing port to establish fluid communication between the reservoir and the wellbore string through the housing port. The valve assembly further includes a top sleeve operatively mounted within the valve housing between the bottom sleeve and the top sub, the top sleeve and the valve housing defining an annular region therebetween with the top sleeve being provided with a sleeve port and being slidable within the valve housing between (i) a first position where the sleeve port is occluded by the outer wall of the valve housing and where a restricted flowpath is defined between the outer wall and the top sleeve at an uphole end thereof to enable an ingress of wellbore fluid into the annular region, and (ii) a second position where the sleeve port communicates with the housing port to define a fluid pathway along which reservoir fluids are flowable from the reservoir, through the housing port and the sleeve port, into the annular region, along the annular region toward the uphole end of the top sleeve and into the central passage of the valve housing; and a flow control device coupled to the top sleeve and operable to control a flow of fluids along the fluid pathway when the top sleeve is in the production position. When in the first position, the top sleeve is in sealing engagement with the valve housing for defining a dead-end chamber within the annular region, the dead-end chamber being in fluid communication with the central passage via the restricted flowpath to enable fluid pressurization of the dead-end chamber and prevent cementitious material from flowing into the annular region, the flow control device being positioned within the dead-end chamber and being isolated from the cementitious material when the top sleeve is in the first position.

According to a possible implementation, the flow control device includes a directional control valve device adapted to prevent fluid flow in at least one direction between the central passage and the reservoir, when the top sleeve is in the second position.

According to a possible implementation, the directional control valve device is adapted to prevent fluid flow from the central passage to the sleeve port via the annular region, and allow fluid flow from the sleeve port to the central passage via the annular region.

According to a possible implementation, the top sleeve comprises a sleeve mandrel defining a sleeve passage therethrough, a collet coupled to an uphole end of the sleeve mandrel and being adapted to releasably engage an inner surface of the outer wall, and a sleeve cap coupled to a downhole end of the sleeve mandrel, the sleeve cap being provided with the sleeve port, where at least one of the sleeve mandrel and the sleeve cap sealingly engages the outer wall to define the dead-end chamber.

According to a possible implementation, the top sleeve comprises a latching mechanism configured to releasably connect the top sleeve to the outer wall when the top sleeve is in the first position and/or the second position.

According to a possible implementation, the outer wall comprises inner annular grooves and the latching mechanism comprises one or more protrusions adapted to releasably engage at least one of the annular grooves when the top sleeve is in the first position and/or the second position.

According to a possible implementation, when the top sleeve is in the first position, the collet is adapted to engage the top sub and the outer wall, and wherein the restricted flowpath is defined between the top sub, the outer wall and the collet.

According to a possible implementation, the sleeve mandrel comprises a ring portion extending into the annular region and engaging the inner surface of the outer wall, the ring portion defining a downhole annular region in fluid communication with the sleeve port, and an uphole annular region in fluid communication with the central passage, the ring portion comprises one or more through channels establishing fluid communication between the uphole and downhole annular regions.

According to a possible implementation, the one or more through channels comprise a plurality of through channels provided at regular intervals around the sleeve mandrel.

According to a possible implementation, the directional control valve device comprises a displaceable member provided within the uphole annular region and being movable between an engaged position, where the displaceable member at least partially prevents fluid communication between the uphole and downhole annular regions, and a disengaged position, where fluid communication between the uphole and downhole annular regions is allowed, the directional control valve device further comprises a biasing member operatively coupled to the displaceable member for biasing the displaceable member in the engaged position.

According to a possible implementation, the displaceable member is movable from the engaged position to the disengaged position via fluid flow from the reservoir into the downhole annular region and the through channels.

According to a possible implementation, the directional control valve device comprises an axial check valve device, and wherein the displaceable member comprises a ring plug member slidably mounted about the sleeve mandrel, and the biasing member comprises a spring provided about the sleeve mandrel and operatively coupled between the ring plug member and the collet to bias the ring plug member in the engaged position.

According to a possible implementation, the ring plug member comprises a front edge adapted obstruct the through channels to at least partially prevent fluid communication between the uphole and downhole annular regions when in the engaged position, and wherein fluid flow from the reservoir into the through channels pushes on the front edge and slides the ring plug member in the disengaged position.

According to a possible implementation, the ring portion comprises an overhang extending into the uphole annular chamber, and wherein the front edge is tapered and adapted to sealingly engage the overhang when in the engaged position.

According to a possible implementation, the front edge of the ring plug member is circumferentially continuous.

According to a possible implementation, the directional control valve device comprises a radial check valve device, and wherein the displaceable member comprises a plurality of radial poppets provided about the ring portion for obstructing respective through channels when in the engaged position.

According to a possible implementation, the flow control device comprises a screen superposed with the sleeve port to allow fluid flow from the reservoir into the annular region, and prevent various particulates from entering the top sleeve and/or the central passage.

According to a possible implementation, the sleeve port comprises a plurality of elongate slots provided around the sleeve cap and opening on an outer surface of the sleeve cap, and wherein the screen comprises one or more circumferential openings defined along an interior surface of the sleeve cap and in fluid communication with the elongate openings through a bottom surface thereof.

According to a possible implementation, the circumferential openings are generally perpendicular relative to the elongate slots.

According to another aspect, a valve assembly for integration within a wellbore string disposed along a wellbore defined within a subterranean reservoir is provided. The valve assembly includes a valve housing comprising a top sub, a bottom sub and an outer wall extending between the top and bottom subs, the outer wall defining a central passage therethrough and having a housing port extending through the outer wall for establishing fluid communication between the wellbore string and the reservoir; a bottom sleeve operatively mounted within the valve housing and slidable within the central passage between a closed position where the bottom sleeve occludes the housing port, and an open position where the bottom sleeve is spaced from the housing port to establish fluid communication between the reservoir and the wellbore string through the housing port; a top sleeve operatively mounted within the valve housing between the bottom sleeve and the top sub, the top sleeve and the valve housing defining an annular region therebetween, the top sleeve being provided with a sleeve port and being slidable within the central passage between (i) a first position where the sleeve port is occluded by the outer wall of the valve housing and where a restricted flowpath is defined between the outer wall and the top sleeve at an uphole end thereof to enable an ingress of fluid into the annular region, and (ii) a production position where the sleeve port communicates with the housing port to define a fluid pathway along which fluids are flowable from the reservoir, through the housing port and the sleeve port, into the annular region, along the annular region toward the uphole end of the top sleeve and into the central passage of the valve housing; and one or more seals provided between the top sleeve and the outer wall for sealing a downhole end of the annular region and defining a dead-end chamber along the annular region when the top sleeve is in the first position, where the ingress of fluid into the annular region via the restricted flowpath pressurizes the dead-end chamber to prevent cementitious material from flowing into the annular region during completion of the wellbore.

According to a possible implementation, the valve assembly further includes a flow control device coupled to the top sleeve and operable to control a flow of fluids along the fluid pathway when the top sleeve is in the production position, and where the flow control device is provided within the dead-end chamber and isolated from the cementitious material when the top sleeve is in the first position.

According to another aspect, a valve assembly for integration within a wellbore string disposed along a wellbore defined within a subterranean reservoir is provided. The valve assembly includes a valve housing having an outer wall defining a central passage therethrough and having a housing port extending through the outer wall; a bottom sleeve operatively mounted within the valve housing and slidable within the central passage between a closed position occluding the housing port, and an open position; a top sleeve operatively mounted within the valve housing and defining an annular region therebetween, the top sleeve having a sleeve port and being slidable within the central passage between (i) a first position where a downhole end of the top sleeve sealingly engages an inner surface of the valve housing and defines an annular chamber within the annular region, and (ii) an operational position where the sleeve port is in fluid communication with the housing port to define a fluid pathway along which fluids are flowable from the reservoir through the annular chamber and into the central passage; and a flow control device provided within the annular region and being operable to control a flow of fluids along the fluid pathway when the top sleeve is in the operational position. The annular chamber is in fluid communication with the central passage for allowing wellbore fluid to flow into and pressurize the annular chamber to prevent subsequent fluid, particulates and/or slurry material from flowing into the annular chamber, and where the sleeve port and flow control device are positioned within the annular chamber when in the first position.

According to a possible implementation, the subsequent fluid, particulates and/or slurry material comprises cement.

According to a possible implementation, the wellbore fluid comprises brine, water, drilling mud or a combination thereof.

According to another aspect, a valve assembly for integration within a wellbore string disposed along a wellbore defined within a subterranean reservoir is provided. The valve assembly includes a valve housing having an outer wall defining a central passage therethrough and having a housing port extending through the outer wall; a valve sleeve operatively mounted within the valve housing and defining an annular region therebetween, the valve sleeve having a sleeve port and being slidable within the valve housing between (i) a closed position where a downhole end of the valve sleeve occludes the housing port to prevent fluid communication between the reservoir and the central passage, and (ii) an operational position where the sleeve port is in fluid communication with the housing port to define a fluid pathway along which fluids are flowable from the reservoir through the annular region and into the central passage, when in the closed position, the downhole end of the valve sleeve sealingly engages an inner surface of the outer wall and defines an annular chamber within the annular region, the annular chamber being in fluid communication with the central passage for allowing wellbore fluid to flow into and enable fluid pressurization of the annular chamber to prevent subsequent fluid, particulates and/or slurry material from flowing into the annular region, and where the sleeve port is positioned within the annular chamber when in the first position.

According to a possible implementation, the valve assembly further includes a flow control device, where the flow control device is integrated in the fluid pathway when the valve sleeve is in the operational position.

According to a possible implementation, the flow control device is provided within the annular chamber when the valve sleeve is in the closed position.

According to a possible implementation, the flow control device comprises a screen superposed with the sleeve port for enabling screened fluid communication between the reservoir and the annular region.

According to a possible implementation, the flow control device comprises a directional control valve device provided within the annular region to prevent fluid flow in at least one direction between the central passage and the reservoir.

According to a possible implementation, the top sleeve is slidable within the valve housing to an open position where the housing port is in fluid communication with the central passage, and where fluid flow from the reservoir into the annular region is prevented.

According to a possible implementation, the subsequent fluid, particulates and/or slurry material comprises cement, and the wellbore fluid comprises brine, water, drilling mud or a combination thereof.

According to another aspect, a valve assembly for integration within a wellbore string disposed along a wellbore defined within a subterranean reservoir is provided. The valve assembly includes a valve housing comprising an outer wall defining a central passage therethrough and having a housing port extending through the outer wall; a valve sleeve assembly operatively mounted within the valve housing and comprising a bottom sleeve slidable within the central passage between a closed position occluding the housing port, and an open position; a top sleeve defining an annular region between an outer surface thereof and an inner surface of the outer wall, the top sleeve being slidable within the valve housing between (i) a first position where a downhole end of the top sleeve is axially spaced from the housing port, and (ii) a second position where the downhole end at least partially extends over the housing port; and a flow-controlling sleeve having a sealed end sealingly engaging the inner surface of the outer wall to define an annular chamber within the annular region, the flow-controlling sleeve having a sleeve port and a flow control device proximate the sleeve port, the flow-controlling sleeve being slidable within the valve housing between (i) a shrouded position where the sleeve port and flow control device are provided within the annular chamber, and (ii) a flow-controlling position where the sleeve port is in fluid communication with the housing port to define a fluid pathway along which fluids are flowable from the reservoir through the housing port, through the sleeve port and into the central passage. The annular chamber being in fluid communication with the central passage for allowing wellbore fluid to flow into and enable fluid pressurization of the annular chamber to prevent subsequent fluid, particulates and/or slurry material from flowing into the annular region, and where the flow control device is provided along the fluid pathway when in the flow-controlling position.

According to a possible implementation, the downhole end of the top sleeve is adapted to prevent fluid communication between the sleeve port and the central passage when in the second position, and wherein the fluid pathway is defined by moving the top sleeve from the second position to the first position.

According to a possible implementation, the flow-controlling sleeve comprises an internal shoulder proximate the sealed end and extending into the central passage, the top sleeve being adapted to engage the internal shoulder to push the flow-controlling sleeve, whereby moving the top sleeve from the first position to the second position correspondingly displaces the flow-controlling sleeve from the shrouded position to the flow-controlling position.

According to a possible implementation, the flow-controlling sleeve comprises a latching mechanism configured to releasably connect the flow-controlling sleeve to the outer wall when the flow-controlling sleeve is in one of the shrouded position and the flow-controlling position.

According to a possible implementation, the latching mechanism is adapted to retain the flow-controlling sleeve in the flow-controlling position when moving the top sleeve from the second position to the first position.

According to a possible implementation, the flow control device comprises a screen superposed with the sleeve port to allow fluid flow from the reservoir through the screen and into the central passage, the screen being configured to prevent various particulates from entering the valve housing and/or the central passage.

According to another aspect, a valve assembly for integration within a wellbore string disposed along a wellbore defined within a subterranean reservoir is provided. The valve assembly includes a valve housing comprising an outer wall defining a central passage therethrough and having a housing port extending through the outer wall; a valve sleeve assembly operatively mounted within the valve housing and defining an annular region within the valve housing, the valve sleeve assembly comprising a valve sleeve having a sleeve port and being slidable within the valve housing between (i) a first position where a downhole end of the valve sleeve sealingly engages an inner surface of the outer wall to define an annular chamber within the annular region, and (ii) an operational position where the sleeve port is in fluid communication with the housing port to define a fluid pathway along which fluids are flowable from the reservoir into the central passage; and a flow control device provided within the annular region and being operable to control a flow of fluids along the fluid pathway when the valve sleeve is in the operational position. The annular chamber being in fluid communication with the central passage for allowing wellbore fluid to flow into and enable fluid pressurization of the annular chamber to prevent subsequent fluid, particulates and/or slurry material from flowing into the annular region, and where the sleeve port is positioned within the annular chamber when in the first position.

According to another aspect, a method of operating a well for primary production of hydrocarbons is provided. The method includes running a wellbore string provided with one or more valve assemblies as defined above down the well; pressurizing the annular chamber to create a pressure balance between the annular chamber and the central passage; pumping cement slurry down the wellbore string for cementing the wellbore string down the well; shifting one or more valve sleeves for operating the valve assembly in the open configuration; injecting fracturing fluid through the housing port for fracturing the wellbore; shifting one or more valve sleeves for defining a production fluid pathway along which reservoir fluid is flowable through the housing port, through the annular region provided with the flow control device and into the central passage.

DETAILED DESCRIPTION

Figure 1:
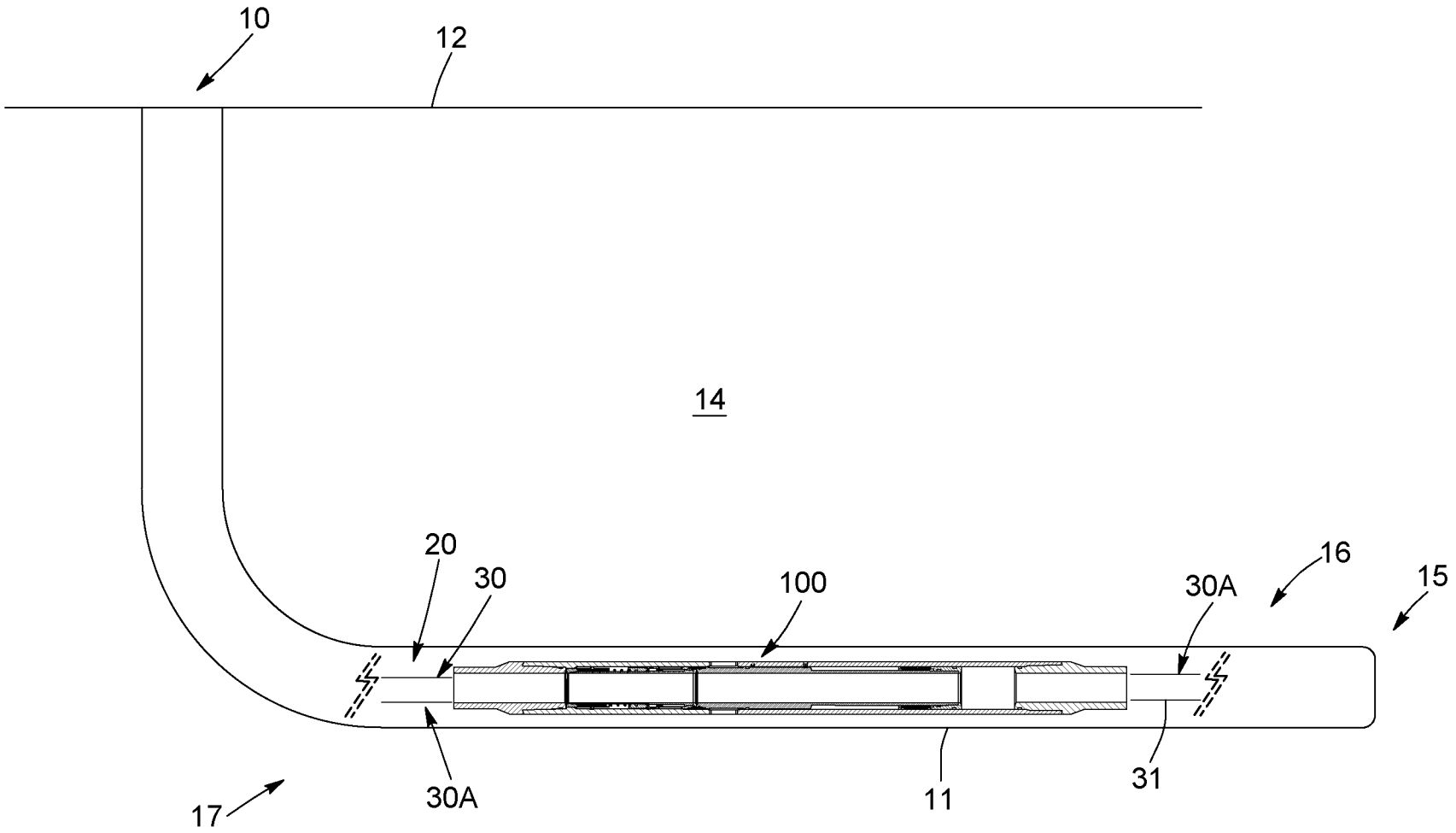
FIG. 1 is a transverse cut view of a wellbore with downhole components integrated along a wellbore string in a horizontal section extending in a reservoir, according to an implementation.

As will be explained below in relation to various implementations, the present disclosure describes devices, systems and methods for various operations, such as the injection of fluids and the recovery of hydrocarbon material from a subterranean reservoir. The present disclosure more specifically relates to a well completion system, and corresponding structural features, operable for the injection and recovery of fluids, such as hydrocarbons, via a wellbore. The well completion system is configured to be installed within the wellbore and includes a wellbore string comprising one or more valve assemblies operable to inject fluid (e.g., a fluid for stimulating hydrocarbon production via a drive process, such as waterflooding, or via a cyclic process, such as "huff and puff") into the subterranean reservoir, and also to produce reservoir fluids. In other words, the valve assemblies can be configured to enable both injection and production operations within the reservoir. The valve assembly can also include an annular chamber in which an apparatus, a subsystem or a device, such as a flow control device, is provided, enabling the device to be deployed downhole along with the wellbore string (e.g., instead of being run downhole as part of a subsequent work string).

The valve assembly can be shifted, operated, or otherwise moved, into different configurations to define different flow pathways at different stages of operation. As will be described further below, the valve assembly can be adapted to define a first flow pathway and a second flow pathway which can be defined by two partially independent passages along which fluid can flow. In other words, and for example, the first and second flow pathways are not identical (e.g., structurally), but can share common components, such as inlets.

In some implementations, the valve assembly includes a valve housing having a central passage therethrough and a plurality of frac ports extending radially through an outer wall thereof for establishing fluid communication between the passage and the reservoir. The valve assembly further includes a pair of sleeves, which can be slidably mounted within the housing and configured to selectively close and open the frac ports. The housing and the sleeves define the at least two fluid pathways which can be at least partially isolated from one another, and along which fluid flows to and/or from the reservoir. As will be described further below, one of the pathways includes the annular chamber provided with the flow control device, such that fluid is confined to flow through the annular chamber and where fluid flow is at least partially controlled by the flow control device.

It will be understood that the valve assembly described herein can be used in relation with cemented wellbore string applications, such as with multistage fracturing (also referred to as "fracking") operations, for example. In fracturing operations, the wellbore can first be dug out (e.g., drilled) and lined with casing, and then cement slurry can be pumped down the casing towards a toe of the wellbore and back up an annulus defined between the casing and the reservoir (i.e., the walls of the wellbore). In order to push the cement slurry past the toe and into the annulus, a wiper plug can be pumped down the casing to effectively wipe the slurry from the interior of the wellbore. Once within the annulus, the cement can be allowed to cure, thus cementing the casing within the wellbore.

In the context of the present disclosure, the valve assembly can be installed between lengths of casing at desired locations. These locations can be determined based on where perforations would have been created using a perforating gun, for example. After the casing and valve assemblies are in place down the wellbore, the casing and valve assemblies are cemented in place using cementing techniques such as those noted above. It is noted that the cementing process can interfere with the operation of the sleeves or other moving parts of the valve assembly. The sleeves can therefore be designed to accommodate the cementing process whereby cement is prevented from entering any ports, slots, recesses and the like, that might not be cleaned by the wiper plug, such as the annular chamber, for example. Furthermore, in order to prevent the sleeves from being moved by the wiper plug (or by subsequent well equipment, cleaning, etc.), the sleeves can be held in position by shear pins or other securing mechanisms, as will be described further below.

The valve assembly can further include interstices defined between various components thereof (the sleeve, the housing, etc.) which establish fluid communication between a central passage of the valve assembly and the annular chamber. The interstices are sized and adapted to allow fluid, e.g., water, gas, etc., to flow into and pressurize the annular chamber. The valve assembly also includes an arrangement of seals which prevents fluid from flowing out of the annular chamber, which defines a dead-end annular chamber and facilitates pressurization thereof. As such, when pumping slurry material, e.g., cement, down the wellbore in order to secure the wellbore string, the pressurized annular chamber prevents the cement from flowing into the dead-end annular chamber, thereby preventing cement from contacting and potentially damaging the flow control device. The fluid which initially flows into the annular chamber can be residual fluid from drilling out the wellbore (e.g., brine, water, drilling mud, etc.), which pressurizes the annular chamber and prevents subsequent fluid or material being pumped downhole from flowing into the annular chamber.

It should thus be noted that the valve assembly is shaped, sized and adapted to be integrated as part of the wellbore string, and is secured in place (e.g., cemented) down the wellbore along with the wellbore string. The valve assembly is further adapted to isolate, or "shroud" components provided within the dead-end annular chamber while the valve assembly is in the run-in, or closed configuration. The valve assembly is operable between various configurations for allowing fluid to be injected within the reservoir, and reservoir fluid to be produced from the reservoir into the valve assembly for ultimate recovery to surface. In some implementations, the valve assembly is a dual-barrel valve assembly configurable between the closed configuration, where the ports of the valve housing are occluded, the open configuration, where the ports are open and fluid communication can be established between the reservoir and the fluid passage of the wellbore string, and a flow restricted configuration, where the flow control device is moved and aligned with the ports of the housing, thereby creating a fluid pathway which cooperates with the flow control device. As mentioned above, in some implementations, the flow control device is provided within the annular chamber, therefore it is noted that the fluid pathway created when in the flow restricted configuration can flow through the annular chamber defined between the valve sleeve and the exterior housing.

In an exemplary implementation, the flow control device includes a screened configured to have fluid produced from the reservoir flow through it, thus preventing large particulates from entering the wellbore string and being produced to surface. The flow control device can alternatively, or additionally include a check valve which prevents fluid flow in a specific direction. For example, the valve assembly can be operated as a production-only valve assembly, where the check valve prevents the injection of fluid into the reservoir when the valve assembly is in the flow restricted configuration. The wellbore string can include multiple valve assemblies and can thus be operated for various applications, such as asynchronous frac-to-frac operations, where the reservoir is fractured, the valve assemblies are shifted in the open configuration for the injection of fluid into the reservoir, and then shifted in the flow restricted configuration to initiate a screened production of reservoir fluids. The well completion system can also be used in other applications, such as geothermal applications. It is also noted that the well completion system can be used in applications where the formation is not required to be fractured but has a permeability that enables fluid injection or includes naturally formed fractured.

It should also be noted that enabling an initial ingress of fluids within the annular region (e.g., within the annular chamber) creates a pressure-balanced system between the annular chamber and the central passage of the valve assembly. This pressure-balanced system enables the use of valve sleeves having relatively thin walls since the wall is not submitted to a pressure differential between the annular chamber and the central passage. The pressure-balanced system therefore assists in preventing collapse of the valve assembly during pressurization of the annular region, during the cementing process and during various operations of the valve assembly. It should be understood that the annular chamber is in fluid-pressure communication with the central passage, and that this pressure-balanced system also prevents subsequent fluids or materials from flowing into the annular chamber, and instead flow towards an opened port, for example. Therefore, components provided within the annular chamber are protected from potentially damaging fluids and/or material, such as cement, for example.

It is noted that the completion system and the valve assemblies described herein can be implemented in various wellbores, formations, and for various applications. In some implementations, the wellbore can be straight, curved, or branched, and can have various wellbore sections. A wellbore section should be considered to be an axial length of a wellbore. A wellbore section can be characterized as "vertical" or "horizontal" even though the actual axial orientation can vary from true vertical or true horizontal, or can tend to undulate or corkscrew or otherwise vary. The term "horizontal", when used to describe a wellbore section, refers to a horizontal or highly deviated wellbore section as understood in the art, such as a wellbore section having a longitudinal axis that is between 70 and 110 degrees from vertical. For simplicity, it is noted that most of the conduits, channels, passageways, pipes, tubes and/or other similar components referred to in the present disclosure have a cross-section that is preferably circular or annular, although it should be appreciated that other shapes are also possible.

Figure 2:
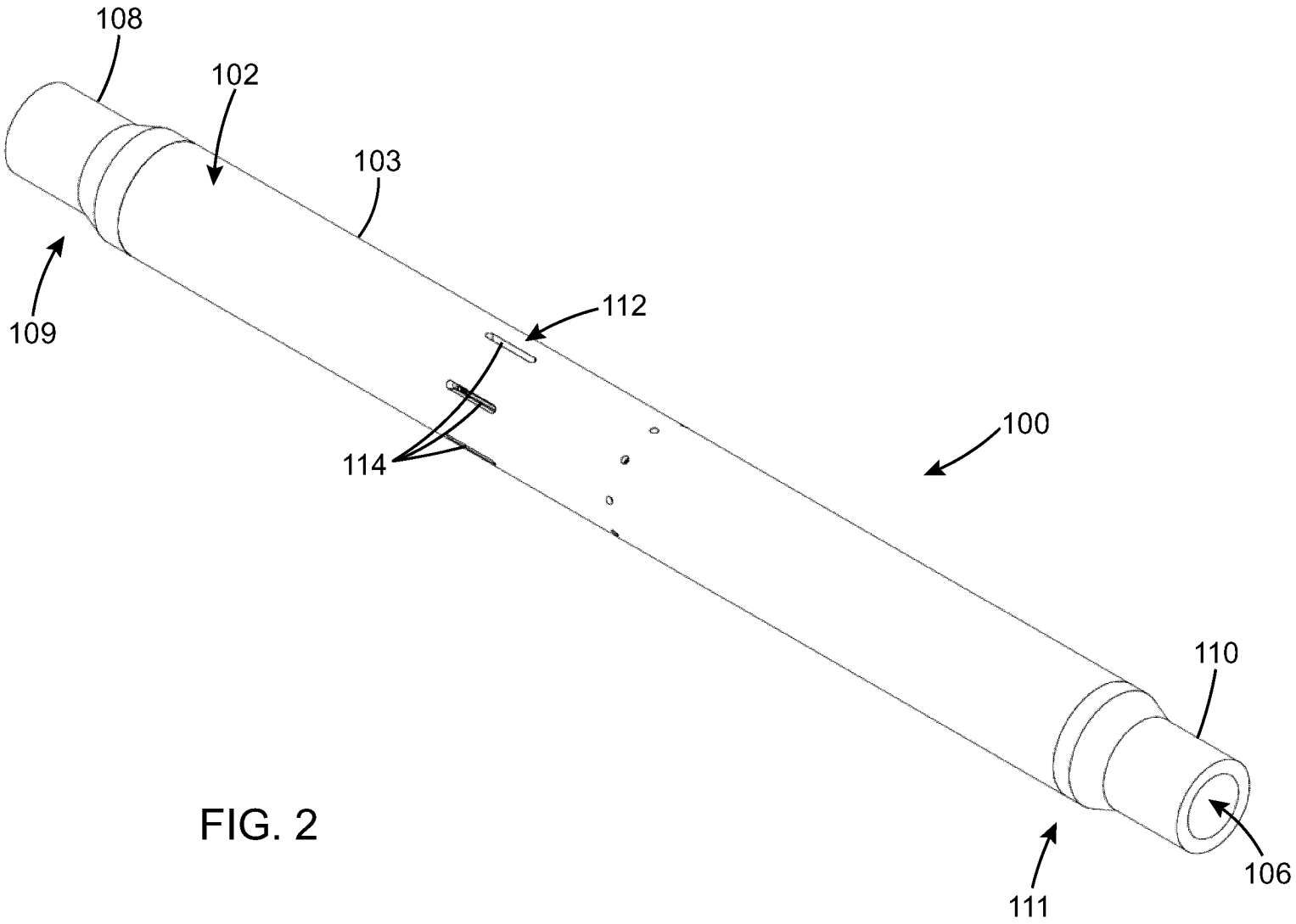
FIG. 2 is a perspective view of a valve assembly comprising a housing port to enable fluid communication between the wellbore and the wellbore string, according to an implementation.

With reference to FIGS. 1 and 2, a wellbore 10 extends from the surface 12 and into a reservoir 14. A well completion system 20 including one or more valve assemblies 100 can be integrated as part of a wellbore string 30 extending within the wellbore 10. The wellbore string 30 defines a wellbore string passage 30A for conducting fluid between the surface 12 and the reservoir 14. In some implementations, the valve assemblies 100 each include at least one passage allowing fluid flow therethrough. It should therefore be understood that the valve assemblies include passages that can form part of the wellbore string passage 30A along at least a portion of the wellbore, such that fluid communication between the surface 12 and the reservoir 14 can be established via the valve assemblies 100. More specifically, and as will be described below, the valve assembly 100 can be provided with one or more ports at respective locations along the wellbore for establishing fluid communication between the wellbore string 30 and the reservoir 14. It is also noted that conduits 31 of the wellbore string 30 can be located on either end of the valve assembly 100 and can be coupled to respective ends thereof by any suitable method. It is also possible to connect some or all of the valve assemblies end-to-end without any intervening conduits 31.

As seen in FIG. 1, the wellbore 10 can include a horizontal wellbore section 16 having a toe 15 and a heel 17 at respective ends thereof. It should be understood that, as used herein, the expression "toe" refers to an end region of the horizontal wellbore section, such as the end region furthest from surface. Similarly, the expression "heel", as used herein, refers to the opposite end region of the horizontal section, i.e., the beginning of the horizontal wellbore section 16, and may include at least part of the curved transition section between the horizontal and vertical sections of the wellbore 10. Therefore, the expressions "downhole" and "uphole" used herein can refer to directional features, whereby uphole is in a general direction towards the heel 17, and downhole is in a general direction towards the toe 15.

Figure 3:
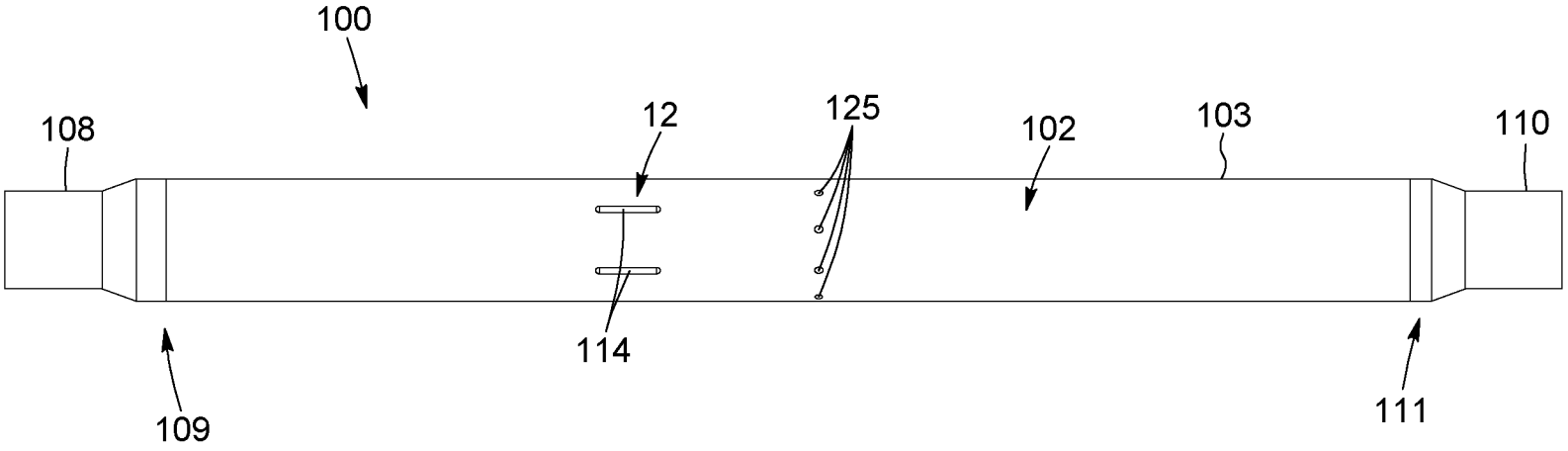
FIG. 3 is a side view of the valve assembly shown in FIG. 2.
Figure 4:
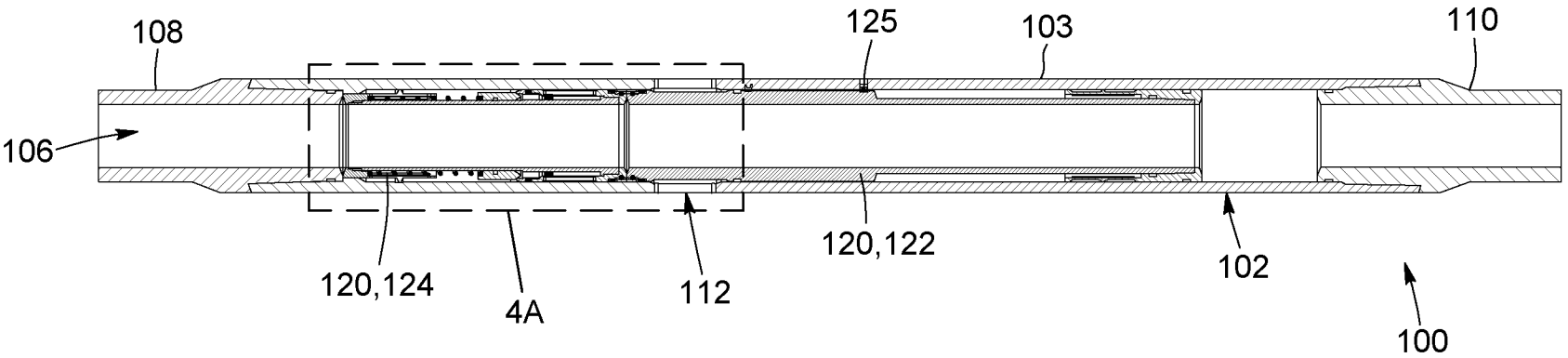
FIG. 4 is a cross-sectional view of the valve assembly shown in FIG. 3, showing a pair of valve sleeves operatively coupled along a passage of the valve assembly, according to an implementation.

With reference to FIGS. 3 to 4, in addition to FIGS. 1 and 2, the valve assembly 100 includes a valve housing 102 having an outer tubular wall 103 defining a central passage 106 for enabling fluid communication through the housing 102 (e.g., axially through the housing 102). In other words, the central passage 106 can act as a fluid passage configured to allow a flow of fluid therethrough and along the wellbore string. Referring more specifically to FIGS. 2 and 3, the valve housing 102 includes a top sub 108 provided at an uphole end 109 of the outer wall 103, and a bottom sub 110 provided at a downhole end 111 thereof. The top and bottom subs 108, 110 are secured to the outer wall 103 via interference fit, although other connection methods can be used, such as via threaded connectors, via a slot and key connection or via fasteners. The top and bottom subs can also be connected between lengths of conduits or other components of the valve assembly 100, thereby enabling the integration of the valve assembly with the wellbore string 30.

The valve housing 102 also includes a housing port 112 extending through the outer wall 103 and through which fluid communication between the central passage 106 and an environment external to the housing 102 (e.g., the reservoir 14) is established. In some implementations, the housing port 112 includes a plurality of openings 114 (e.g., two, three, four, six, eight, etc.) defined through the outer wall 103, although a single opening could be used. The openings 114 can be formed as generally straight and tubular openings through the outer wall 103, although any other suitable shapes, configurations and/or number of openings can be used. As seen in FIGS. 2 and 3, the openings 114 can be distributed (e.g., evenly/at regular intervals) about a circumference of the outer wall 103. The openings can also have different cross-sectional areas and shapes, e.g., cylindrical, frustoconical, tapered toward or away from the reservoir, etc. In some implementations, the openings can also be open during deployment downhole or could have a temporary plug or cap that is expelled due to the pressure of the fracturing fluid during the fracturing operation. It should be noted that the valve assembly 100 can be used for fracturing operations, where fracturing fluid is injected into the reservoir via the housing port 112. As such, it is appreciated that the openings 114 of the housing port 112 can correspond to frac ports.

In some implementations, the valve assembly 100 is configurable in a plurality of operational configurations, and each one of the operational configurations, independently, corresponds to a state of fluid communication, via the housing port 112, between the central passage 106 and the surrounding reservoir. In other words, fluid flow through the housing port 112 can be at least partially controlled via a change in the operational configuration of the valve assembly 100 (e.g., a change from a first operational configuration to a second operational configuration). In some implementations, the valve assembly 100 can be configurable between a closed configuration (seen in FIG. 4), where the housing port 112 is blocked or closed; an open configuration (seen in FIG. 5), where the housing port 112 is unobstructed or open and where fluid can be injected within the reservoir via the housing port 112; and a flow-restricted configuration (seen in FIG. 6), where production fluid is produced from the reservoir and is confined to flow along a fluid pathway provided with a flow control device. The valve assembly 100 can also move to a configuration where production fluid is received within the passage 106 but does not flow along the fluid pathway if the latter is kept enclosed and sealed. In order to operate the valve assembly 100 in these various configurations, the valve assembly 100 includes one or more inner sleeves, or valve sleeves 120, operatively mounted within the housing 102 and displaceable between various positions.

The sleeves 120 can be provided with various features and/or in various configurations in order to be displaceable and to provide the different (e.g., non-identical) flow pathways for fracturing, injecting and producing. Some features and implementations of possible sleeve arrangements are described below.

Figure 4A:
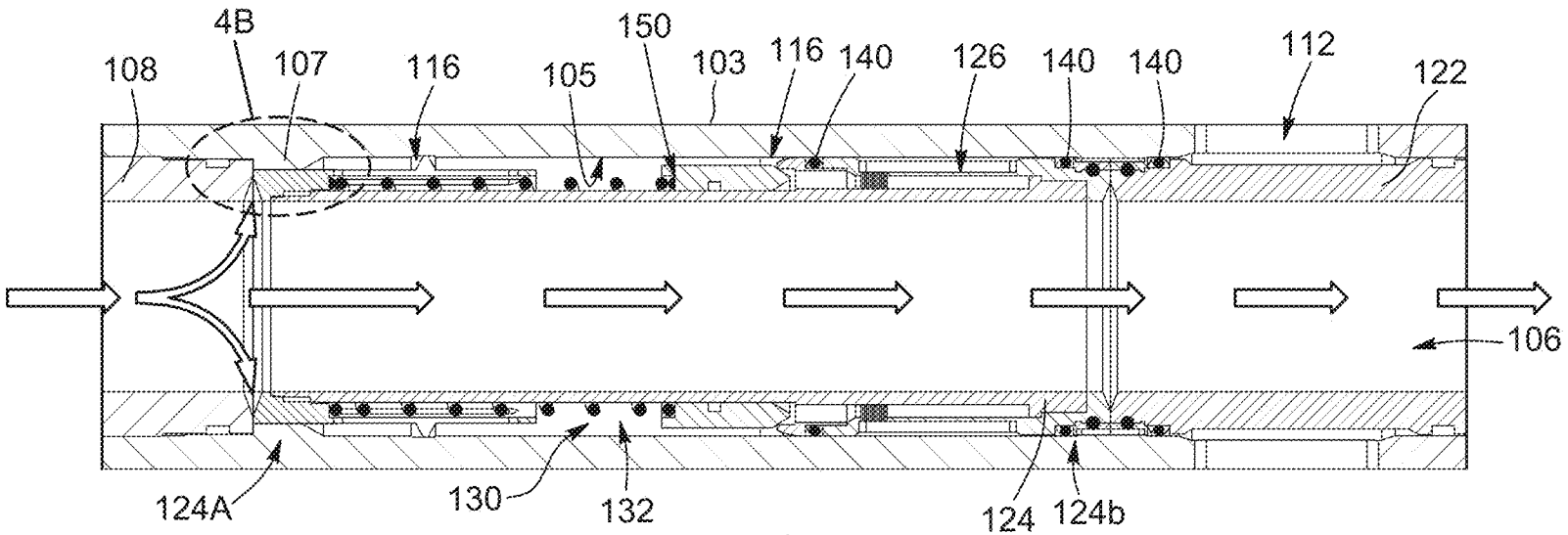
FIGS. 4A, 4B and 4C are enlarged views of portions of FIGS. 4, 4A and 4B respectively, showing a fluid flowpath enabling fluid flow into an annular region, according to an implementation.

Still referring to FIG. 4, and with further reference to FIGS. 4A, the valve sleeves 120 are operatively mounted within the housing 102 and are operable for selectively closing and opening the housing port 112. In this implementation, the valve sleeves 120 include a pair of valve sleeves slidably mounted within the housing 102 for moving axially therealong (e.g., sliding or shifting along inner surfaces 105 of the housing within the passage 106). More particularly, the valve sleeves 120 include a bottom sleeve 122 (or downhole sleeve) mounted within a downhole portion of the housing 102, and a top sleeve 124 (or uphole sleeve) mounted within an uphole portion of the housing. The valve sleeves 120 can be substantially aligned with one another and both include a bore therethrough such that fluid can flow freely along the valve assembly 100 (e.g., from one sleeve to the other and through the housing). The valve sleeves 120 can be independently displaced with respect to one another along the passage 106 and can be arranged in various positions in order to direct fluid flow into predetermined fluid pathways of the valve assembly 100.

The valve sleeves 120 can be mounted within the housing 102 in a manner allowing the sleeves to shift from one position to another. It should be understood that the expression "shift" can refer to the displacement of the valve sleeves 120 using a shifting tool, for example, or a self-shifting mechanism provided as part of the valve assembly 100 such that the sleeves can be toollessly operated, for example. As seen in FIGS. 4 and 4A, the valve assembly 100 can be operated in a closed configuration, with the bottom sleeve 122 being mounted in the housing in an occluding, or closed position, where the housing port 112 is blocked by the bottom sleeve 122. Moreover, the top sleeve 124 can be mounted uphole of the bottom sleeve 122 in a first position, or "run-in-hole position". It is appreciated that, when the bottom sleeve 122 is in the closed position, the top sleeve 124 remains in the first position. As will be described further below, the top sleeve 124 is mounted within the valve housing 102 in a manner defining an annular region 130 between an outer surface of the top sleeve 124 and the inner surface 105 of the outer wall 103. In some implementations, the top and bottom sleeves 122, 124 can be shaped and configured to sealingly engage one another and/or the outer wall 103 such that fluid flow is prevented, or at least reduced, along gaps defined between the housing and the sleeves. While deploying a shifting tool can be a preferred way to shift the sleeves, in an alternative scenario the sleeves can be shifted or otherwise displaced remotely or via the use of other devices.

Figure 4C:
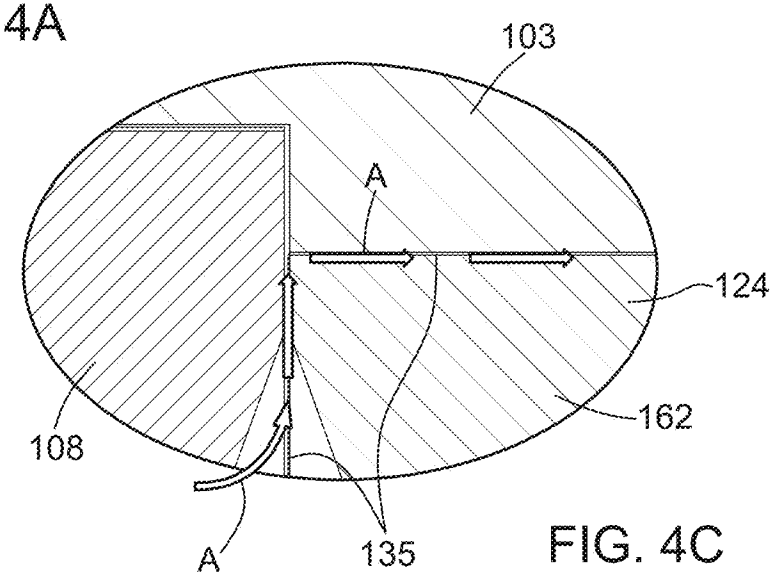

With reference to FIGS. 4 to 4C, when the bottom sleeve 122 is in the closed position, a portion of the bottom sleeve 122 covers the housing port 112 such that fluid cannot flow therethrough. The bottom sleeve 122 can sealingly engage the inner surface of the outer wall 103 such that fluid flow is prevented, or at least reduced, within interstices defined by the housing and the bottom sleeve 122. In some implementations, the valve assembly 100 can include additional elements adapted to prevent, or at least reduce, movement of the sleeves and/or fluid flow into certain regions. For example, in the illustrated implementation, the valve assembly 100 includes seals 140 provided between the sleeves and the outer wall 103. For example, in this implementation, a seal 140 can be provided at the uphole end of the bottom sleeve 122 to prevent fluid communication between the central passage 106 and an environment surrounding the valve assembly 100 when the valve assembly 100 is in the closed configuration.

Still referring to FIGS. 4 to 4C, when in the closed configuration, the top sleeve 124 is positioned within the valve housing 102 in the first position, proximate the top sub 108. More specifically, in this implementation, the uphole end 124*a* of the top sleeve 124 can abut the top sub 108, with the downhole end 124*b* having a greater outer diameter to engage the inner surface 105 of the outer wall 103. The outer wall 103 can also include an internal protrusion, such as an inner ring 107, extending inwardly within the central passage 106 to enable engagement with the uphole end 124*a* of the top sleeve 124. As such, the top sleeve 124 and the outer wall 103 can define an annular chamber 132 within the annular region 130, where the annular chamber 132 is defined radially between the outer surface of top sleeve 124 and the inner surface 105 of the outer wall, and defined axially between the downhole end 124*b* of the top sleeve engaging the outer wall and the uphole end 124*a* of the top sleeve engaging the inner ring 107.

Figure 4B:
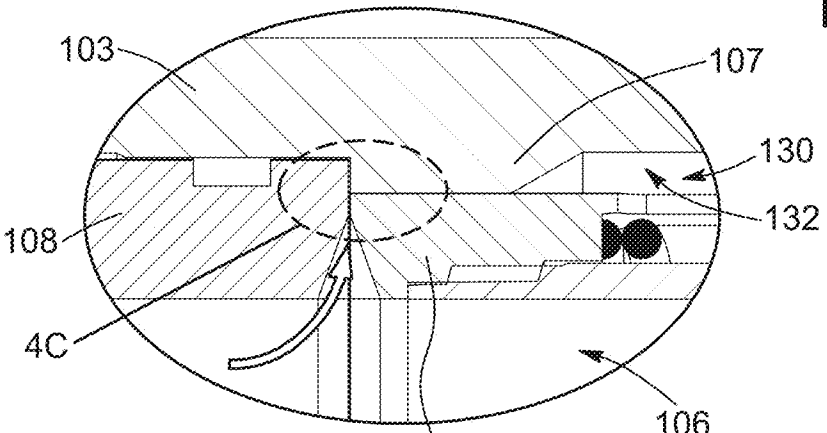

The annular chamber 132 can be in fluid communication with the central passage 106 via one or more interstices 135 defined between the components of the valve assembly 100. As seen in FIGS. 4B and 4C, the interstices 135 can define a restricted flowpath (A) along which fluid can flow from the central passage 106 to the annular chamber 132. The interstices 135 are sized and adapted to allow fluid (e.g., water) to flow into and pressurize the annular chamber 132 while also preventing particulates and/or slurry material (e.g., cement) from flowing into the annular chamber 132. As will be described further below, the top sleeve 124 includes a sleeve port 126 adapted to be aligned with the housing port 112 in order to define a fluid pathway for the production of reservoir fluids. The valve assembly 100 can also include a flow control device 150 coupled to the top sleeve and positioned along the fluid pathway, within the annular region 130. The sleeve port 126 and flow control device 150 are illustratively provided within the annular chamber 132 when the top sleeve 124 is in the first position. As such, it should be noted that the sleeve port 126 and flow control device 150 are isolated, or at least partially protected from particulates and/or slurry material flowing along the central passage 106, such as cement when cementing the wellbore string down the wellbore.

Prior to being shifted, the valve sleeves 120 can be secured in their respective run-in positions using any suitable method. The valve sleeves 120 can be shaped and configured to engage inner surfaces 105 of the corresponding portion of the housing 102. For example, the valve sleeves 120 can have one or more sections having a greater outer diameter for sealingly engaging with the housing 102, and thus maintain the sleeves in position (e.g., via a press-fit connection). Alternatively, or additionally, the housing 102 can have portions that extend inwardly (i.e., into the passage 106) at predetermined sections for engaging with corresponding parts of the valve sleeves 120 and further securing or stabilizing the valve sleeves 120 in position. In some implementations, the valve sleeves 120 can be secured in position using one or more fasteners, such as shear pins 125 extending from the housing 102 and engaging the valve sleeves 120. The shear pins 125 are configured to break in order to allow the valve sleeves 120 to be shifted between positions. In this implementation, the shear pins 125 are configured to retain the sleeves in their initial positions during the completion of the wellbore, and more specifically during cementing of the casing. In other words, the shear pins 125 are configured to retain the sleeves while the sleeves are being installed along the wellbore, and while the wiper plug cleans the interior of the wellbore, as previously described.

The valve assembly 100 can be run downhole in the closed configuration (FIGS. 4 to 4C) where the housing port 112 is blocked and the flow control device is shrouded within the annular chamber in order to secure (e.g., cement) the wellbore string without obstructing the port 112 or damaging the flow control device. Once the wellbore string is cemented, the valve assembly 100 can be operated in an open configuration (FIGS. 5 and 5A) where fluid communication is established between the central passage 106 and the reservoir. The open configuration can also correspond to a fracturing configuration of the valve assembly 100 in order to initiate fracturing of the reservoir. Fracturing generally includes injection of fracturing fluid into the reservoir at high pressure for fracturing the subterranean formation surrounding the valve assembly. The injection of fluid causes the rock of the formation to fracture, thereby enabling the fluid to flow into the fractures. In this implementation, in order to operate the valve assembly 100 in the fracturing configuration, the bottom sleeve 122 can be shifted to a non-occluding position, or open position, in order to open the housing port 112. In some implementation, the bottom sleeve 122 is displaced in the downhole direction until the housing port 112 is open, thus allowing fluid to be injected into the reservoir. However, it is appreciated that other configurations are possible. Furthermore, it should be noted that the top sleeve 124 preferably remains in the first position when operating the valve assembly 100 in the fracturing configuration in order to maintain the housing port 112 open, and the components isolated within the annular chamber 132.

Figure 5:
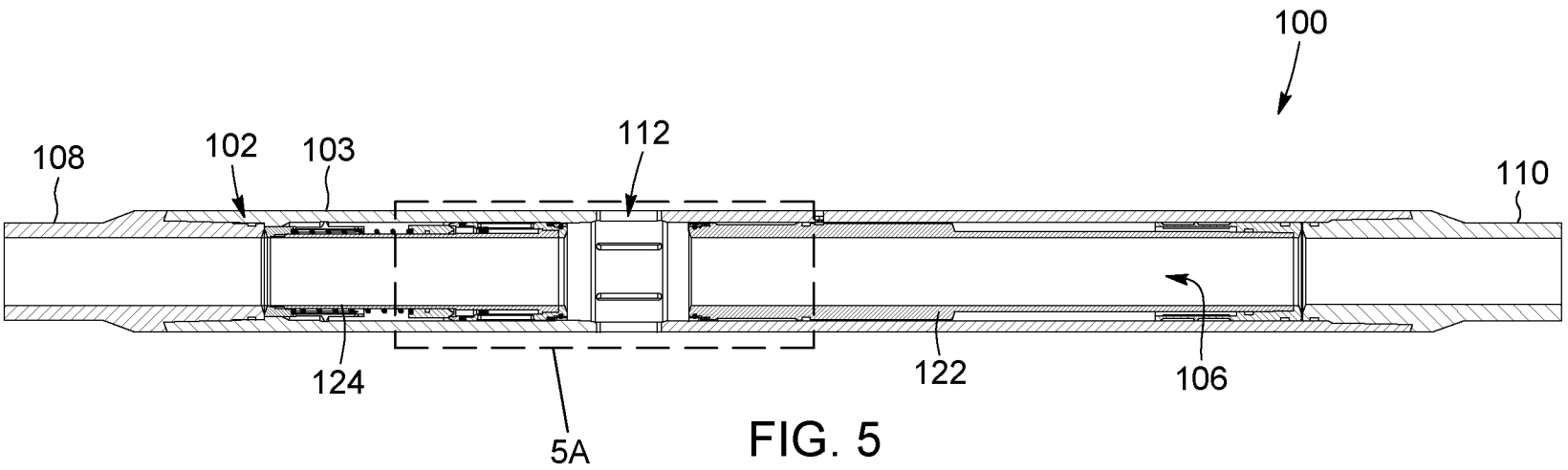
FIG. 5 is a cross-sectional view of the valve assembly, showing the valve assembly in an open configuration, where a bottom sleeve is spaced from the housing port, according to an implementation.
Figure 5A:
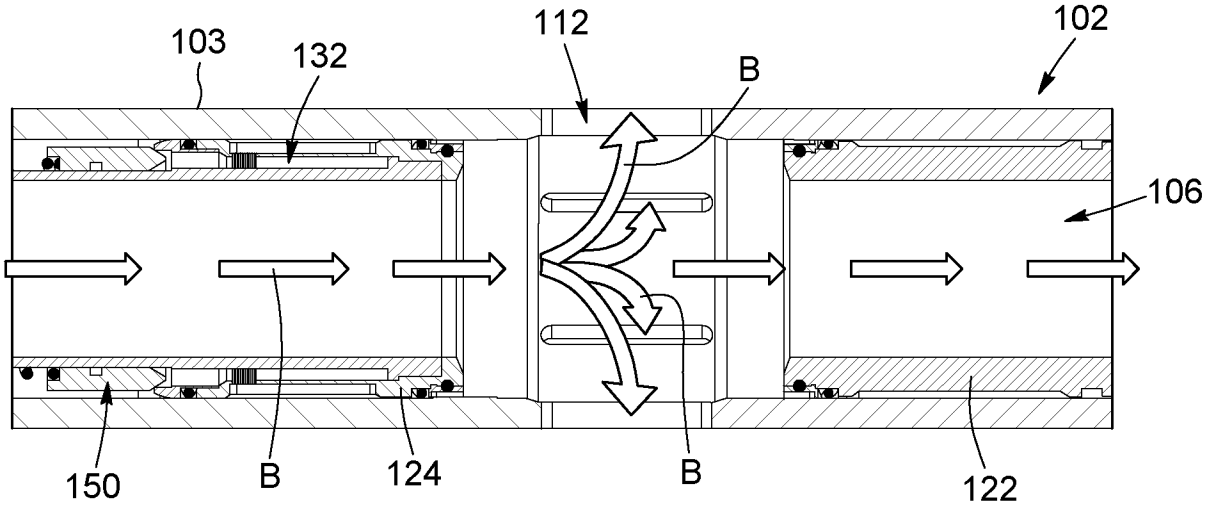
FIG. 5A is an enlarged view of the housing port shown in FIG. 5, showing a fluid flowpath for fluids being injected into the surrounding reservoir, according to an implementation.

With reference to FIGS. 5 and 5A, in this implementation, the valve assembly 100 defines a fracturing fluid pathway (B) (which can also be referred to as an injection fluid pathway) along which the fluid (e.g., fracturing fluid, injection fluid, etc.) flows to reach the housing port 112. The fluid flowing along the fracturing fluid pathway (B) enters the central passage 106 via the top sub 108, flows through the top sleeve 124 and exits the housing 102 (e.g., enters the reservoir) via the housing port 112. However, it is appreciated that other pathways and configurations are possible for routing the fracturing fluid to the reservoir. As described above, the fracturing fluid can be forced through the housing port 112 due to pressure build-up within the housing 102 caused by the presence of a packer, frac plug, or other obstruction (not illustrated) deployed downhole of the valve assembly 10, for example. Furthermore, once fracturing has occured, the bottom sleeve 122 can be shifted uphole, back to the closed position (as seen in FIG. 4) to prevent back flow of the fracturing fluid from the formation and allow "healing" or equilibration of the reservoir prior to a subsequent operation, such as production.

In some implementations, fluid production from the reservoir can be initiated using a pump coupled to the wellbore string configured to pump fluid (e.g., hydrocarbon-containing fluid) uphole along the valve assembly 100 and the wellbore string for recovery thereof at surface. Production can be enabled by a downhole pump, a surface pump or artificial lift, as the case may be. It should be understood that production fluid can be recovered when the valve assembly 100 is in the so-called "fracturing configuration", whereby fluid is pumped through the housing port 112 into the housing 102 and follows the fracturing fluid pathway (B) in the opposite direction (e.g., uphole toward the surface). In some implementations and for some operations, the valve assembly 100 is indeed operated in this manner at least for some time. This operating mode can be referred to as a non-restricted production mode, as the annular chamber 132 remains isolated, and the production fluid pathway does not flow through the flow control device 150. However, as will be described below, the valve assembly 100 can be operated in a flow-restricted configuration, whereby a separate fluid pathway is defined to allow production fluid to flow from the reservoir to the wellbore string through the annular region, through (or around) the flow control device, and ultimately to surface. It is noted that all of the production fluid being recovered via a particular valve assembly while in the flow-restricted configuration can be routed to flow through the annular region, although other configurations are possible.

Figure 6:
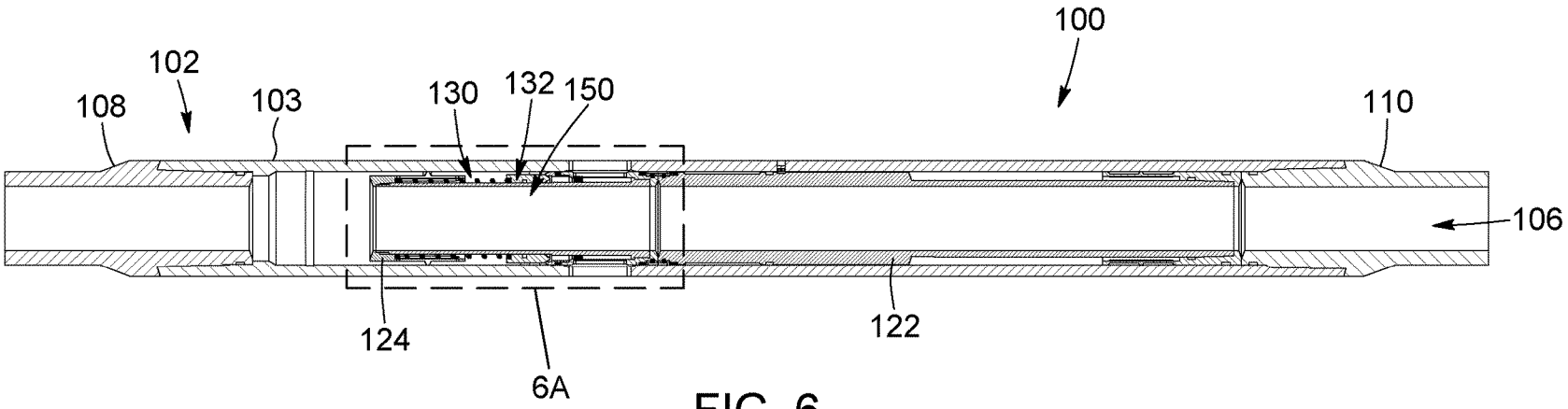
FIG. 6 is a cross-sectional view of the valve assembly, showing the valve assembly in a flow-restricted configuration, according to an implementation.
Figure 6A:
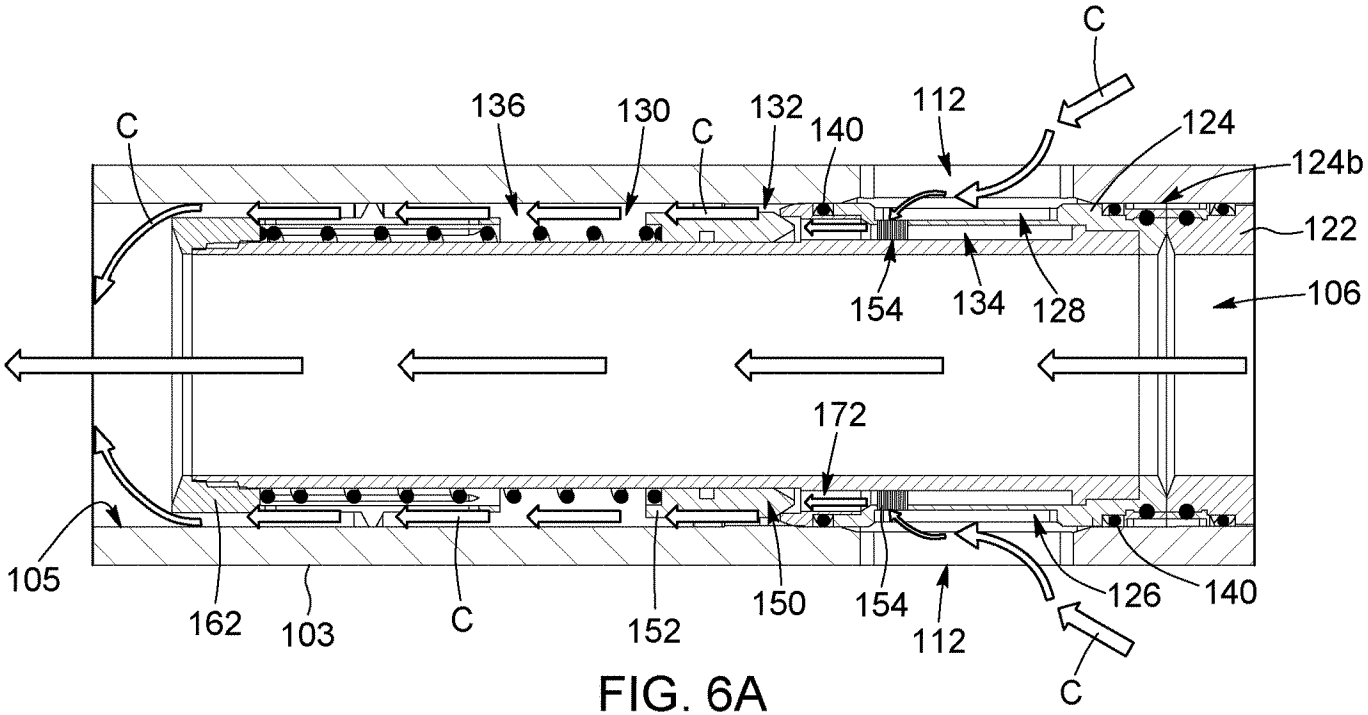
FIG. 6A is an enlarged view of the housing port shown in FIG. 6, showing a fluid pathway provided with a flow control device for controlling fluid flow of fluid being produced from the surrounding reservoir, according to an implementation.

Referring to FIGS. 6 and 6A, the flow-restricted configuration allows production of reservoir fluid via the wellbore string for recovery thereof at surface. More specifically, the flow-restricted configuration defines a production fluid pathway (C) along which the production fluid flows to reach the central passage 106 of the valve assembly 100. As seen in FIGS. 6 and 6A, the top sleeve 124 can be disposed within the housing 102 in a manner defining the annular region 130 between at least a section of the top sleeve 124 and the outer wall 103, and more particularly between the outer surface of the top sleeve 124 and the inner surface 105 of the outer wall 103. In some implementations, the top sleeve 124 and the outer wall 103 are substantially concentric such that a relatively constant flow area is defined through the annular region 130. However, it is appreciated that other configurations are possible, such as having an annular region 130 with a varying flow area along the top 124, for example, or defining the production fluid pathway in other ways. In the illustrated implementation, the annular region 130 defines a notable portion of the production fluid pathway (C) and is configured to allow fluid flowing from the reservoir to reach the passage 106 during production.

In some implementations, the flow-restricted configuration is achieved by shifting the top sleeve 124 downhole to a second position, such as a production position, where the sleeve port 126 is aligned with the housing port 112, thereby opening the annular chamber 132 to the reservoir. It is noted that positioning the top sleeve 124 in the production position can push the bottom sleeve 122 to the open position simultaneously. Furthermore, in this implementation, shifting the top sleeve 124 to the production position establishes fluid communication between the reservoir and at least a portion of the annular region 130 via the housing port 112, thereby opening the flow control device 150 to fluid flow. However, it is appreciated that other configurations are possible for establishing fluid communication between the reservoir and the annular region 130. For example, the housing 102 can be provided with a second set of ports configured to be open upon operation of the valve assembly 100 to the flow-restricted configuration so that the second set of ports communicates with the reservoir and the annular region.

In this implementation, the flow control device 150 is at least partially housed within the annular chamber 132 and is configured to control the fluid flowing through the annular region 130 during production. As mentioned above, the annular chamber 132 is at least partially isolated from the rest of the valve assembly 100 prior to shifting the top sleeve 124 to the production position. In some implementations, the top sleeve 124 can be shaped and configured to sealingly engage the housing 102 at the downhole end 124*b* thereof. For example, the top sleeve 124 can be provided with a pair of seals 140 at the downhole end thereof on either side of the sleeve port 126. As such, fluid flowing through the housing port 112 is substantially confined to flow through the sleeve port 126 and along the annular region 130. In other words, the entire volume of production fluid flows into the housing, along the annular region 130 through the annular chamber 132 and past the uphole end of the top sleeve 124 to reach the central passage 106 (e.g., fluid flowpath (C) illustrated in FIG. 6A). It is noted that in the production position, the uphole end of the top sleeve 124 can be free of contact from the housing 102 to allow fluid from within the annular region 130 to flow into the central passage 106 by simply flowing past the uphole edge of the top sleeve 124.

In some implementations, the flow control device 150 can include a directional control valve device 152 adapted to prevent fluid flow in at least one direction between the central passage 106 and the reservoir, when the top sleeve 124 is in the production position. For example, in this implementation, the directional control valve device 152 is adapted to prevent fluid flow from the central passage 106 to the sleeve port 126 via the annular region 130, and allow fluid flow from the sleeve port 126 to the central passage 106 via the annular region. In other words, the directional control valve device 152 is configured to prevent the injection of fluid into the reservoir through the annular region 130, and allow fluid to be produced from the reservoir through the annular region 130. It is thus appreciated that the directional control valve device 152 can enable operation of the valve assembly 100 as a production-only valve when the top sleeve 124 is in the production position. The flow control device 150 can further include a screen 154 superposed with the sleeve port 126 to enable a screened production of fluid from the reservoir. The screen 154 can be adapted to prevent various particulates and/or debris from entering the valve assembly and potentially clogging up the annular region 130 or being produced to surface.

Now referring to FIGS. 7 to 10, an implementation of the top sleeve 124 is illustrated. The top sleeve 124 includes a sleeve mandrel 160 defining a sleeve passage 161 therethrough, a collet 162 coupled to an uphole end of the sleeve mandrel 160 and a sleeve cap 164 coupled to a downhole end of the sleeve mandrel 160. In some implementations, the collet 162 and the sleeve cap 164 are secured to the sleeve mandrel 160 via interference fit, although other connection methods can be used. The collet 162 can include a latching mechanism 165 adapted to releasably engage valve housing 102 to assist in retaining the top sleeve 124 in position within the valve housing. For example, the outer wall can be provided with annular grooves 116 (seen in FIGS. 4A and 10, among others) along the inner surface thereof, and the latch mechanism 165 can include one or more protrusions 166 extending outwardly from the collet 162 for engaging the annular grooves 116, thereby latching the top sleeve to the outer wall to resist displacement of the top sleeve 124 along the valve housing. The annular grooves 116 can be provided at predetermined locations along the valve housing 102 such that engagement of the annular grooves by the latching mechanism 165 corresponds to an operational configuration of the valve assembly 100.

In some implementations, the latch mechanism 165 of the collet 162 includes resilient members 168, each provided with one or more of the protrusions 166 and configured to bias the protrusions outwardly to engage the annular groove of the housing. The resilient members 168 are further adapted to move radially inwardly (e.g., within the sleeve passage 161) upon an application of sufficient force, such as from a shifting tool, for example. It is appreciated that moving the resilient members 168 radially inwardly can disengage the protrusions 166 from the annular groove, thereby enabling a generally unhindered movement of the top sleeve 124 along the valve housing. The resilient members 168 can be distributed about the sleeve mandrel 160, thereby defining openings and gaps therebetween through which fluid flowing along the fluid flowpath (C) can travel to flow past the collet 162 and into the central passage 106. Referring back to FIG. 4C, it is noted that the collet 162 defines the upholemost component of the top sleeve 124 such that the interstices 135 are defined between the top sub 108, the outer wall 103 and the collet 162, although other configurations are possible.

Figure 7:
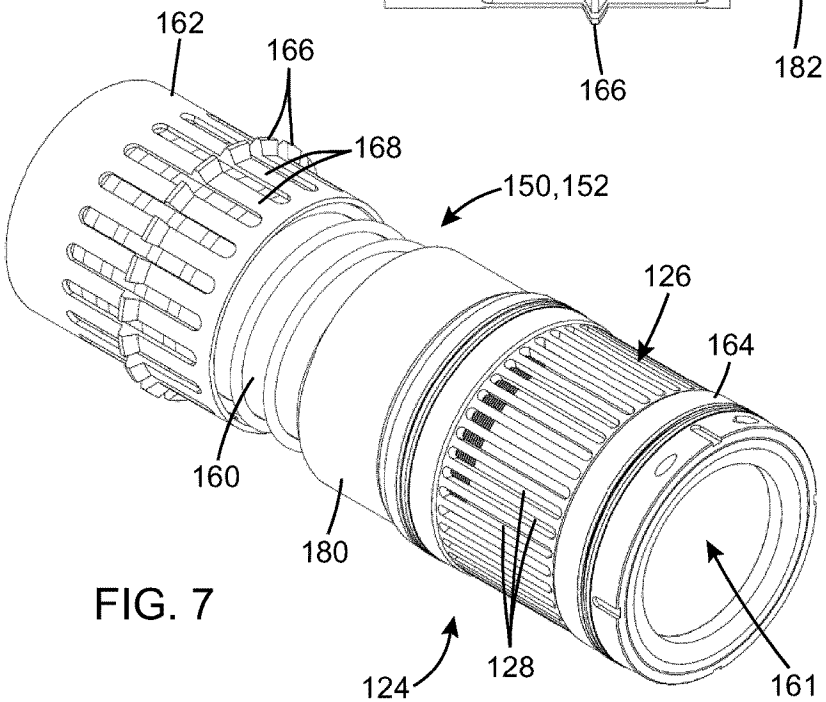

As seen in FIGS. 7 to 10, the sleeve cap 164 can be provided with the sleeve port 126 such that aligning the sleeve cap 164 with the housing port 112 correspondingly aligns the sleeve port 126 with the housing port 112. The sleeve port 126 can include a plurality of elongate slots 128 provided around the sleeve cap 164 for enabling fluid communication between the annular region and the housing port (and thus also with the reservoir). In some implementations, the housing port 112 includes as many openings 114 as the sleeve port 126 includes elongate slots 128. However, it is appreciated that other configurations are possible, for example, and as seen in FIGS. 2 and 7, the housing port 112 includes less openings 114 than the sleeve port 126 includes elongate slots 128.

Figure 8:
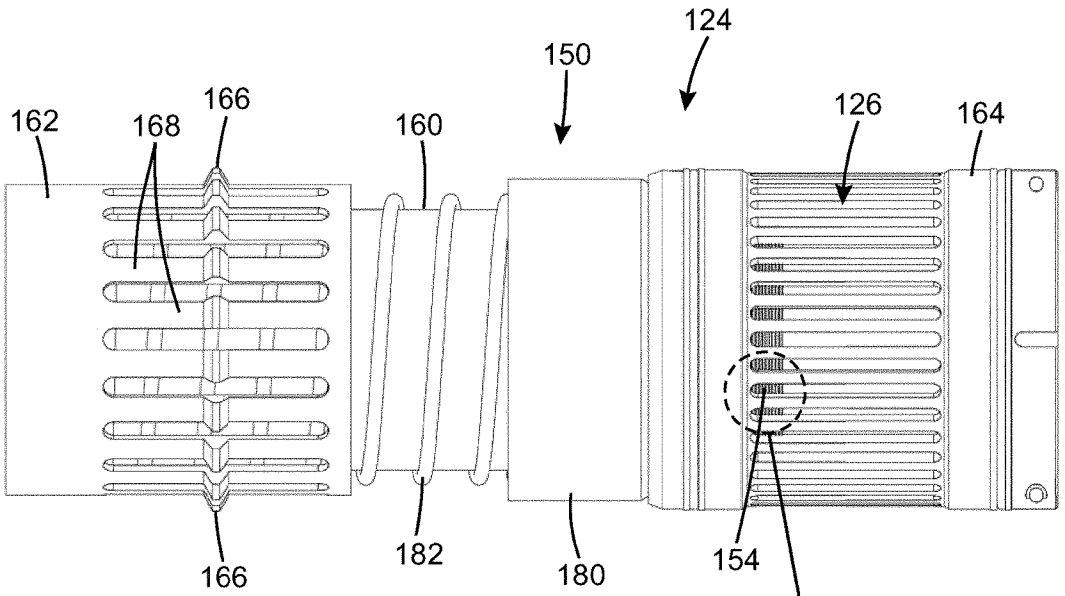
FIGS. 7 and 8 are respectively a perspective view and a side view of a top sleeve, showing a sleeve port defined therethrough, according to an implementation.
Figure 8A:
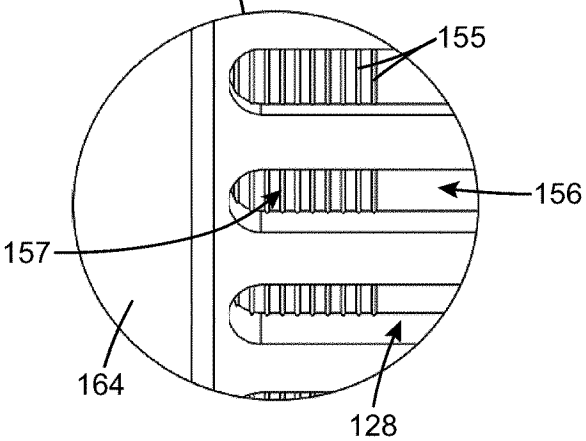
FIG. 8A is an enlarged view of a portion of FIG. 8, showing circumferential openings defined in the sleeve port, according to an implementation.

In this implementation, the screen 154 is superposed with the sleeve port 126, and more specifically with the elongate slots 128. As seen in FIGS. 8 and 8A, the screen 154 can include one or more circumferential openings 155 disposed beneath the elongate slots 128 and through which fluid flows during production. The circumferential openings 155 are illustratively smaller than the elongate slots 128, and are therefore adapted to prevent particulates, such as various debris, from entering the annular region. In some implementations, the elongate slots 128 are defined within a thickness of the sleeve cap 164 and opens on an outer surface of the sleeve cap 164. Therefore, each elongate slot 128 can include a bottom surface, with the circumferential openings 155 being defined through and spaced along at least a portion of the bottom surface.

In some implementations, the circumferential openings are generally perpendicular relative to the elongate slots and, although not illustrated as such, are dispersed along the entirety of the bottom surface. The space between each circumferential opening 155 can have generally the same width as the circumferential openings themselves, such that about 50% of the bottom surface of each elongate slot 128 corresponds to circumferential openings 155, and the other 50% corresponds to the solid bottom surface. However, it is appreciated that other configurations are possible, such as having wider circumferential openings 155, thinner circumferential openings 155, or circumferential openings of varying dimensions throughout the same elongate slot 128 or between different slots 128.

Figure 9:
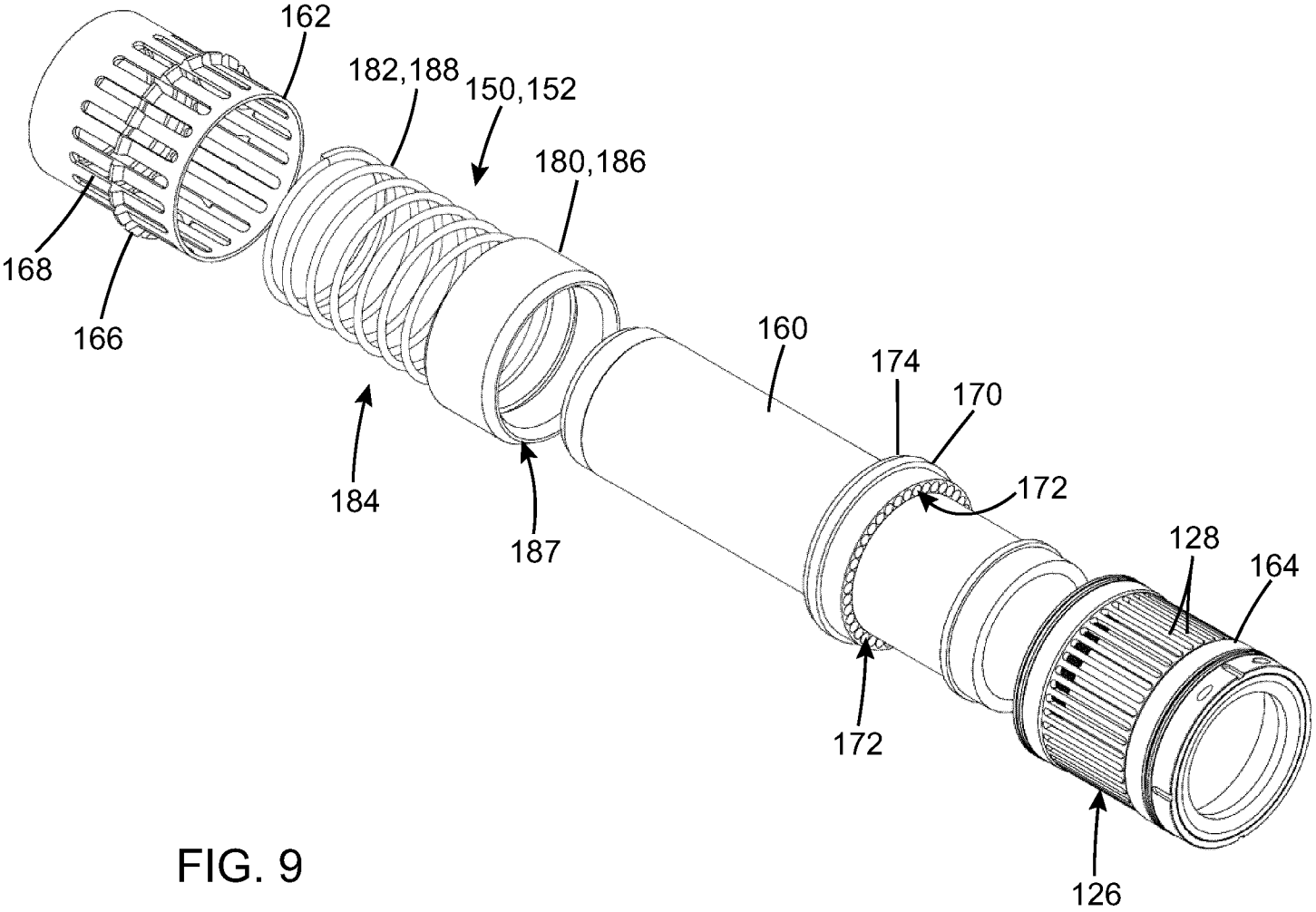
FIG. 9 is an exploded view of the top sleeve shown in FIG. 7, showing components of a flow control device, according to an implementation.
Figure 10:
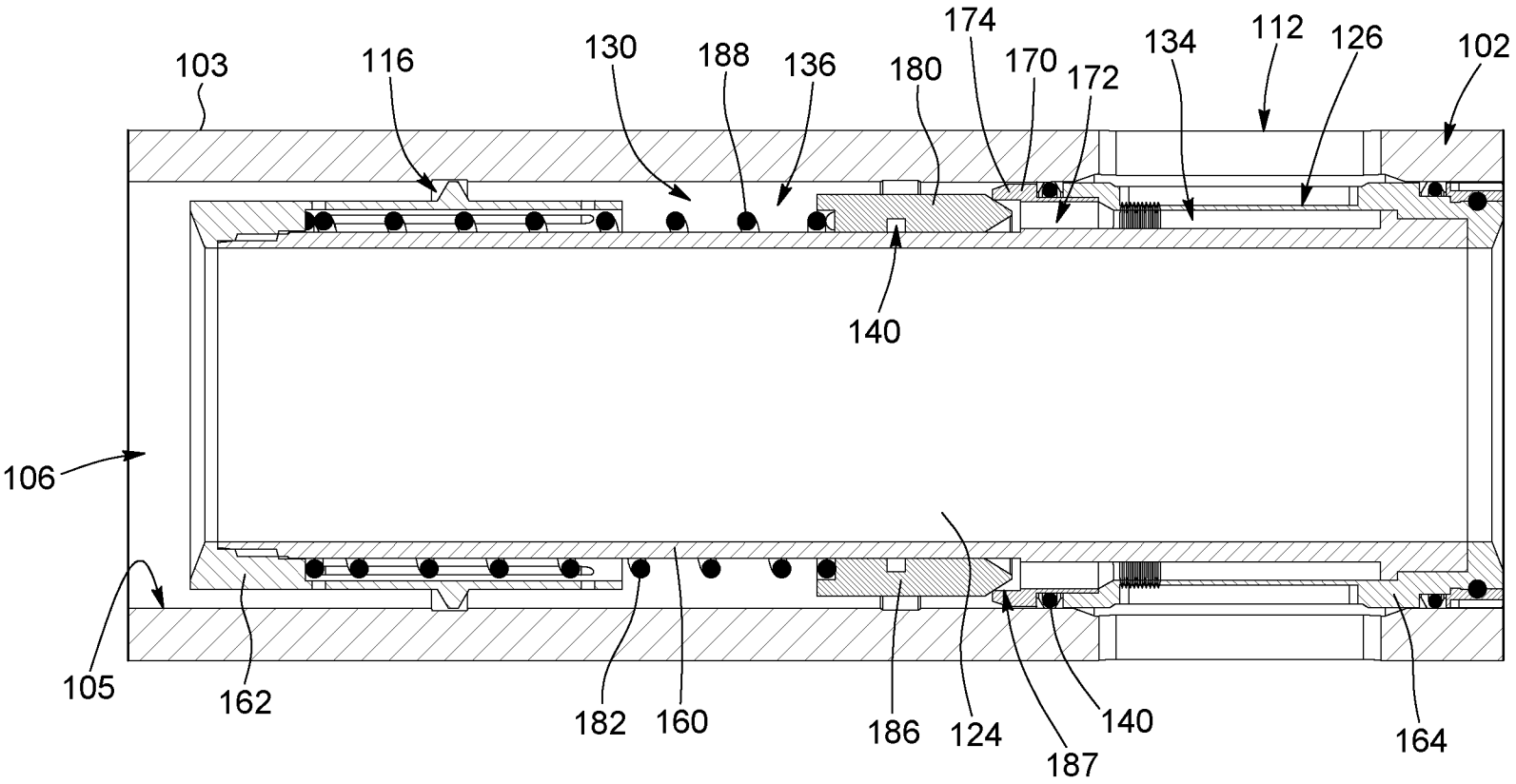
FIG. 10 is an enlarged cross-sectional view of the top sleeve shown in FIG. 6A, showing the flow control device comprising an axial check valve device located in the annular region, according to an implementation.
Figure 12:
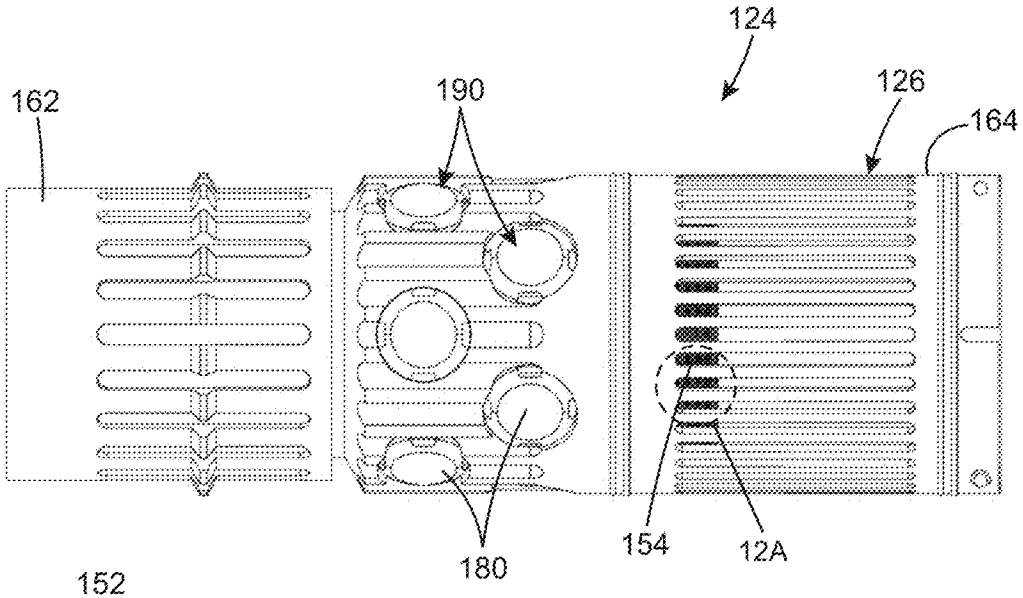
FIGS. 11 to 12A are an alternate implementation of the top sleeve, showing flow control device comprising a radial check valve device, according to an implementation.
Figure 12A:
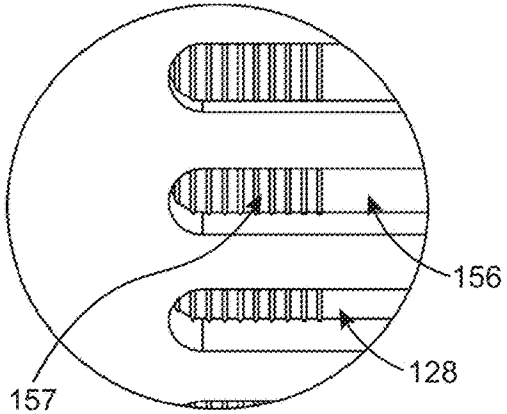
Figure 11:
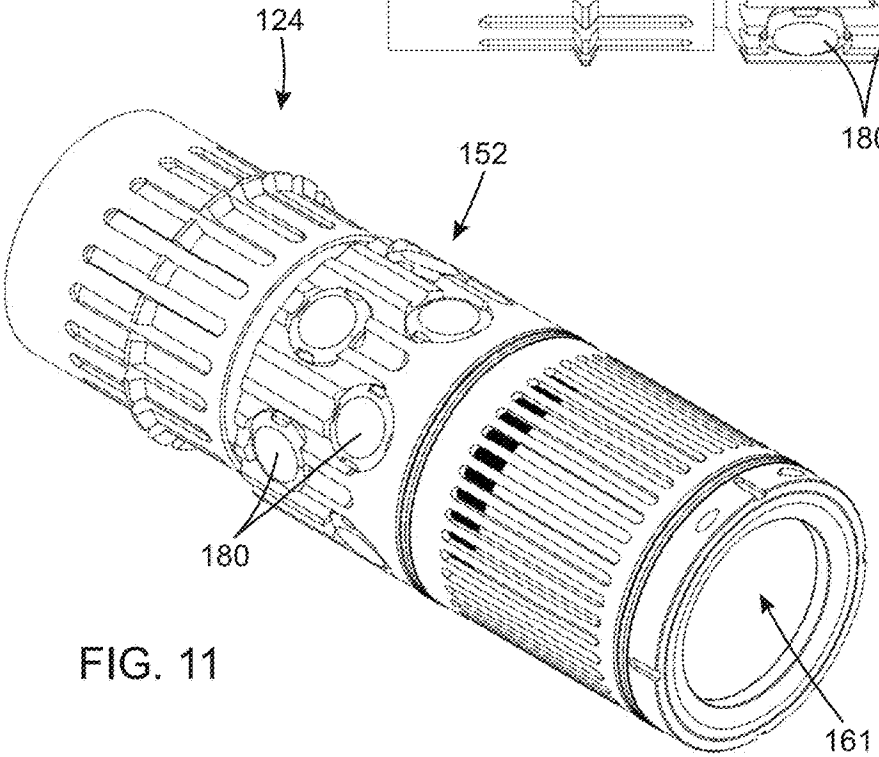

With reference to FIGS. 9 and 10, in addition to FIGS. 7 to 8A, the annular region 130 is illustratively defined between the sleeve mandrel 160 and the outer wall 103. Therefore, it is noted that the volume of the annular region 130 can be at least partially dependent on the thickness of the sleeve mandrel 160 and/or of the outer wall 103. For instance, increasing the thickness of the wall of the sleeve mandrel 160 impedes on either the volume of the annular region 130, the volume of the central passage 106, or both. Similarly, increasing the thickness of the outer wall 103 (e.g., without increasing the width of the wellbore) reduces the volume of the annular region 130. Therefore, in order to define an annular region 130 adapted to house one or more components, such as the flow control device 150, the thickness of at least one of the outer wall 103 and sleeve mandrel 160 can be made thinner.

Reducing the thickness of either one of these walls can include risks. The outer wall 103 is sized and configured to withstand a pressure differential between an internal pressure (e.g., along the central passage 106) and an exterior pressure (e.g., a reservoir pressure). It should thus be noted that reducing the thickness of the outer wall 103 risks collapsing the valve assembly. In this implementation, the sleeve mandrel 160 is not subjected to a pressure differential since the annular region 130 remains in fluid communication, or fluid-pressure communication, with the central passage 106. In other words, the pressure within the annular region 130 (e.g., within the annular chamber 132) is substantially the same as the pressure along the central passage 106.

Therefore, it is noted that enabling fluid flow into the annular region (i.e., into the annular chamber 132) prior to cementing the wellbore string can create a pressure-balanced system between the annular region 130 and the central passage 106. As such, the thickness of the sleeve mandrel 160 can be reduced to increase the volume of the annular region 130 since the sleeve mandrel 160 is not subjected to a pressure differential.

In some implementations, the sleeve mandrel 160 can include a ring portion 170 extending into the annular region 130 and engaging the inner surface 105 of the outer wall 103. The ring portion 170 can therefore be adapted to define a downhole annular region 134 in fluid communication with the sleeve port 126, and an uphole annular region 136 in fluid communication with the central passage 106. The ring portion 170 also illustratively includes one or more through channels 172 establishing fluid communication between the uphole and downhole annular regions 134, 136. A seal 140 can be provided between the ring portion 170 and the outer wall 103 to confine fluid flow through the through channels 172.

Referring back to FIG. 6A, when the valve assembly is in the flow-restricted configuration, the top sleeve 124 is in the production position and defines the fluid flowpath (C) which includes the following path: i) production fluid flowing into the valve assembly via the housing port 112, ii) production fluid flowing into the downhole annular region 134 via the sleeve port 126 (e.g., through the elongate slots 128 and the screen 154), iii) production fluid flowing into the uphole annular region 136 via the through channels 172, and iv) production fluid flowing along the annular region, past the collet 162 and into the central passage 106.

Referring broadly to FIGS. 6 to 10, the directional control valve device 152 can be coupled to the sleeve mandrel 160 in the uphole annular region 136, and configured to selectively control fluid flow along the annular region 130, and more specifically through the through channels 172 of the ring portion 170. For example, in this implementation, the directional control valve device 152 comprises a displaceable member 180 provided within the uphole annular region 136 and being movable between an engaged position (seen in FIG. 10), where the displaceable member 180 at least partially prevents fluid communication between the uphole and downhole annular regions 134, 136, and a disengaged position (not shown), where fluid communication between the uphole and downhole annular regions is allowed via the through channels 172. The directional control valve device 152 can further include a biasing member 182 operatively coupled to the displaceable member 180 for biasing the displaceable member 180 in the engaged position.

In this implementation, the displaceable member 180 can be displaced from the engaged position to the disengaged position via fluid flow, such as fluid flowing from the reservoir into the annular region 130. More specifically, fluid flowing from the reservoir into the downhole annular region 134 can generate hydraulic pressure on the displaceable member 180, causing it to move into the disengaged position and enable fluid flow through the through channels 172. It is noted that fluid flow in the opposite direction, i.e., toward the reservoir is blocked as it does not displace the displaceable member 180.

In some implementations, the directional control valve device 152 includes an axial check valve device 184 configured to prevent axial flow from the uphole annular region 136 to the downhole annular region 134. The displaceable member 180 of the axial check valve device 184 can include a check valve head, such as a ring plug member 186, engageable with the ring portion 170 of the sleeve mandrel 160. Additionally, the biasing member 182 of the axial check valve device 184 can include a spring 188 operatively coupled between the ring plug member 186 and the collet 162 within the annular region 130 to bias the ring plug member 186 in the engaged position. As seen in FIG. 10, when in the engaged position, the front edge 187 of the ring plug member 186 sealingly engages the ring portion 170 to prevent fluid flow between the annular regions 134, 136 via the through channels 172. In this implementation, the ring plug member 186 is slidably mounted about the sleeve mandrel 160 such that hydraulic pressure within the downhole annular region 134 can generate a force on the axial check valve device 184, thereby compressing the spring 188 and moving the ring plug member 186 away from the ring portion 170 to the disengaged position. It should be noted that when fluid flow is stopped, or reduced, the spring 188 is configured to push the ring plug member 186 back to the engaged position.

Still with reference to FIGS. 9 and 10, the ring portion 170 includes an outer surface which engages the inner surface 105 of the outer wall 103. In this implementation, the outer surface of the ring portion 170 includes an overhang 174 axially extending within the uphole annular region 136. The front edge 187 of the ring plug member 186 can be shaped and adapted to come into contact with the overhang 174 and create a seal therewith to prevent fluid flow through the ring portion 170 via the through channels 172. The front edge 187 is illustratively tapered such that a portion thereof is shaped and sized to at least partially extend below the overhang 174, with the tapered surface sealingly engaging the overhang 174 when in the engaged position. The axial check valve device 184 can also be provided with a seal 140 provided between the ring plug member 186 and the sleeve mandrel 160 such that fluid flow is prevented both above and below the ring plug member 186 when engaged with the ring portion 170. As seen in FIG. 9, the front edge 187 can be substantially continuous such that the tapered surface of the front edge is correspondingly continuous and uniformly engages the overhang 174. However, it is appreciated that other configurations are possible, or example, the front edge 187 can include a plurality of plug members configured to engage and plug respective through channels 172 for preventing fluid flow therethrough.

Now referring to FIGS. 11 to 15, an alternate implementation of the top sleeve 124 is illustrated. The sleeve mandrel 160, collet 162 and sleeve cap 164 are substantially the same as those described above. However, in this implementation, the directional control valve device 152 includes a radial check valve device 190, where the displaceable member 180 is configured to move radially between the sleeve mandrel 160 and the outer wall to selectively control fluid flow between the downhole and uphole annular regions 134, 136. In this implementation, the displaceable member 180 includes a plurality of radial poppets 192 provided about the ring portion 170 for obstructing respective through channels 172, when in the engaged position. Each radial poppet 192 can be configured to block one end of one of the through channels 172, such as the end adapted to communicate with the uphole annular region 136, for example.

Figure 14:
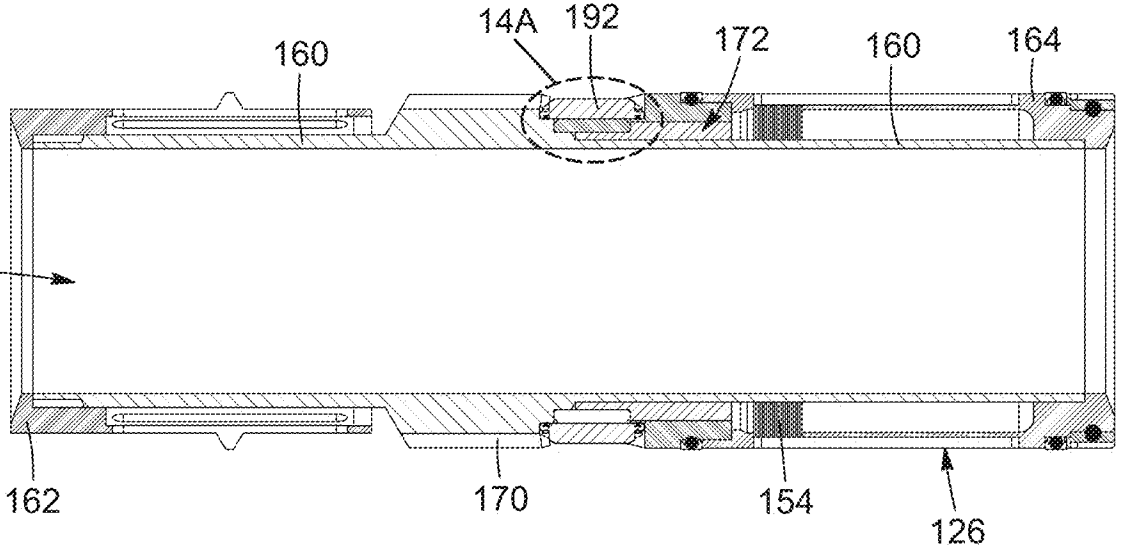
FIG. 14 is a cross-section view taken along line 14-14 in FIG. 13, showing the radial check valve device coupled about the top sleeve, according to an implementation.
Figure 14A:
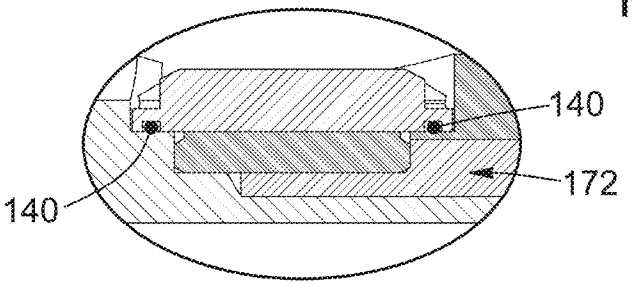
FIG. 14A is an enlarged view of a component of the radial check valve device, according to an implementation.
Figure 13:
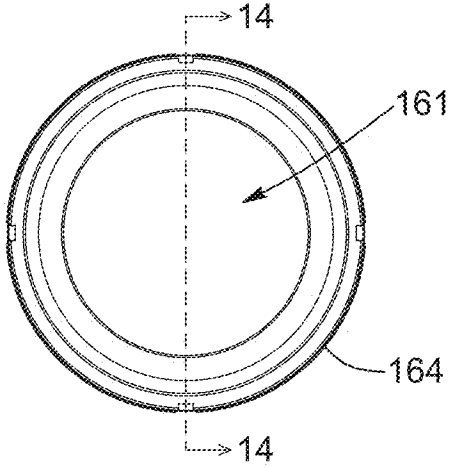
FIG. 13 is a front view of the top sleeve shown in FIG. 11.
Figure 15:
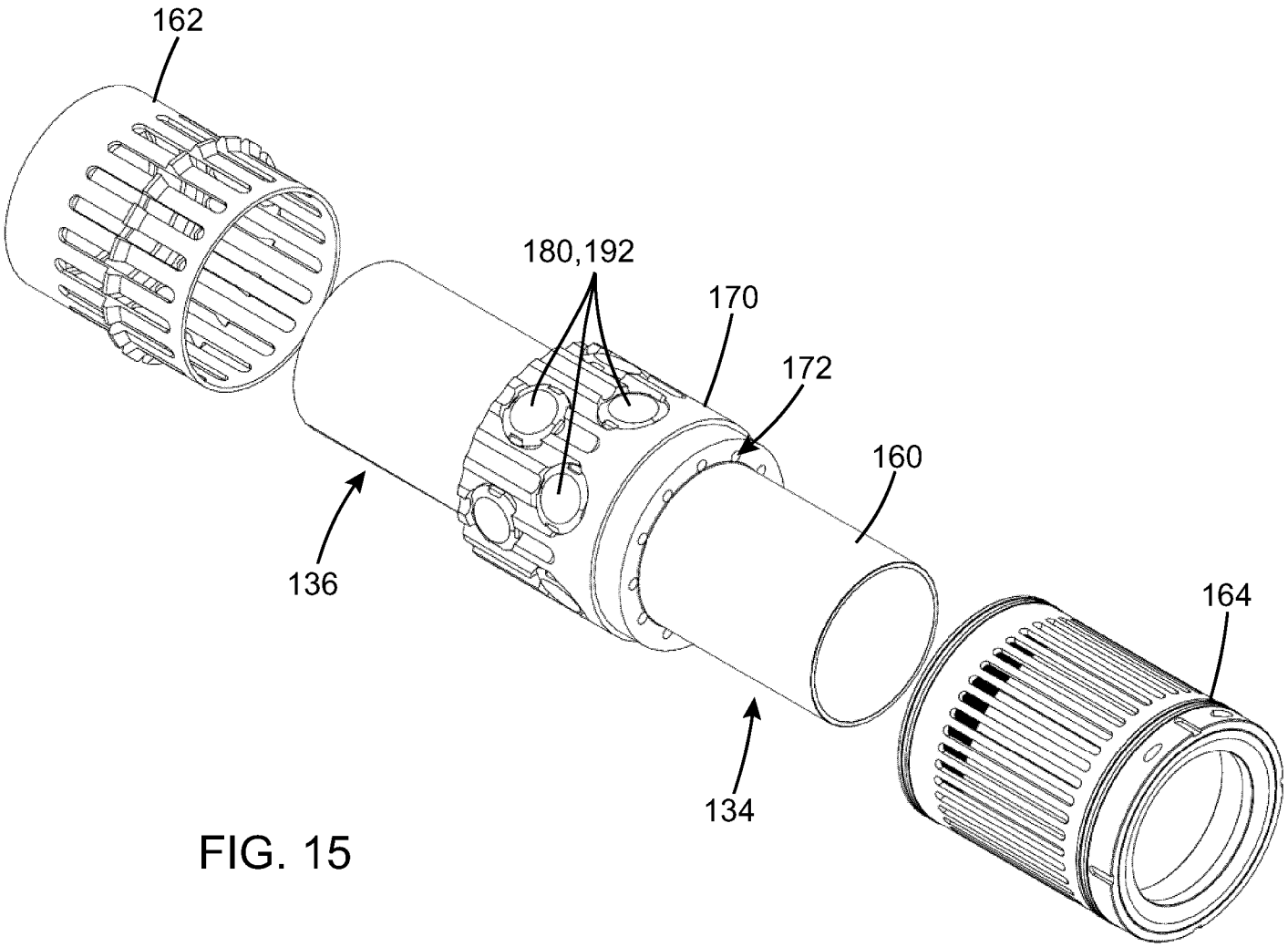
FIG. 15 is an exploded view of the top sleeve shown in FIG. 11, showing the radial check valve device coupled to a central portion of the top sleeve, according to an implementation.

During production, fluid flows from the reservoir, through the housing port, through the sleeve port 126 and into the downhole annular region 134. The hydraulic pressure increases and generates an outward radial force on a bottom surface of the radial poppets 192 to disengage, or "unseat", the radial poppet 192 from its engaged and occluding position. As seen in FIG. 14A, the radial poppet 192 can be provided with one or more seals 140 for preventing fluid flow when in the engaged, or "seated" position. Once sufficient hydraulic pressure is created below (e.g., within the through channels 172 and the downhole annular region 134), the radial poppet 192 is lifted from its seat, thereby enabling fluid flow around the radial poppet 192, into the uphole annular region 136 and finally in the central passage 106. Each radial poppet 192 can be configured to selectively block a single through channel 172, although other configurations are possible, such as providing a radial poppet 192 for more than one through channel, for example. It should also be noted that, in some implementations, the directional control valve device 152 can include a combination of axial and radial check valve devices, or any other type of flow directional control device.

Figure 16:
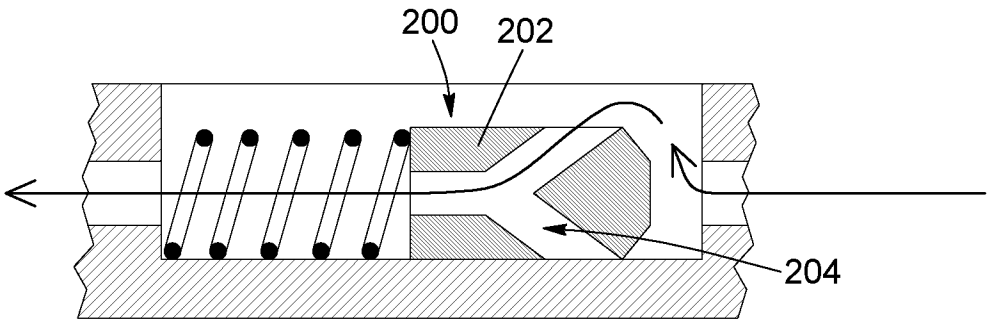
FIGS. 16 to 24 illustrate alternate implementations of the flow control device, including an axial poppet check valve (FIGS. 16 to 18), a reed type check valve (FIGS. 18 to 24), according to possible implementations.
Figure 17:
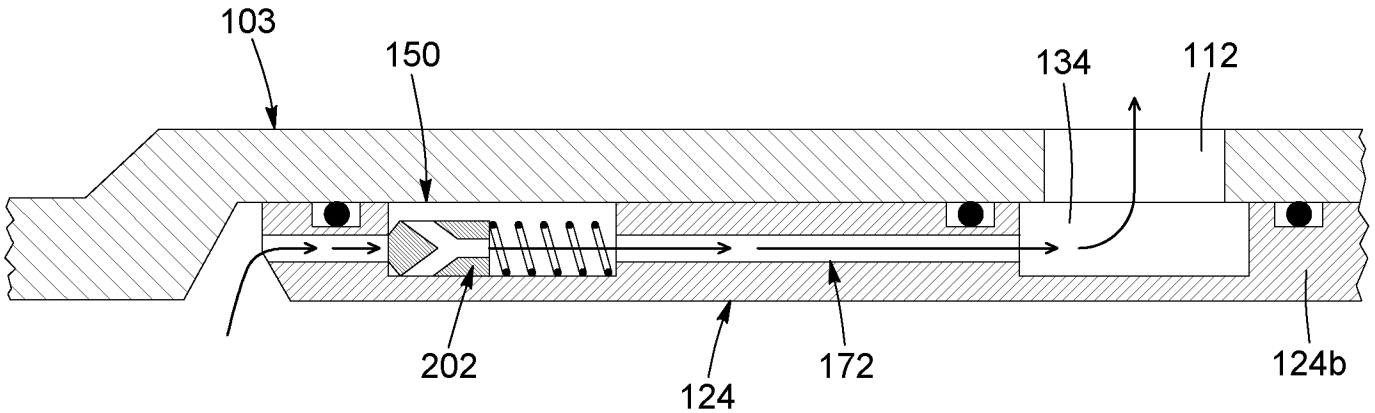
Figure 18:
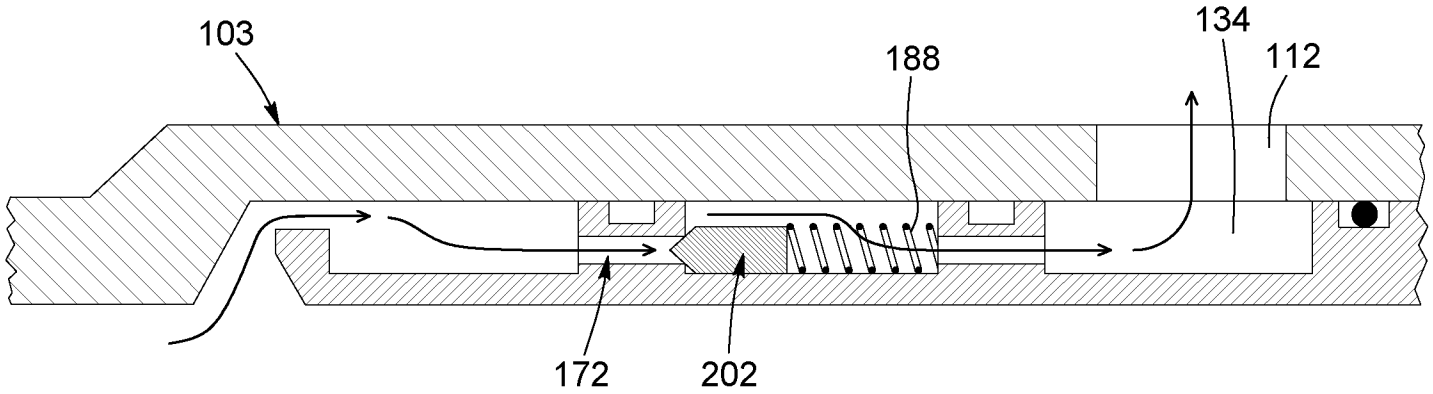

With reference to FIGS. 16 to 26, alternate implementations of flow control devices 150 are illustrated. For instance, with reference to FIG. 16, an implementation of an axial poppet check valve 200 is shown. In this implementation, the poppet member 202 can be provided in the annular region and functions in a similar way as the axial check valve device described above. FIG. 16 shows the axial poppet member 202 in the open position, or retracted position, once fluid pressure forces the poppet away from the through channel 172. Fluid communication is thus created to enable flow past and/or through the poppet (e.g., via internal channels 204 of the axial poppet member 202), along the annular region. FIG. 16 shows an axial poppet check valve preventing injection outflow and enabling production inflow. An axial poppet check valve could also be provided for another valve for preventing production inflow and enabling injection outflow by reorienting the poppet member and the biasing member within the annular region, such as the implementation shown in FIGS. 17 and 18, for example. It is appreciated that the implementations the poppet check valve of FIGS. 17 and 18 can be used in injection-only valves, where production is prevented at predetermined stages of the wellbore.

Referring now to FIGS. 18 to 24, a reed type check valve can be used wherein a reed is incorporated with the sleeve in various ways.

Figure 19:
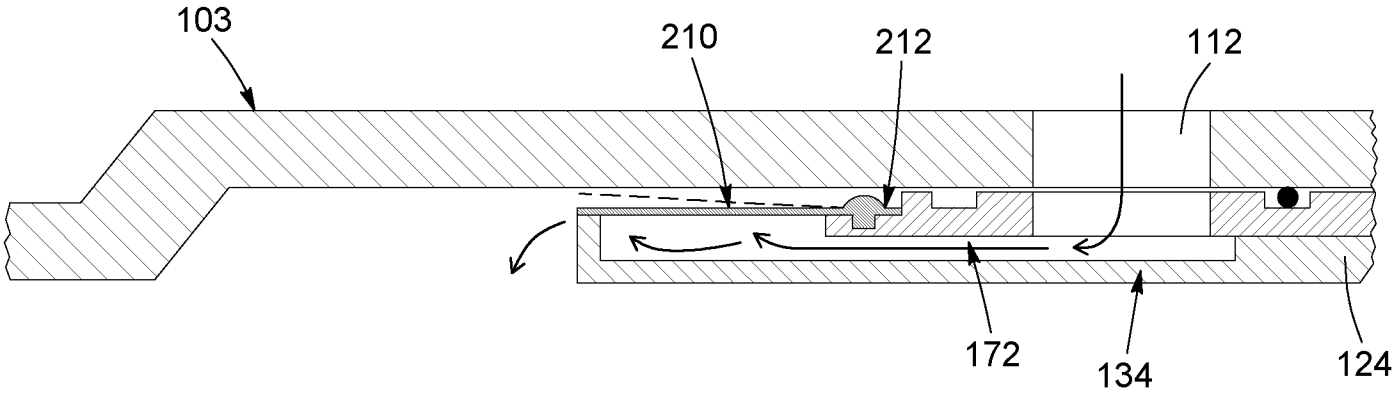
Figure 20:
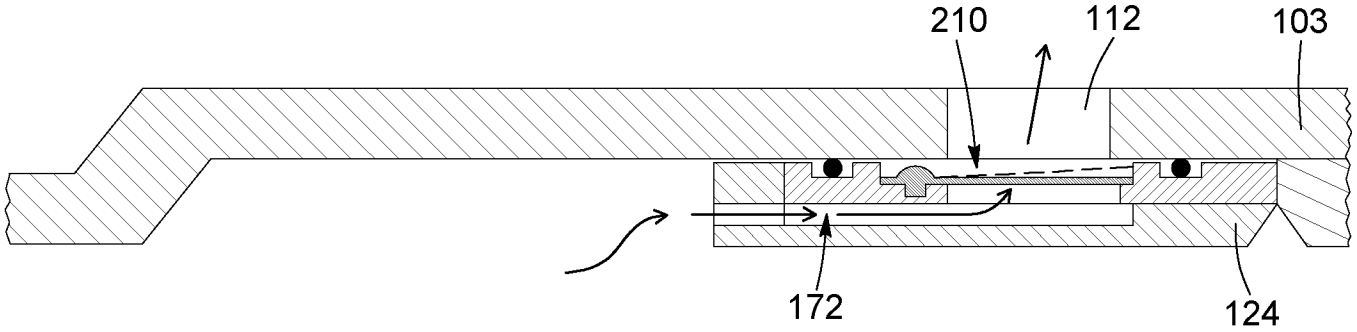
Figure 21:
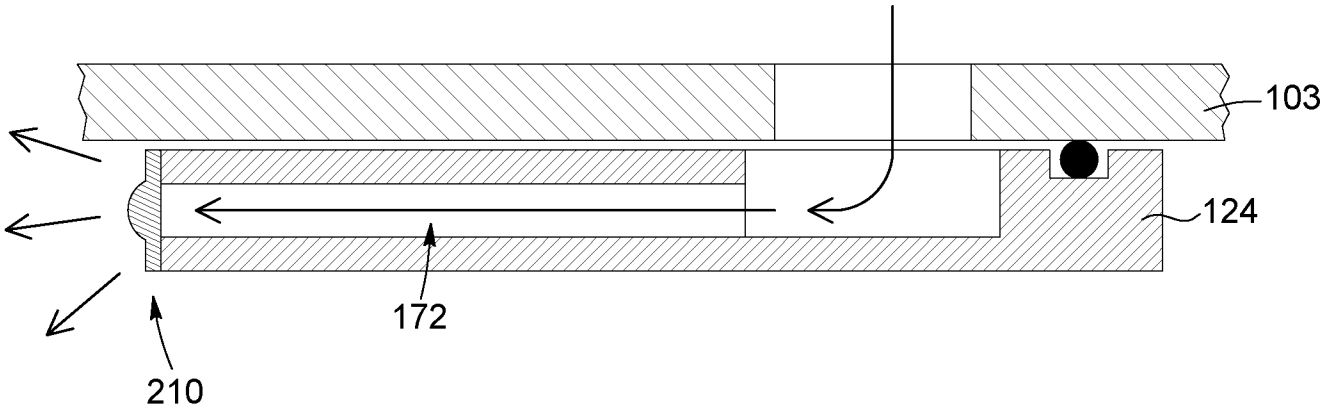

Referring to FIGS. 19-21, each reed check valve can include a reed petal 210 that is attached at one end to the top sleeve 124 via an attachment 212 while enabling the opposed end to flex from a closed position to an open position in response to fluid pressure from one direction.

FIG. 19 shows the reed petal 210 fixed proximate the uphole end of the sleeve and arranged so that an end section of the reed petal 210 can rest on a support portion of the sleeve in the closed position and then flex or pivot in response to fluid pressure from below to move the reed petal to the open position to define an opening that allows fluid communication past the reed petal 210. In FIG. 19, the reed petal 210 is arranged to flex radially outward in response to fluid pressure that flows from the exterior of the valve and through the through channels 172. A gap can be defined between the housing 103 and the support portion to enable the reed petal 210 to flex toward the housing inner surface to enable fluid to pass through. When the fluid pressure is on the inside of the valve, the reed petal 210 tends to remain closed for the reed check valves of FIG. 19, which can thus be used in a production-only valve. In addition, the sleeve 124 can be composed of two or more parts, if desired, for ease of manufacturing and assembly of the different portions of the various features.

FIG. 20 shows a reed check valve for an injection-only scenario wherein the reed petal 210 is arranged to flex radially outward in response to fluid pressure from the interior of the valve. Fluid can flow through the annular region to force the reed petal to open and then flow through the housing port 112 and into the reservoir.

The reed check valves illustrated in FIGS. 19-20 are arranged so that the reed petal 210 flexes radially and thus deflects from a closed position that can be generally aligned with a longitudinal axis of the sleeve to an open position at an angle, which may be acute, with respect to the longitudinal axis. This general configuration can be referred to herein as a side-bending configuration of the reed check valve. The side-bending reed valve can be used for injection or production in various valve implementations. The side-bending reed valve can be integrated within the sleeve of the valve, as shown in FIGS. 19-20, or with the housing itself if desired. As shown in FIGS. 19-20, the reed valve can be arranged so that the reed petal bends outward toward the open position, rather than bending inward toward the middle of the valve. Outward bending can reduce issues related to catching tools and the like that can be run through the sleeve. Orientations of the sleeve parts, the reed petal, and related equipment that reduce the risk of catching can be beneficial (e.g., reed petals that are shielded from tool deployment, as shown in FIGS. 19-20). In other terms, the reed petal 210 can be oriented so that it does not create an obstruction. The reed petal can also be arranged facing either axial direction (the loose end uphole or downhole) with the sleeve and channels being arranged accordingly.

Figures 22, 23:
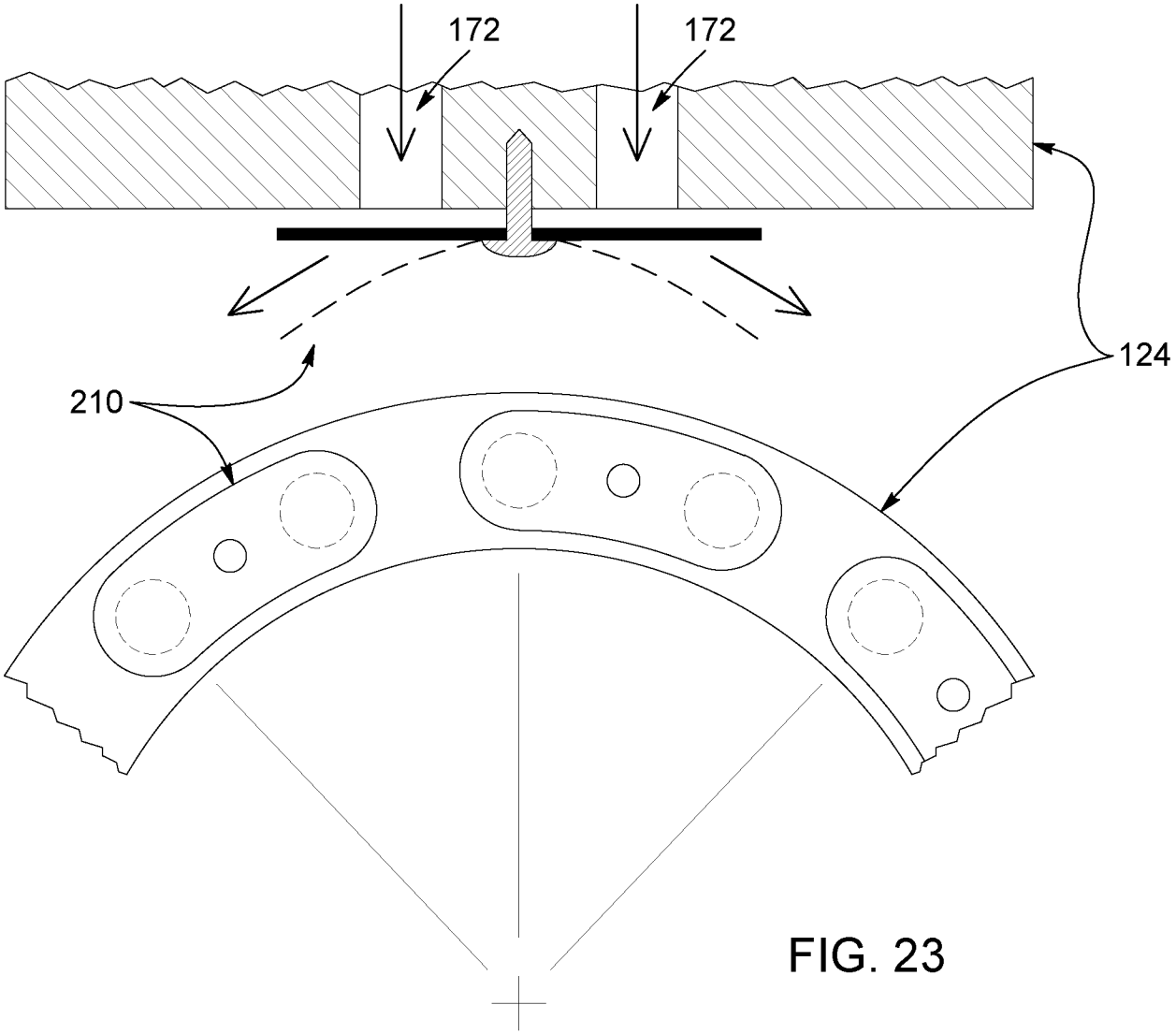

Turning to FIGS. 21-23, the reed check valve can be provided in an alternative arrangement that can be referred to as an end-bending configuration. In the closed position, the reed petal 210 can be oriented generally perpendicular to the longitudinal axis of the sleeve, and in response to fluid pressure the reed petal 210 flexes to an angle to allow fluid passage in one direction. In this implementation, the reed petal 210 can be arranged to cover an outlet of the through channels 172. As shown in FIGS. 22-23, each through channel 172 can be covered by a reed petal 210. A pair of adjacent through channels 172 can also be covered by a single reed petal 210 with first and second sides that cover respective through channels 172 and the attachment 212 securing the reed petal 210 in between the adjacent through channels 172. The reed petal 210 could alternatively be secured to the end of the sleeve in other configurations so that the reed petal bends in one or various directions. It is noted that the end-bending configuration could also include an additional inner sleeve part configured to shield the reed petal.

While FIGS. 19-20 show a side-bending configuration and FIG. 21-23 show an end-bending configuration, it should be noted that other angle of the reed petal and associated through channels 172 are possible. In other words, the reed petal does not have to be parallel or perpendicular to the sleeve longitudinal axis, but can be oriented at other angles.

Figure 24:
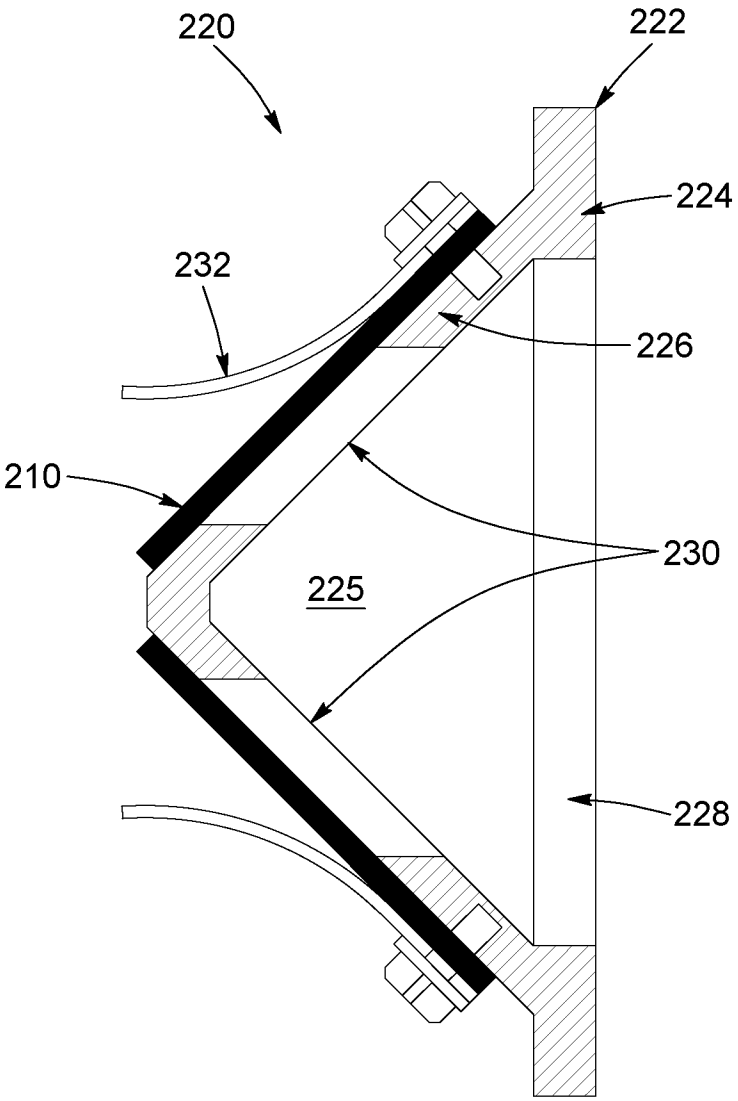

Referring to FIG. 24, it is also noted that the reed check valve can be provided in the form of an angled reed valve device 220, where the reed petals 210 are arranged at an angle with respect to the longitudinal orientation in the closed position. For example, the reed petals can be mounted to a reed block 222 that includes a base plate 224, angled walls 226 extending from the base plate 224 and side walls (not shown) also extending from the base plate, such that the walls define a flow cavity 225. The base plate 224 defines a base opening 228, and the angled walls include openings 230 over which the reed petals 210 are provided. The fluid can flow through the base opening, into the cavity, and out of the openings, deflecting the reed petals 210 in one direction (i.e., from right to left in FIG. 24); but the fluid is prevented from flowing in the opposite direction. Each reed petal 210 can also be overlaid with a stop plate 232 that can be curved and configured to define the maximum open position of the reed petal. In this regard, is it noted that a dedicated stop plate component can be provided for various reed valves, or certain components of the valve (e.g., housing, sleeve, etc.) can act as a stop plate depending on the configuration of the reed petal.

Referring back to FIG. 1, the wellbore 10 includes a casing 11 lining an inner surface of the wellbore 10. The casing 11 can be adapted to contribute to the stabilization of the reservoir 14 after the wellbore 10 has been drilled, e.g., by contributing to the prevention of the collapse of the walls of the wellbore 10. In some implementations, the casing 11 includes one or more successively deployed concentric casing strings, each of which is positioned within the wellbore 10. In some implementations, each casing string includes a plurality of jointed segments of pipe. The jointed segments of pipe typically have threaded connections although other configurations are possible and may be used.

It can be desirable to seal an annulus formed within the wellbore between the casing string 11 and the reservoir 14. Sealing of the annulus can be desirable for preventing injection fluid from flowing into remote zones of the reservoir, thereby providing greater assurance that the injected fluid is directed to the intended zones of the reservoir. To prevent or at least interfere with injecting fluid into an unintended zone of the reservoir, this annulus can be filled with an isolation material, such as cement, thereby cementing the casing to the reservoir 14. It should be noted that the cement can also provide one or more of the following functions: (a) strengthens and reinforces the structural integrity of the wellbore, (b) prevents, or substantially prevents, produced fluids of one zone from being diluted by water from other zones, (c) mitigates corrosion of the casing 11, and (d) at least contributes to the support of the casing 11.

It is further noted that the casing 11 can include a plurality of casing outlets for allowing fluid flow between the wellbore string 30 and the reservoir (e.g., via injection and production segments of the valve assembly 100). In some implementations, in order to facilitate fluid communication between the wellbore string 30 and the reservoir 14, each of the casing outlets can be substantially aligned with, or at least proximate to, a housing port of the valve assembly 100. In this respect, in implementations where the wellbore 10 includes the casing 11, injection fluid is injected from the surface down the wellbore string 30 in order to reach the valve assembly 100. Injection fluid then flows through the open housing port of the corresponding valve assemblies and into an annular space defined between certain portions of the wellbore string 30 and the casing string 11, and finally into the reservoir 14 via the casing outlets.

Figure 25:
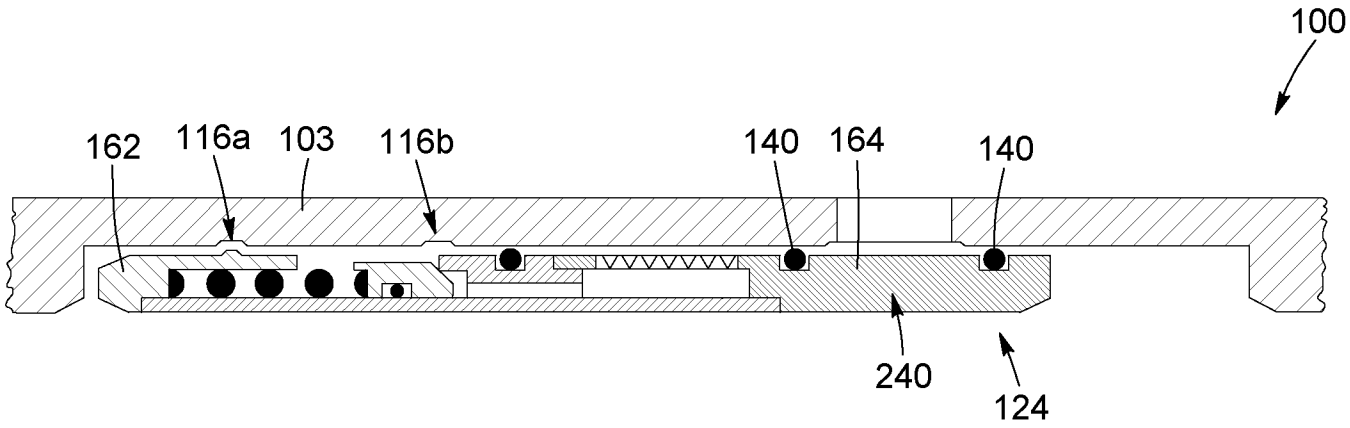
FIG. 25 is a cross-sectional view of an alternate implementation of the valve assembly, showing a single valve sleeve operable between a closed position and a screened position, according to an implementation.
Figure 26:
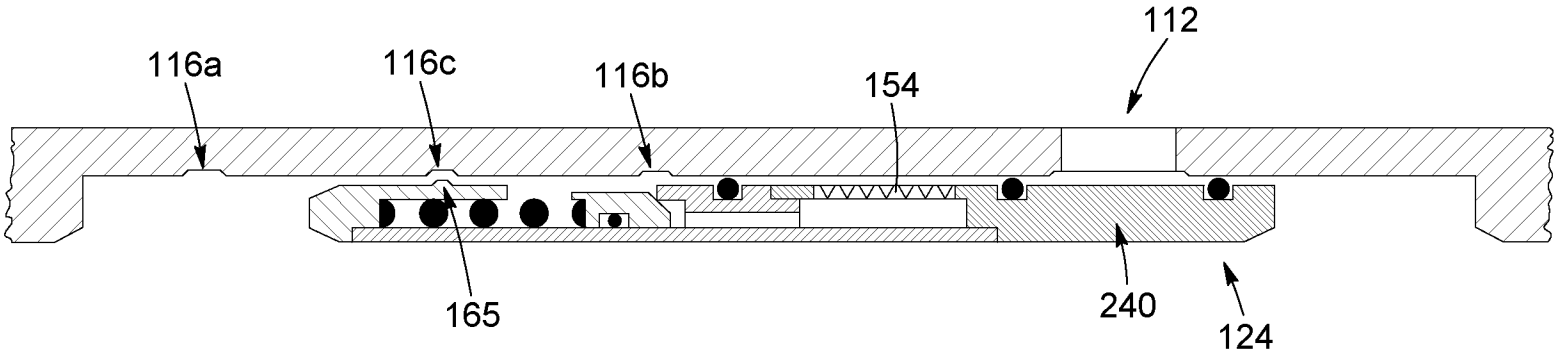
FIG. 26 is a cross-sectional view of an alternate implementation of the valve assembly, showing a single valve sleeve operable between a closed position, an open position and a screened position, according to an implementation.

In another possible implementation, and with reference to FIGS. 25 and 26, the valve assembly can be provided with a single sleeve, such as the top sleeve 124, shiftable between various positions and being adapted to close the housing port 112, open the housing port 112 and/or restrict the housing port 112. In other words, the different configurations of the valve assembly described herein can be generally replicated using only one valve sleeve (i.e., instead of the dual-sleeve assembly described above). Referring more specifically to FIG. 25, the top sleeve 124 can include an occluding portion 240 adapted to be aligned with the housing port 112 to operate the valve assembly 100 in the closed configuration. The occluding portion 240 can correspond to a portion of the sleeve cap 164 which is illustratively provided with one or more seals 140 between the outer wall and the occluding portion 240 (e.g., the sleeve cap 164) to prevent fluid communication between the reservoir and the central passage 106.

The top sleeve 124 can be shifted between the closed position (shown) and a screened position, where the screen 154 is aligned with the housing port 112, as described above. Similar to previously described implementations, the screen 154 can be provided on the sleeve cap 164, such that shifting the top sleeve 124, for example in the downhole direction, displaces the occluding portion 240 to no longer block the housing port 112, and moves the screen 154 in alignment with the housing port 112. In this implementation, the outer wall 103 includes a pair of annular grooves 116 where the collet 162 is adapted to engage via the latching mechanism 165. The annular grooves are provided at predetermined locations such that engagement of a first annular groove, such as the upholemost annular groove 116*a* corresponds to positioning the top sleeve in the closed position (e.g., with the occluding portion 240 aligned with the housing port 112), and engagement of a second annular groove, such as the downholemost annular groove 116*b* corresponds to positioning the top sleeve in the screened position.

With reference to FIG. 26, another implementation of the valve assembly 100 is shown. In this implementation, the top sleeve 124 includes generally the same structure as the implementation of FIG. 25. However, the valve housing 102 is shaped and adapted to enable movement of the top sleeve in both the uphole and the downhole directions. As such, it is appreciated that the top sleeve can be displaced into three different operational positions. As seen in FIG. 26, the valve housing includes three (3) annular grooves 116, including the upholemost annular groove 116*a*, the downholemost annular groove 116*b*, and a central annular groove 116*c* therebetween, although additional annular grooves can be provided. The top sleeve 124 can thus be displaced along the valve housing to enable engagement of the latching mechanism 165 in any one of the three (3) annular grooves 116, which corresponds to operation of the valve assembly in three operational configurations (e.g., three different operational configurations).

For example, the valve assembly can be run downhole with the top sleeve in the run-in position, with the latching mechanism 165 engaging the central annular groove 116*c*, which corresponds to the closed position in this implementation. In other words, the valve assembly 100 is run downhole with the occluding portion 240 of the top sleeve aligned with the housing port 112. Once in place, the top sleeve can be either shifted downhole or uphole, for engagement of the latching mechanism with one of the other annular grooves 116*a*, 116*b*. In this implementation, shifting the top sleeve downhole aligns the screen 154 with the housing port 112, thus operating the valve assembly in the screened configuration. Moreover, shifting the top sleeve uphole opens the housing port 112 to direct fluid communication with the central passage, thus operating the valve assembly in the open configuration (e.g., for fracturing purposes, for injection into the reservoir or for unrestricted production of reservoir fluids).

It should be noted that the structural components of the top sleeve can be "flipped" along the valve housing such that shifting the top sleeve uphole moves the top sleeve to the screened position, and shifting the top sleeve downhole moves the top sleeve to the open position, for example. In addition, although FIGS. 25 and 26 illustrate the top sleeve with the axial check valve device configured to operate the valve assembly in a production-only valve, it should be noted that any other suitable type or combination of flow control devices can be used, such as flow control devices configured to operate the valve assembly in an injection-only valve, for example.

Figure 27:
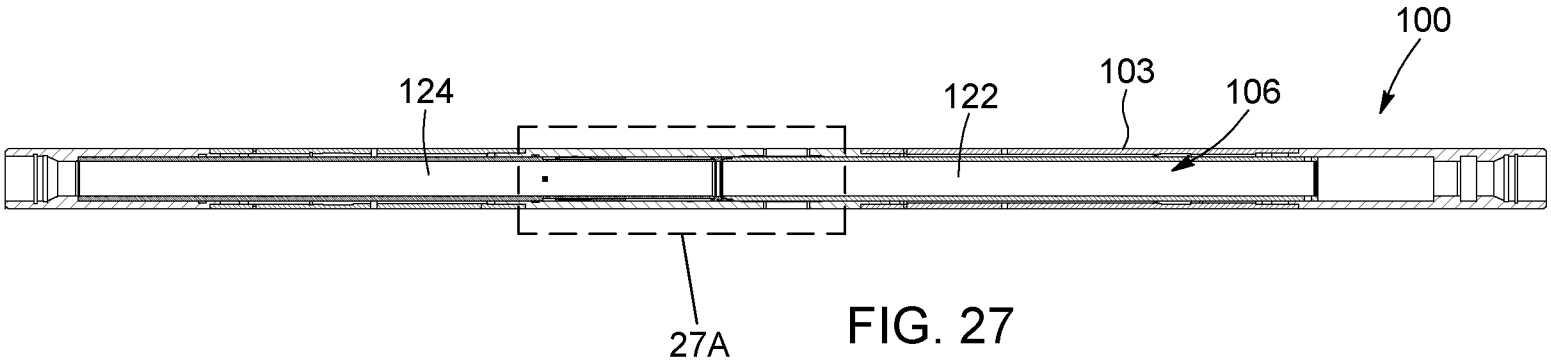
FIGS. 27 to 30 are cross-sectional views of an alternate implementation of the valve assembly, showing the valve assembly in a closed configuration (FIGS. 27 and 27A), an open configuration (FIG. 28), a secondary closed configuration (FIG. 29) and a screened configuration (FIG. 30), according to possible implementations.
Figure 28:
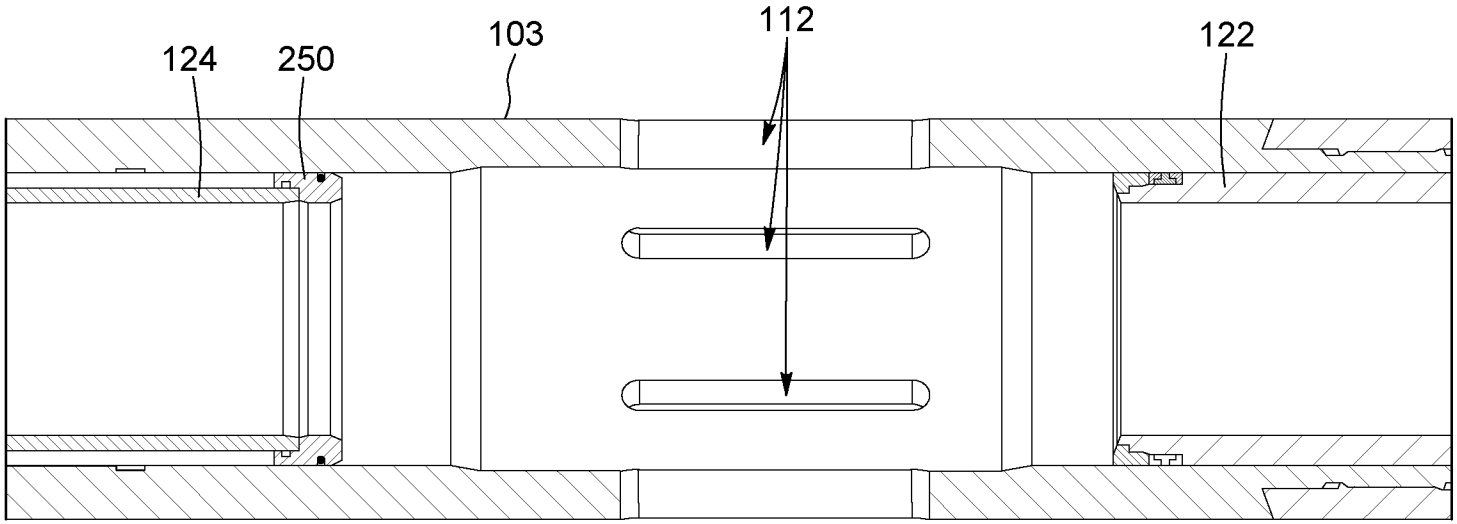
Figure 29:
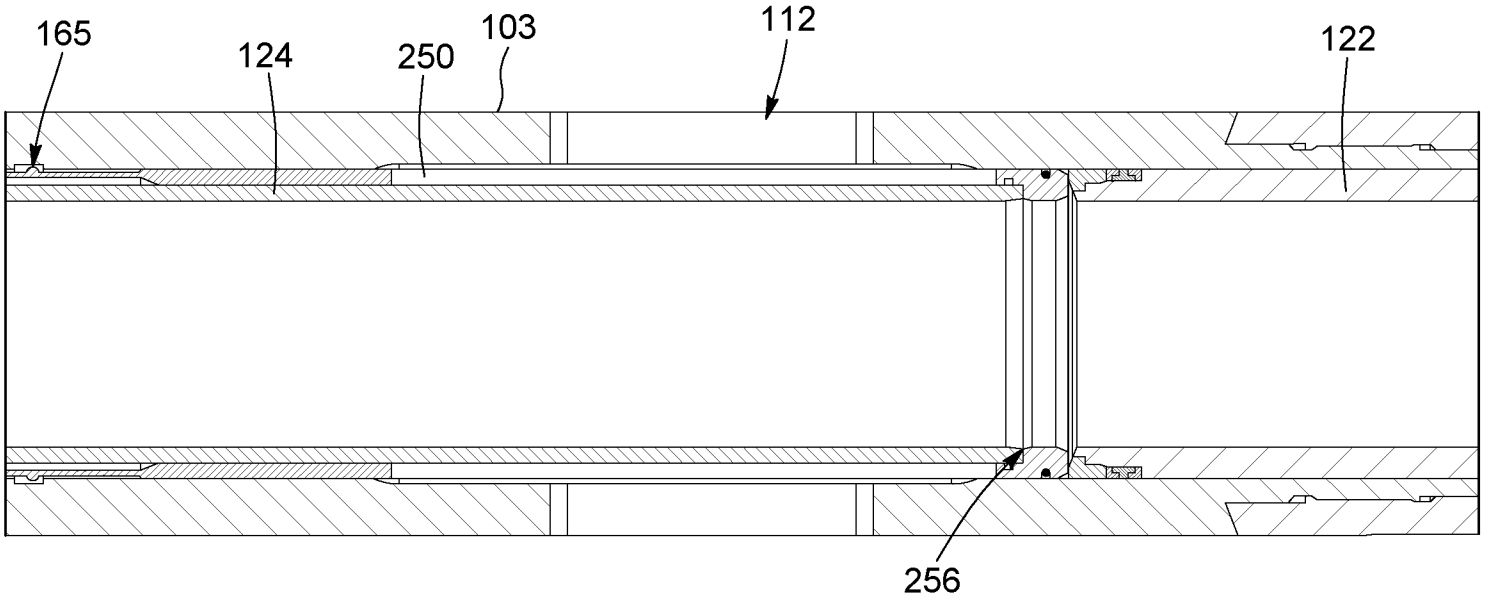

Now referring to FIGS. 27 to 29, another implementation of the valve assembly is illustrated. In this implementation, the valve assembly 100 includes a dual-sleeve assembly (e.g., a bottom sleeve 122 and a top sleeve 124) and further includes a flow-controlling sleeve 250 coupled to one of the bottom sleeve 122 and the top sleeve 124, such as to the top sleeve 124. In some implementations, the flow-controlling sleeve 250 includes the flow control device, or a portion thereof, and includes a flow-controlling sleeve mandrel 253 provided between the top sleeve 124 and the outer wall 103 of the housing. As will be described further below, the flow-controlling sleeve 250 can be slidably mounted within the valve housing, such as slidably mounted between the top sleeve 124 and the outer wall 103, for example, which enables movement of the flow-controlling sleeve 250 along the valve housing relative to the outer wall 103 and/or the top and bottom sleeves. It is thus noted that the flow-controlling sleeve 250 can be at least partially mounted within the annular region 130, such as within the annular chamber 132.

Figure 27A:
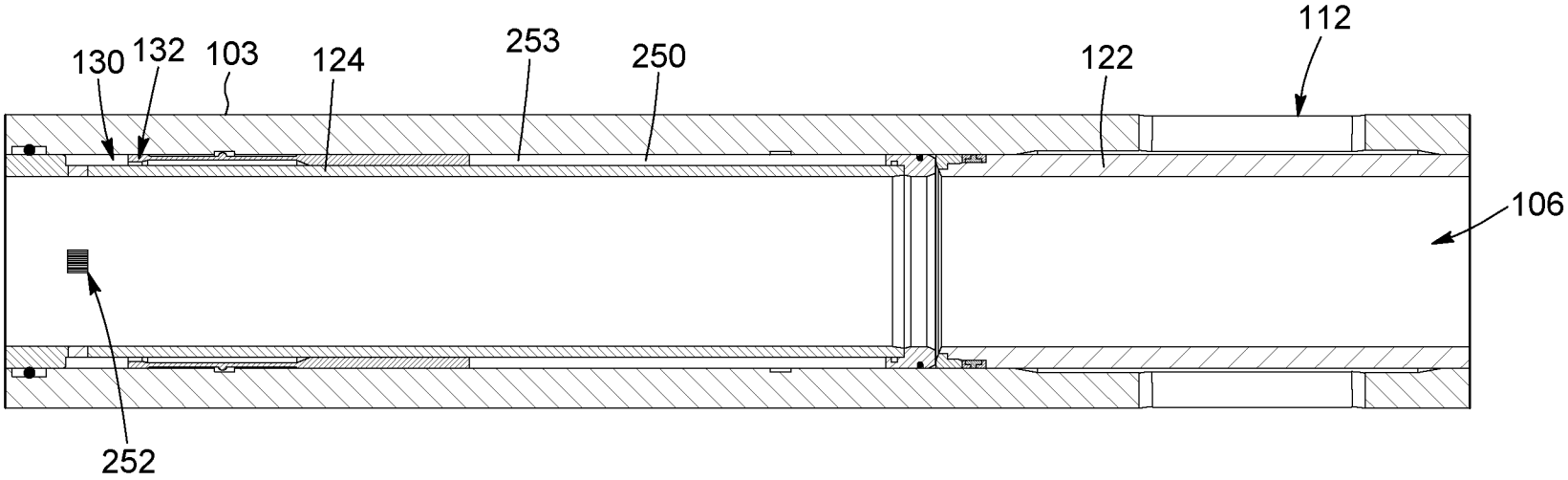

In FIGS. 27 and 27A, the valve assembly 100 is operated in the closed configuration, where the bottom sleeve 122 occludes the housing port 112 to prevent fluid communication between the central passage 106 and the reservoir. In a similar fashion to previously described implementations, the bottom sleeve can be shifted (e.g., in the downhole direction) to an open position (seen in FIG. 28) and enable operation of the valve assembly in the open configuration. It is appreciated that the open configuration of the valve assembly 100 enables fracturing of the reservoir, injection into the reservoir via the housing port and/or unrestricted production of reservoir fluids through the housing port into the central passage 106.

In this implementation, the top sleeve 124 is provided with an annular inlet 252 adapted to establish fluid communication between the central passage and the annular region 130 such that wellbore fluid within the central passage can flow within the annular region. As previously described, this initial ingress of fluid can pressurize the annular chamber 132 and prevent subsequent fluids or material (e.g., cement)

from flowing into the chamber. In this implementation, the annular inlet 252 includes a plurality of slotted inlets circumferentially dispersed along an inner surface of the top sleeve. Therefore, fluid flowing along the central passage can go through the slotted inlets and into the annular region 130. With the flow-controlling sleeve 250 positioned within the annular chamber, it is appreciated that the flow-controlling sleeve 250 can be protected from cement due to the previous fluid pressurization of the annular chamber.

In some implementations, once the reservoir has been fractured, the bottom sleeve can be shifted back uphole to the closed position to prevent back flow of the fracturing fluid from the formation and allow "healing" or equilibration of the reservoir prior to production. Alternatively, and with reference to FIG. 29, the top sleeve 124 can be shifted downhole to overlay and at least partially block the housing port 112. In this implementation, the flow-controlling sleeve 250 can include a sleeve shoulder 256 at a downhole end thereof against which the top sleeve can abut. The sleeve shoulder 256 is defined by a portion of the flow-controlling sleeve 250 which has a smaller inner diameter, thereby enabling the top sleeve to abut thereon. It should thus be understood that shifting the top sleeve in the downhole direction pushes against the sleeve shoulder 256 and correspondingly displaces the flow-controlling sleeve 250 along with the top sleeve.

As seen in FIG. 29, the valve assembly can be operated in a secondary closed configuration by shifting down the top sleeve, which displaces the flow-controlling sleeve 250 for alignment thereof with the housing port 112. It is thus noted that, in this implementation, the downhole end of at least one of the top sleeve and the flow-controlling sleeve 250 can be of an occluding nature (e.g., not slotted or provided with openings) to prevent fluid communication between the reservoir and the central passage 106. In some implementations, the flow-controlling sleeve 250 is provided with the latching mechanism 165, such as the latching mechanism previous described in relation to the collet, configured to releasably engage the outer wall 103 for positioning and retaining the flow-controlling sleeve 250 at predetermined locations within the valve housing. In some implementations, shifting the top sleeve and the flow-controlling sleeve 250 downhole brings the flow-controlling sleeve 250 in abutment with the bottom sleeve 122 to prevent further downhole movement, although other configurations are possible.

Figure 30:
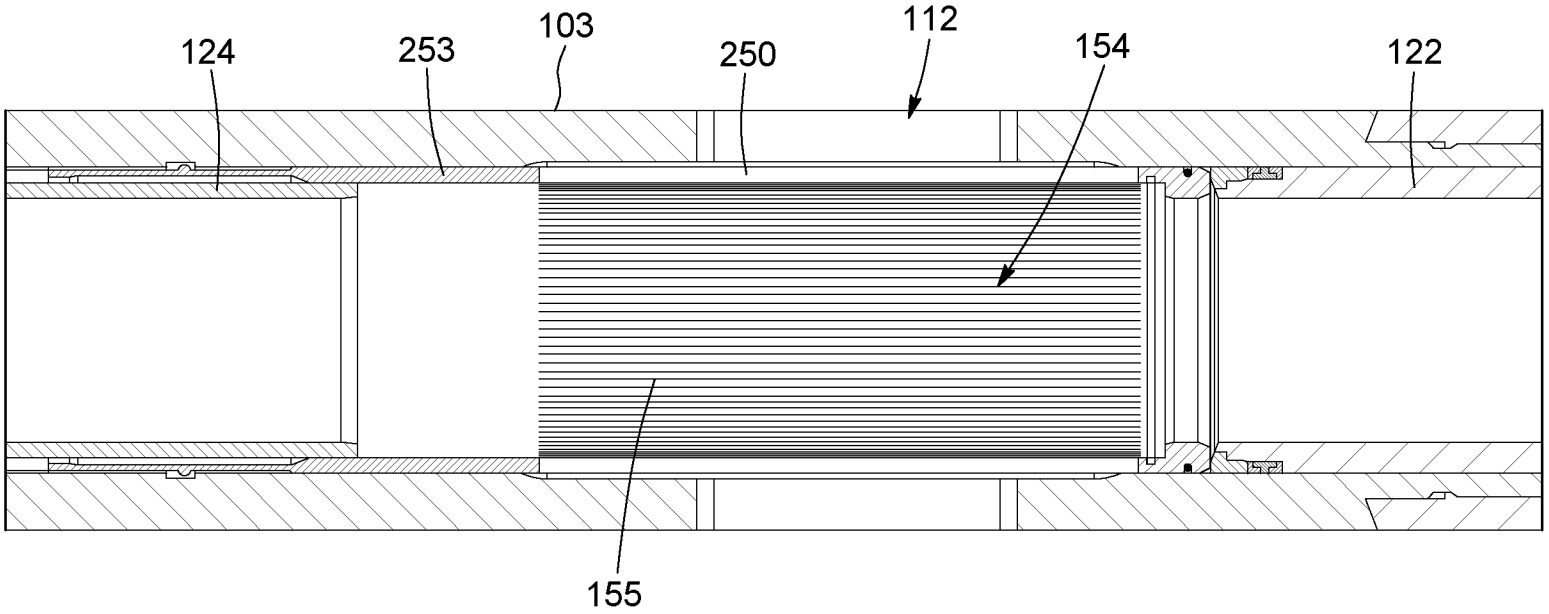

Referring now to FIG. 30, in this implementation, the downhole end of the flow-controlling sleeve 250 is provided with the flow control device, and more specifically, the downhole end includes the screen 154. In some implementations, the screen 154 can define a slotted region of the flow-controlling sleeve 250, whereby the flow-controlling sleeve 250 is provided with a plurality of openings 155 defined through a thickness of the flow-controlling sleeve mandrel 253. As seen in FIG. 30, the openings 155 can be substantially parallel to one another and the longitudinal axis of the valve assembly. The openings 155 can have any suitable shape, size and/or configuration, although it is appreciated that wider and/or a greater number of openings 155 can allow a greater flowrate of fluid into the valve assembly.

Still with reference to FIG. 30, the valve assembly 100 can be operated in a screened configuration, where the screen 154 is aligned with the housing port 112 for enabling a screened production of reservoir fluids. In this implementation, to operate the valve assembly from the secondary closed configuration (seen in FIG. 29) to the screened configuration (seen in FIG. 30), the top sleeve is shifted back uphole, such as back to its initial run-in position. With the flow-controlling sleeve 250 being slidable relative to the top sleeve and coupled to the outer wall via the latching mechanism, the top sleeve can be shifted back uphole by itself (i.e., without dragging the flow-controlling sleeve 250 back with it). As such, the screen 154 remains aligned with the housing port 112 for operation of the valve assembly in the screened configuration.

In this implementation, the flow-controlling sleeve 250 can be reverted to its initial isolated position within the annular region. For example, from the secondary closed or screened configuration, the bottom sleeve 122 can be shifted in the uphole direction. The bottom sleeve can abut the flow-controlling sleeve 250 and can therefore push the flow-controlling sleeve 250 in the uphole direction. When in the secondary closed configuration (FIG. 29), the sleeve shoulder 256 abuts and pushes on the top sleeve, such that all three (3) sleeves are shifted uphole when shifting the bottom sleeve in the uphole direction. When in the screened configuration (FIG. 30), it is noted that the top sleeve is already in its initial uphole position such that the flow-controlling sleeve 250 can be pushed into the annular region 130 between the top sleeve and the outer wall 103. It should thus be understood that the valve assembly can be operated from the closed configuration to the open configuration, to the secondary closed configuration, to the screened configuration and back to the closed configuration. In other words, the valve assembly can be operated back in any one of the operational configurations for performing any corresponding wellbore operation. For example, the valve assembly can be reverted back into the open configuration (e.g., after having produced reservoir fluid through the screen) to enable fracturing the reservoir a subsequent time.

Now referring to FIGS. 31 to 35A, another implementation of the valve assembly is illustrated. In this implementation, the valve assembly 100 includes a dual-sleeve assembly (e.g., a bottom sleeve 122 and a top sleeve 124) and further includes a flow-controlling sleeve 250 coupled to one of the bottom sleeve 122 and the top sleeve 124, such as to the bottom sleeve 122. In some implementations, the flow-controlling sleeve 250 includes the flow control device, or at least a portion thereof. As will be described further below, the flow-controlling sleeve 250 can be slidably mounted within the valve housing which enables movement of the flow-controlling sleeve 250 along the valve housing as the valve sleeves are displaced.

Figure 31:
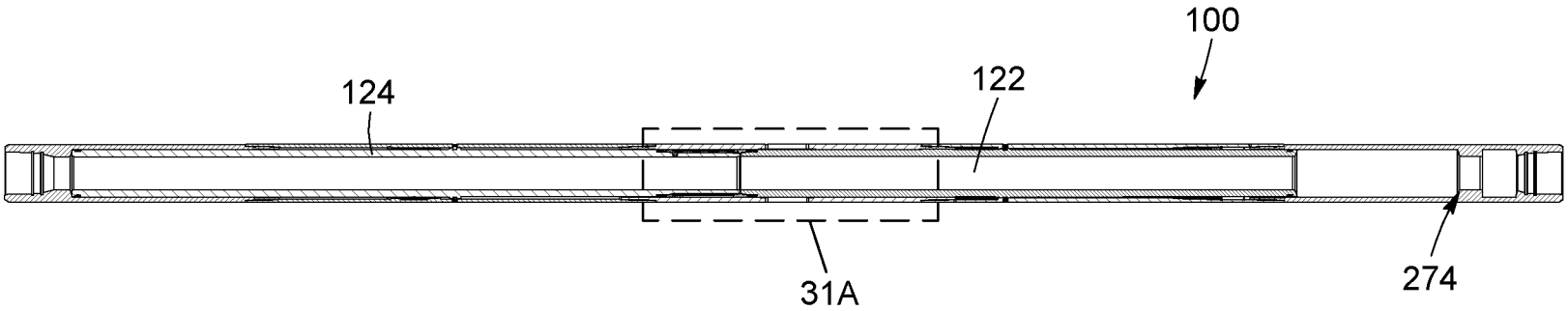
FIG. 31 is a cross-sectional view of an alternate implementation of the valve assembly, showing a dual-barrel valve assembly in a closed configuration, according to an implementation.
Figure 31A:
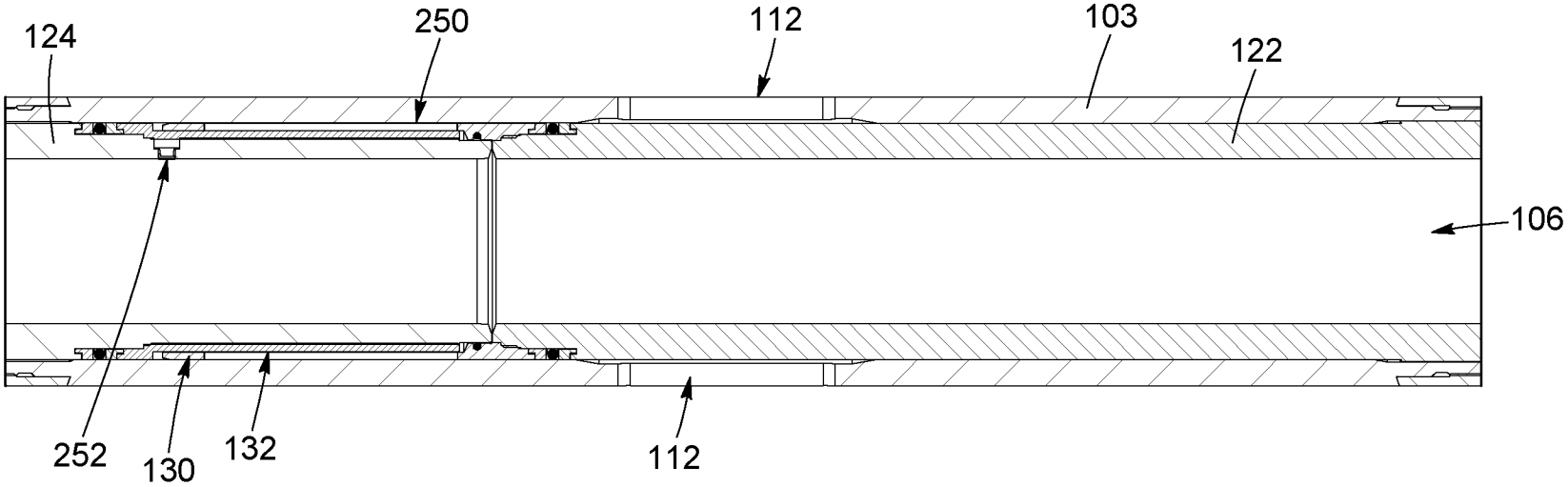
FIG. 31A is an enlarged view of a portion of the valve assembly shown in FIG. 31.
Figure 32:
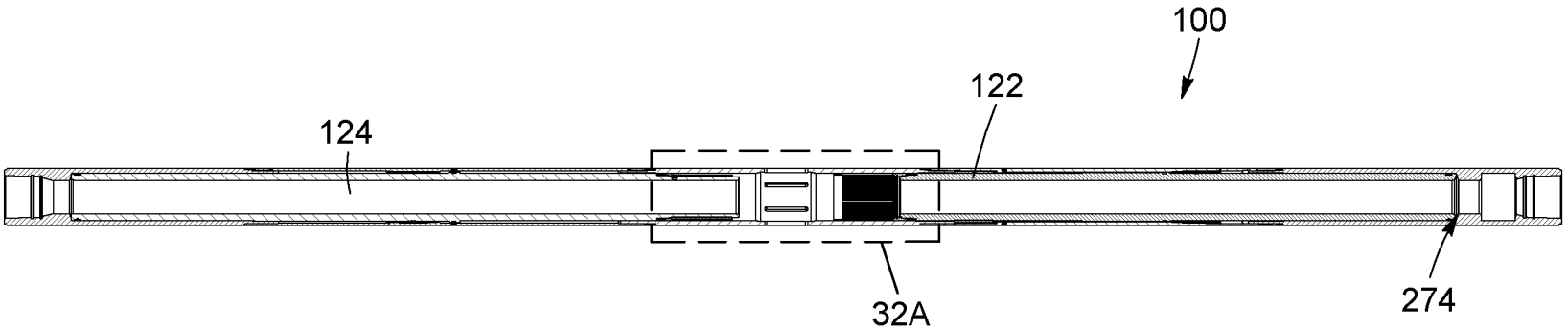
FIG. 32 is a cross-sectional view of the valve assembly shown in FIG. 31, showing the valve assembly in an open configuration, according to an implementation.
Figure 32A:
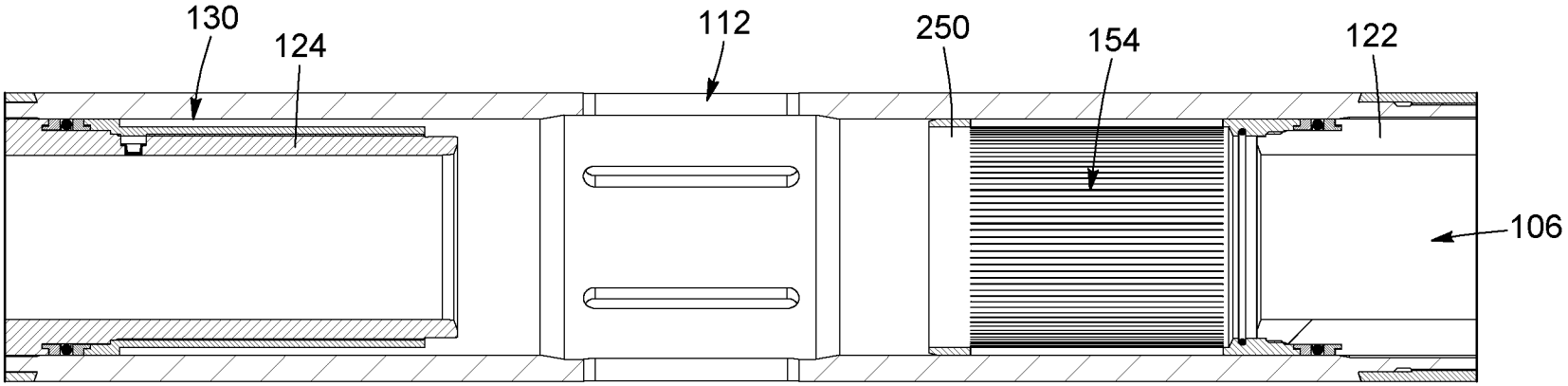
FIG. 32A is an enlarged view of a portion of the valve assembly shown in FIG. 32.

In FIGS. 31 and 31A, the valve assembly 100 is operated in the closed configuration, where the bottom sleeve 122 occludes the housing port 112 to prevent fluid communication between the central passage 106 and the reservoir. While the valve sleeves 122, 124 are in the closed position, the flow-controlling sleeve 250 is illustratively positioned between a downhole end of the top sleeve 124 and the outer wall 103. It is thus noted that the flow-controlling sleeve 250 can be at least partially mounted within the annular region 130, such as within the annular chamber 132. In a similar fashion to previously described implementations, the bottom sleeve can be shifted (e.g., in the downhole direction) to an open position (seen in FIGS. 32 and 32A) and enable operation of the valve assembly in the open configuration. It is appreciated that the open configuration of the valve assembly 100 enables fracturing of the reservoir, injection into the reservoir via the housing port and/or unrestricted production of reservoir fluids through the housing port into the central passage 106.

In this implementation, the top sleeve 124 is provided with an annular inlet, or a vent 252, adapted to establish fluid communication between the central passage and the annular region 130 such that wellbore fluid within the central passage can flow within the annular region. As previously described, this initial ingress of fluid can pressurize the annular chamber 132 and prevent subsequent fluids or material (e.g., cement) from flowing into the chamber. In this implementation, the annular inlet 252 includes one or more openings circumferentially dispersed along an inner surface of the top sleeve. Therefore, fluid flowing along the central passage can go through the openings and into the annular region 130. With the flow-controlling sleeve 250 positioned within the annular chamber, it is appreciated that the flow-controlling sleeve 250 can be protected from cement due to the previous fluid pressurization of the annular chamber.

Figure 33:
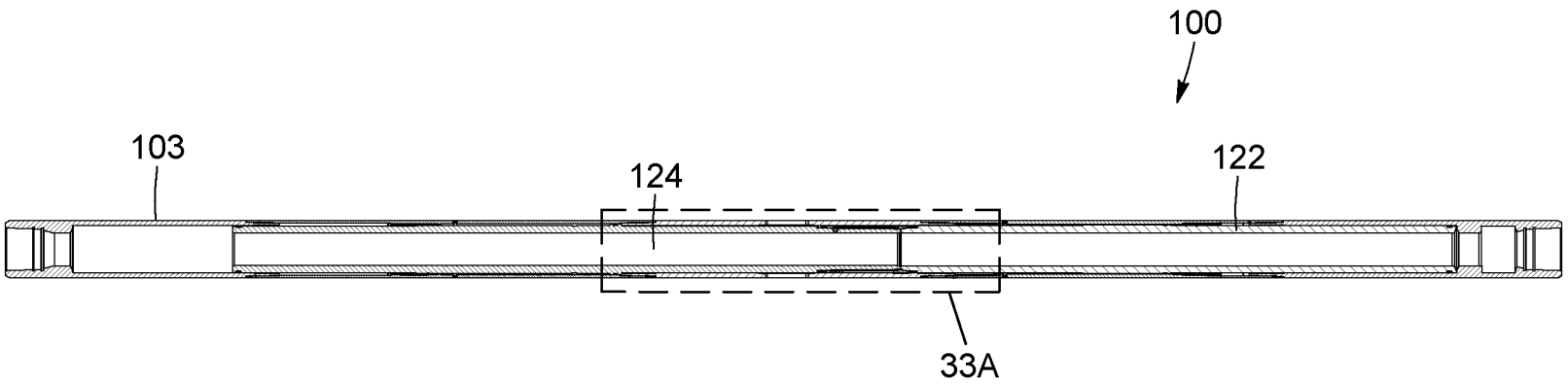
FIG. 33 is a cross-sectional view of the valve assembly shown in FIG. 31, showing the valve assembly in a secondary closed configuration, according to an implementation.
Figure 33A:
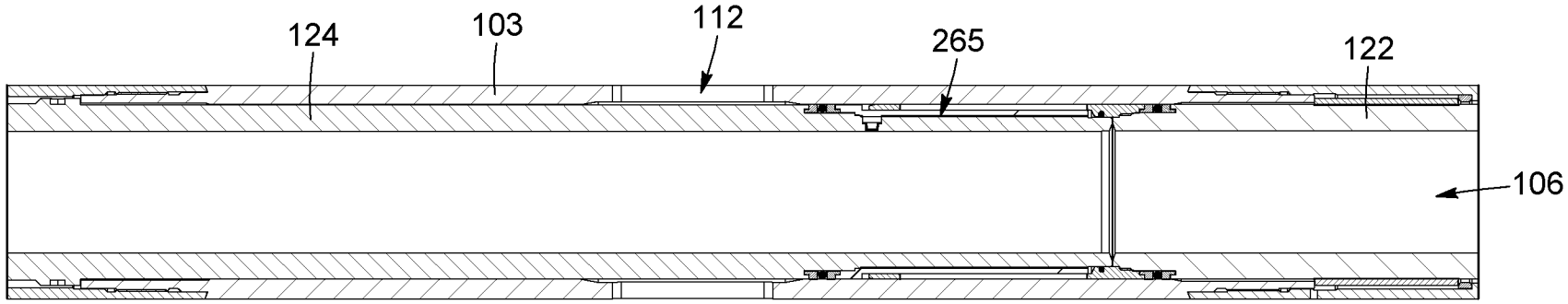
FIG. 33A is an enlarged view of a portion of the valve assembly shown in FIG. 33.

In some implementations, and as seen in FIG. 33, once the reservoir has been fractured, the top sleeve 124 can be shifted toward the bottom sleeve (e.g., downhole) to a secondary closed position occluding the housing port 112 in order to prevent back flow of the fracturing fluid from the formation and allow "healing" or equilibration of the reservoir prior to production. In this implementation, the top sleeve can be provided with a latching mechanism 265 adapted to releasably latch onto the flow-controlling sleeve 250 when moved in the secondary closed position. Once the top sleeve is latched onto the flow-controlling sleeve 250 via the latching mechanism 265, the top sleeve can be moved back uphole, thereby dragging the flow-controlling sleeve 250 and the bottom sleeve along with it. The flow-controlling sleeve 250 is moved in this manner until the flow control device is aligned with the housing port 112 to control fluid flow therethrough.

In this implementation, the valve assembly 100 can be provided with a lock ring 270 installed about the bottom sleeve and being adapted to at least partially limit movement of the bottom sleeve along the valve housing. As will be described further below, the lock ring 270 is configured to be inwardly biased such that the lock ring "squeezes" the bottom mandrel. More particularly, in this implementation, the bottom sleeve 122 includes a downhole end adapted to abut against an inner shoulder 274 of the valve housing to limit downhole movement thereof. It is noted that the bottom sleeve 122 can be in the open position when it abuts the inner shoulder 274.

Figure 34:
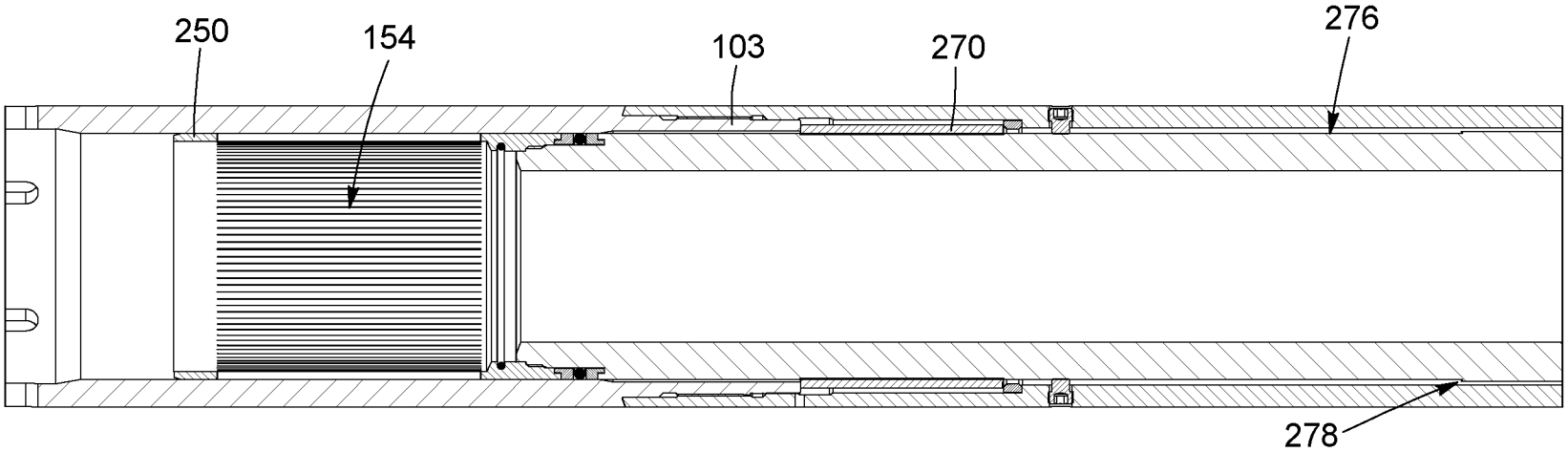
FIG. 34 is an enlarged view of a bottom sleeve shown in FIG. 32, showing a screen provided at an end of the bottom sleeve, and a lock ring provided about the bottom sleeve, according to possible implementations.
Figure 35:
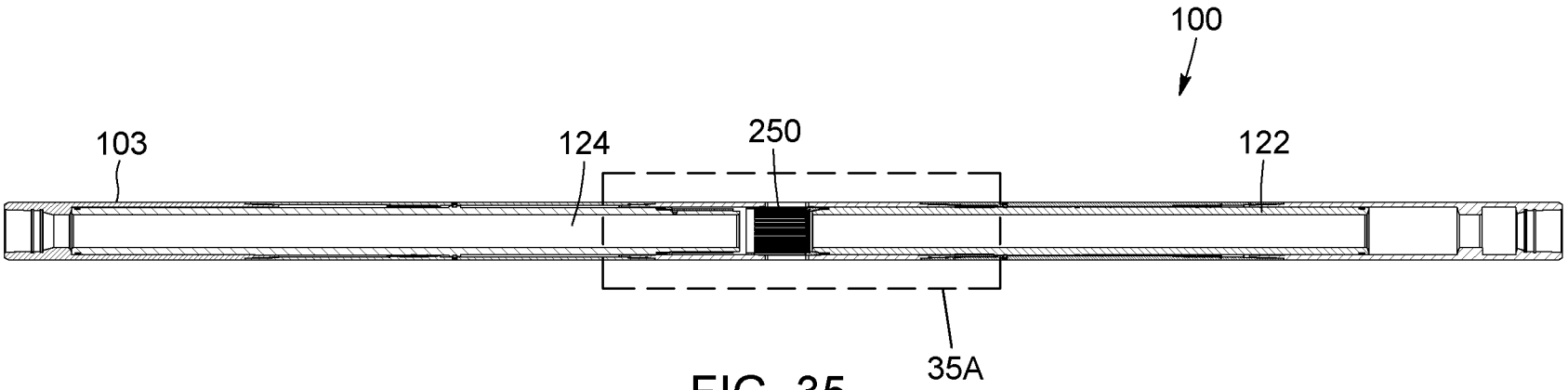
FIG. 35 is a cross-sectional view of the valve assembly shown in FIG. 31, showing the valve assembly in a screened configuration, according to an implementation.
Figure 35A:
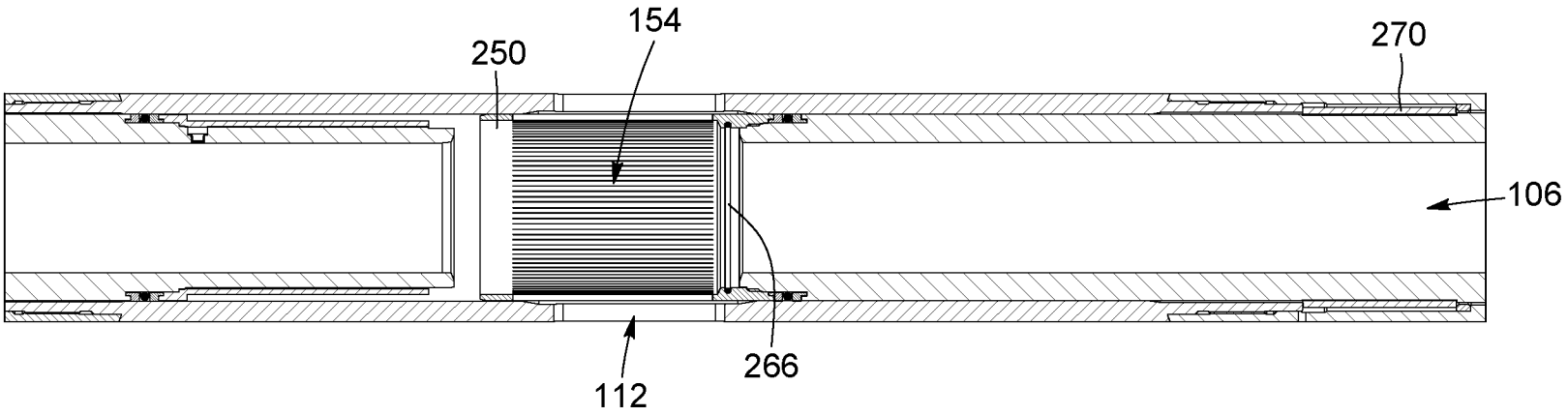
FIG. 35A is an enlarged view of a portion of the valve assembly shown in FIG. 35.

In addition, and with reference to FIGS. 34 to 35A, the mandrel of the bottom sleeve 122 (i.e., the bottom mandrel) is adapted to slidably engage (e.g., contact) the inner surface of the valve housing along a portion of its length. The bottom mandrel can have an inset region 276 defined along a portion thereof and having a smaller outer diameter, thereby defining a sleeve shoulder 278. In this implementation, moving the bottom sleeve in the open position (FIG. 32) aligns the inset region with the lock ring 270, thereby enabling the lock ring to engage (e.g., "snap") onto the bottom mandrel along the inset region, but remains partially retained within an annular housing defined in the tubular wall 103. As such, moving the flow-controlling sleeve 250 and the bottom sleeve in the uphole direction is limited by the lock ring 270, which abuts against the tubular wall 103 and the sleeve shoulder 278.

In this implementation, the flow-controlling sleeve 250 includes the screen 154, similar to the implementation of FIGS. 27 to 30 such that fluid flow is restricted through a slotted region of the flow-controlling sleeve 250. However, it is appreciated that other configurations are possible. The valve assembly 100 can be operated in a screened configuration, where the screen 154 is aligned with the housing port 112 for enabling a screened production of reservoir fluids. In this implementation, to operate the valve assembly in the screened configuration (seen in FIG. 35A), the top sleeve is shifted back uphole, thereby dragging the flow-controlling sleeve 250 and the bottom sleeve along with it via the latching mechanism 265. The lock ring 270, which is engaged with the inset region, abuts against the sleeve shoulder to limit uphole movement of the bottom sleeve and the flow-controlling sleeve. The latching mechanism 265 therefore releases the flow-controlling sleeve 250 (e.g., as the top sleeve is pulled further uphole), leaving the screen in position over the housing port 112, as seen in FIG. 35A.

The latching mechanism 265 can include one or more components of the top sleeve 124 configured to cooperate with the flow-controlling sleeve 250 or the bottom sleeve 122 to releasably couple these components together. For example, the bottom end of the top sleeve can be shaped, sized and/or adapted to engage the flow-controlling sleeve 250 in a releasable press-fit connection. As such, the top sleeve can be shifted uphole and drag the flow-controlling sleeve 250 and the bottom sleeve until the lock ring blocks the movement of the bottom sleeve. Alternatively, or additionally, the top sleeve can be adapted to engage one or more sealing elements 266, such as polymeric seals, provided about an inner surface of the flow-controlling sleeve 250. The sealing elements being adapted to provide sufficient friction between the flow-controlling sleeve 250 and the top sleeve to enable both components to be moved together. It is appreciated that other configurations or implementations of the latching mechanism 265 are possible and may be used.

In this implementation, the top and bottom sleeves can be moved back and forth between the different operational positions described above. It should thus be understood that the valve assembly can be operated between the closed configuration, the open configuration, to the secondary closed configuration and the screened configuration, as desired and/or required.

Figure 36:
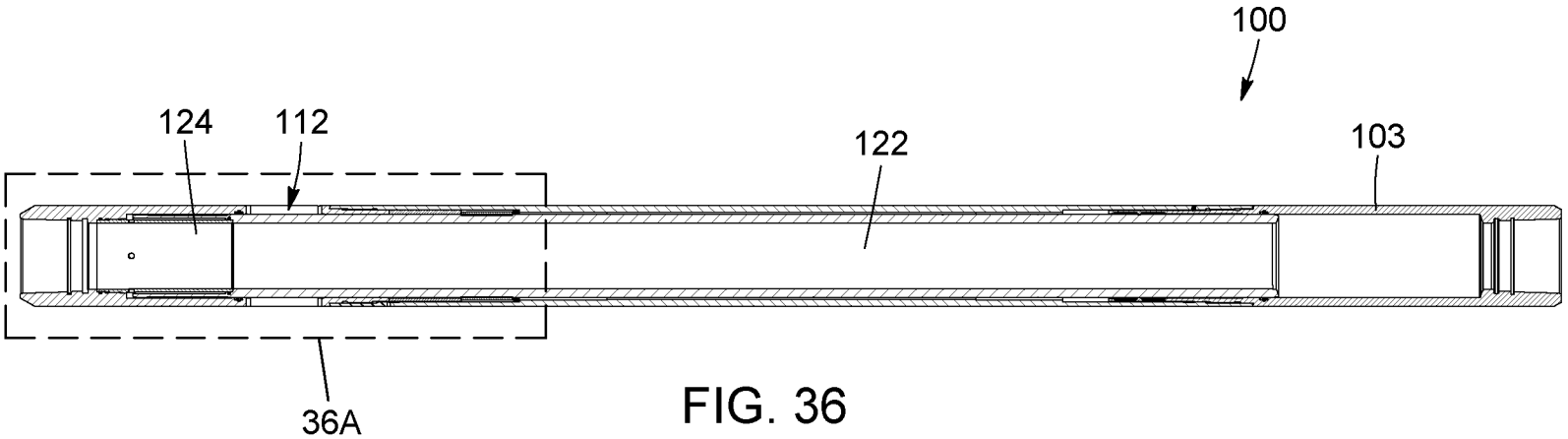
FIG. 36 is a cross-sectional view of an alternate implementation of the valve assembly, showing a valve assembly with a fixed barrel and a movable barrel, according to an implementation.
Figure 36A:
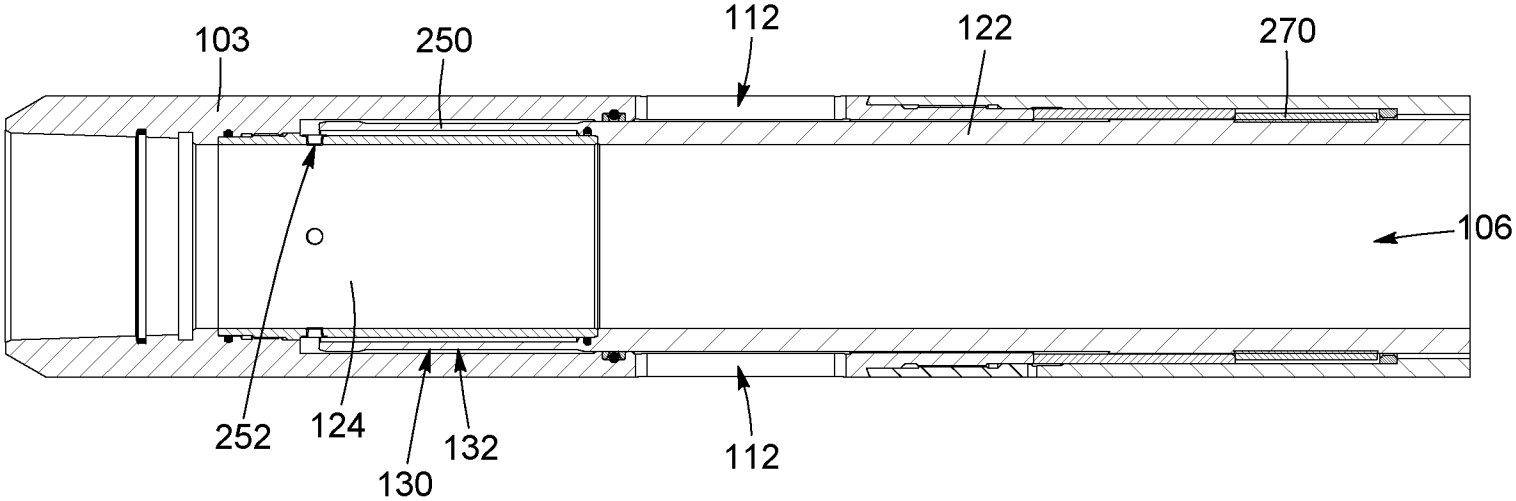
FIG. 36A is an enlarged view of a portion of the valve assembly shown in FIG. 36, showing the valve assembly in a closed configuration, according to a possible implementation.
Figure 37:
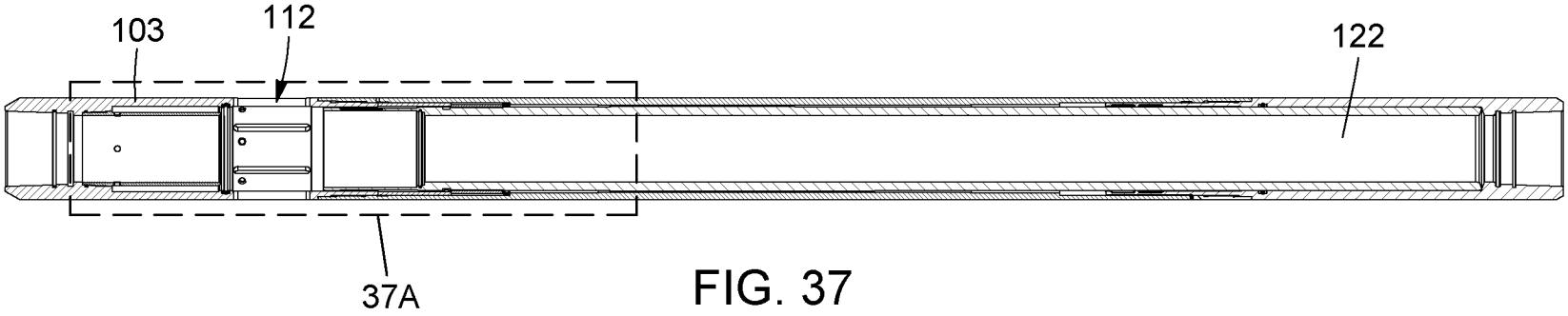
FIG. 37 is a cross-sectional view of the valve assembly shown in FIG. 36, showing the valve assembly in an open configuration, according to an implementation.
Figure 37A:
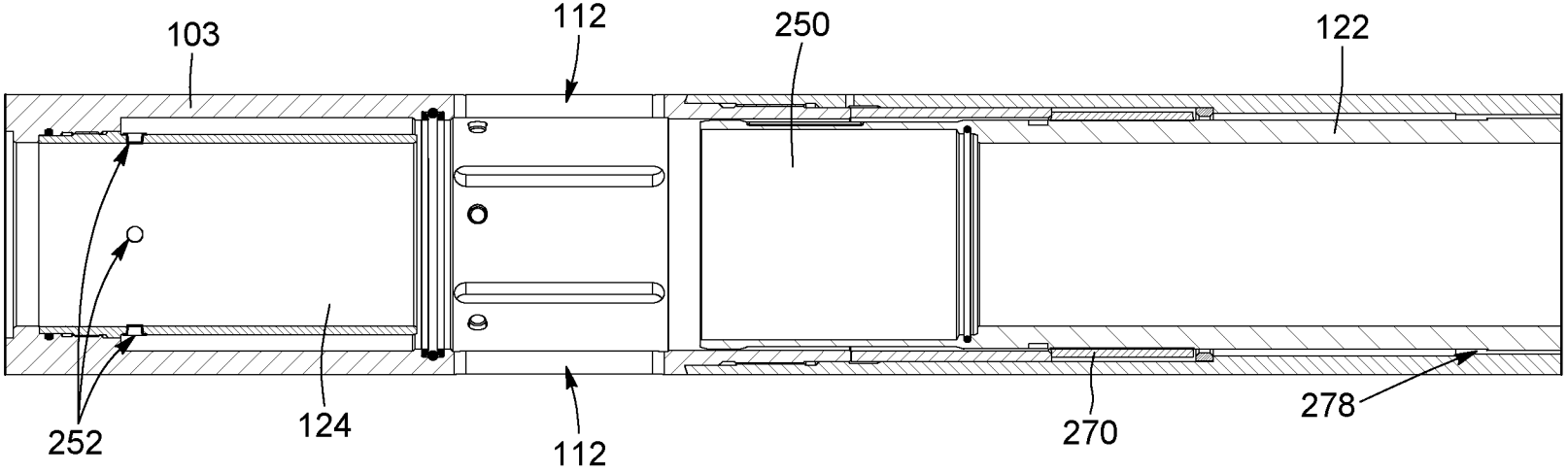
FIG. 37A is an enlarged view of a portion of the valve assembly shown in FIG. 37.
Figure 38:
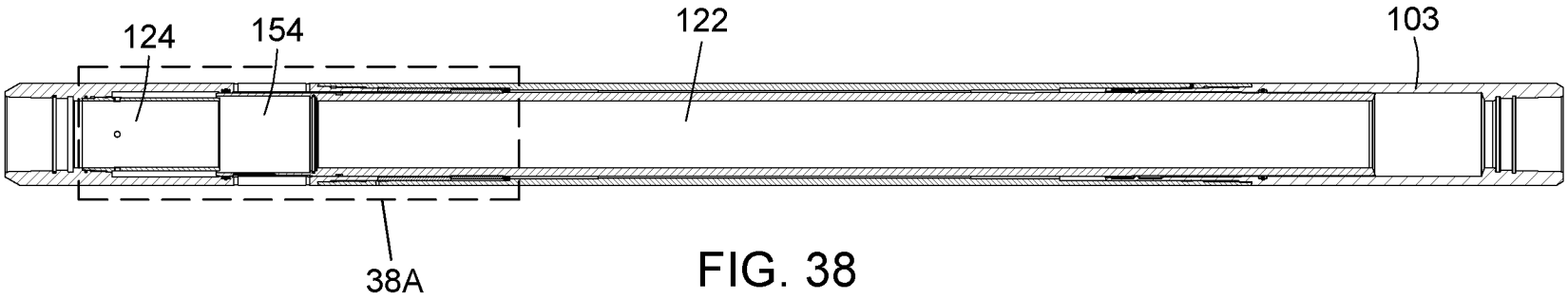
FIG. 38 is a cross-sectional view of the valve assembly shown in FIG. 36, showing the valve assembly in a screened configuration, according to an implementation.
Figure 38A:
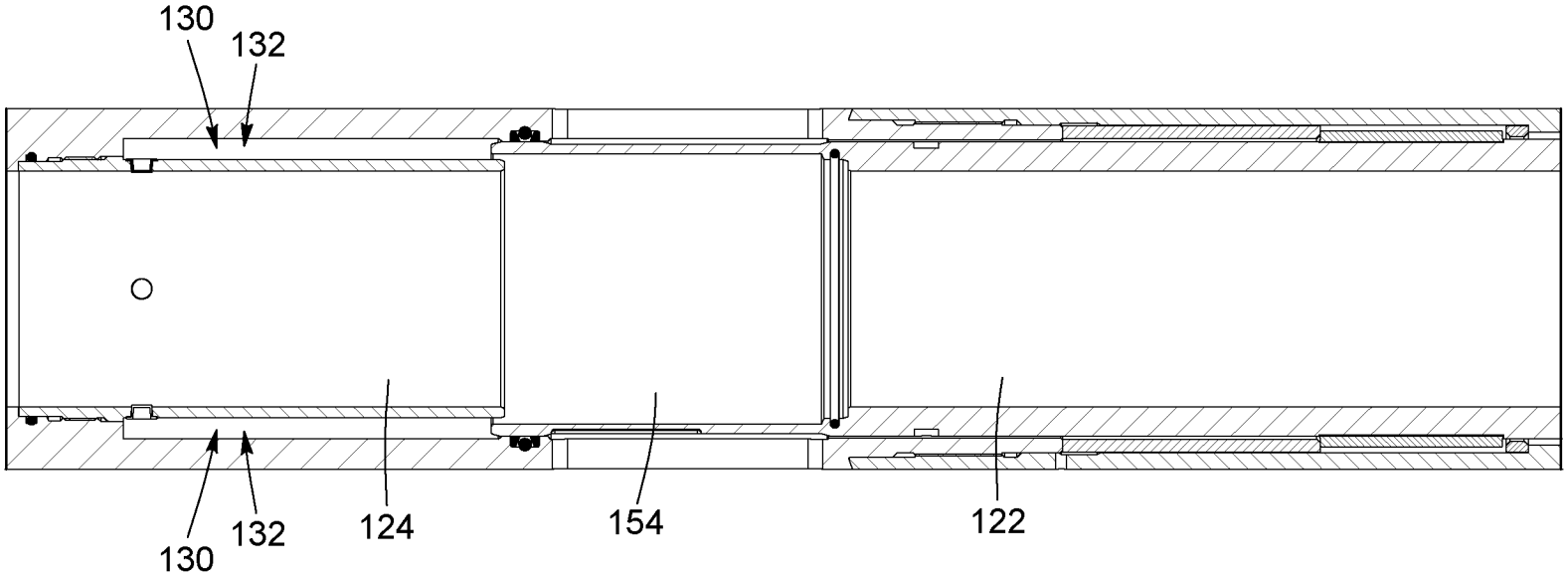
FIG. 38A is an enlarged view of a portion of the valve assembly shown in FIG. 38.
Figure 39:
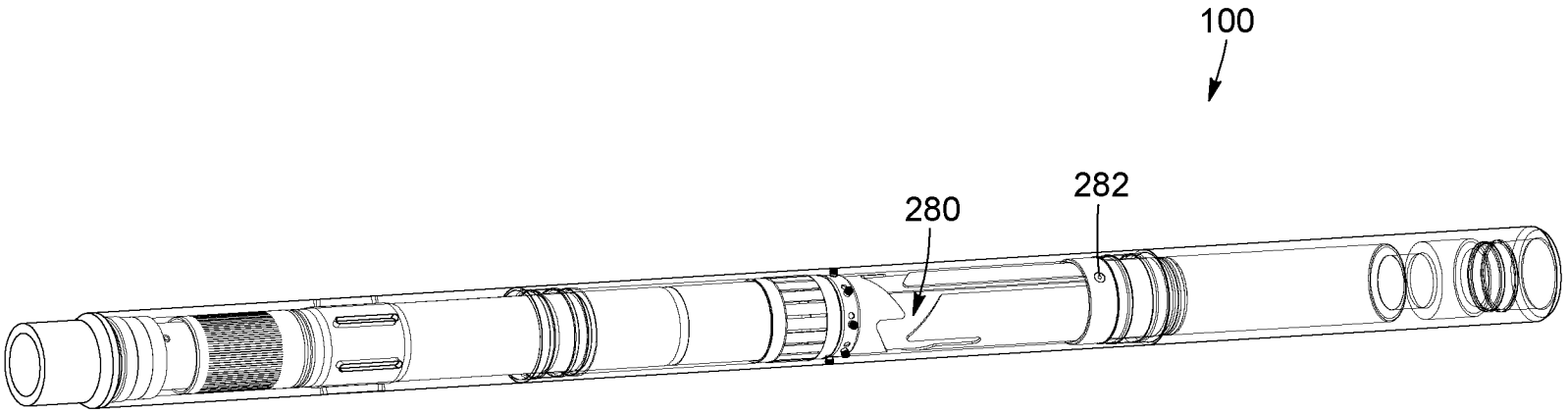
FIG. 39 is a perspective view of an alternate implementation of a valve assembly, showing a dual-barrel valve assembly with a rotating barrel, according to an implementation.

Now referring to FIGS. 36 to 38A, another implementation of the valve assembly is illustrated. In this implementation, the top sleeve 124 can be fixed (e.g., secured, immobile, etc.) relative to the housing, and the bottom sleeve can include the flow control device (e.g., the screen 154) provided at an uphole end thereof. In this implementation the flow control device is integrated with the mandrel of the bottom sleeve such that it forms a single piece. As seen in FIGS. 36 and 36A, the valve assembly 100 is operated in the closed configuration, where the bottom sleeve 122 occludes the housing port 112 to prevent fluid communication between the central passage 106 and the reservoir. While in the closed position, the screen is illustratively positioned between the top sleeve 124 and the outer wall 103. It is thus noted that the screen 154 can be positioned within the annular region 130, such as within the annular chamber 132 for protection thereof. In a similar fashion to previously described implementations, the bottom sleeve can be shifted (e.g., in the downhole direction) to an open position (seen in FIGS. 37 and 37A) and enable operation of the valve assembly in the open configuration.

In this implementation, the top sleeve 124 is provided with an annular inlet, or vent 252, adapted to establish fluid communication between the central passage and the annular region 130 such that wellbore fluid within the central passage can flow within the annular region. As previously described, this initial ingress of fluid can pressurize the annular chamber 132 and prevent subsequent fluids or material (e.g., cement) from flowing into the chamber. In this implementation, fluid flowing along the central passage can go through the annular inlet and into the annular region 130.

In this implementation, the valve assembly 100 is provided with a lock ring 270 similar to the previously described implementation. More specifically, the lock ring 270 is configured to snap into an inset region of the bottom sleeve to limit uphole movement of the bottom sleeve as the lock ring abuts against the sleeve shoulder. When the lock ring 270 abuts the sleeve shoulder 278, the screen 154 is positioned in alignment with the housing port 112 such that fluid flow is controlled, restricted, filtered, etc., through the screen 154. In other words, when the lock ring 270 engages the sleeve shoulder, the valve assembly is operated in the screened configuration for enabling a screened production of reservoir fluids. In this implementation, the bottom sleeve can be moved back and forth between the different operational positions described above, with the top sleeve being fixed and secured to the valve housing. It should thus be understood that the valve assembly can be operated between the closed configuration, the open configuration and the screened configuration, as desired and/or required.

Figure 40:
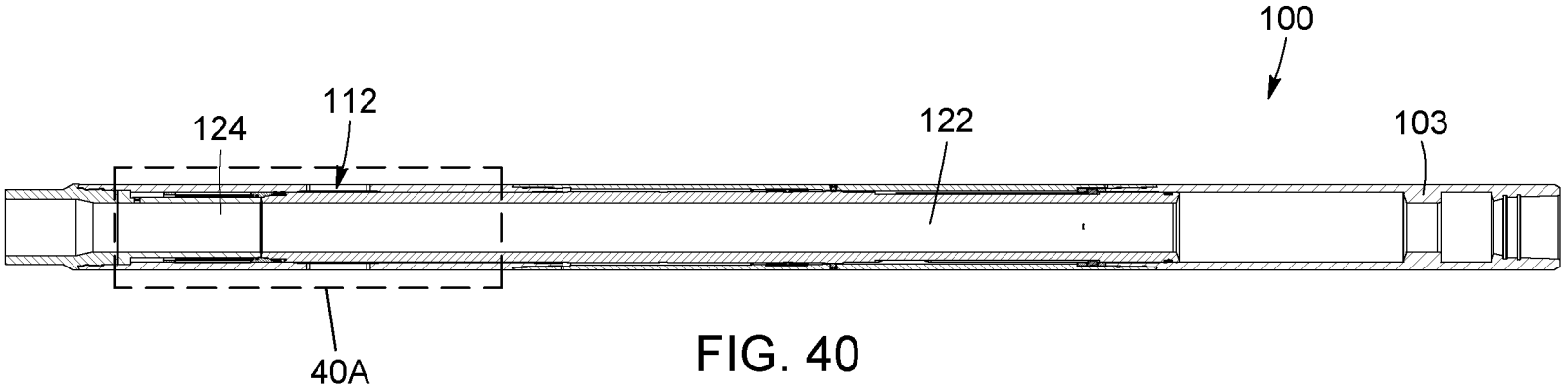
FIG. 40 is a cross-sectional view of the valve assembly shown in FIG. 39, showing the valve assembly in a closed configuration, according to a possible implementation.
Figure 40A:
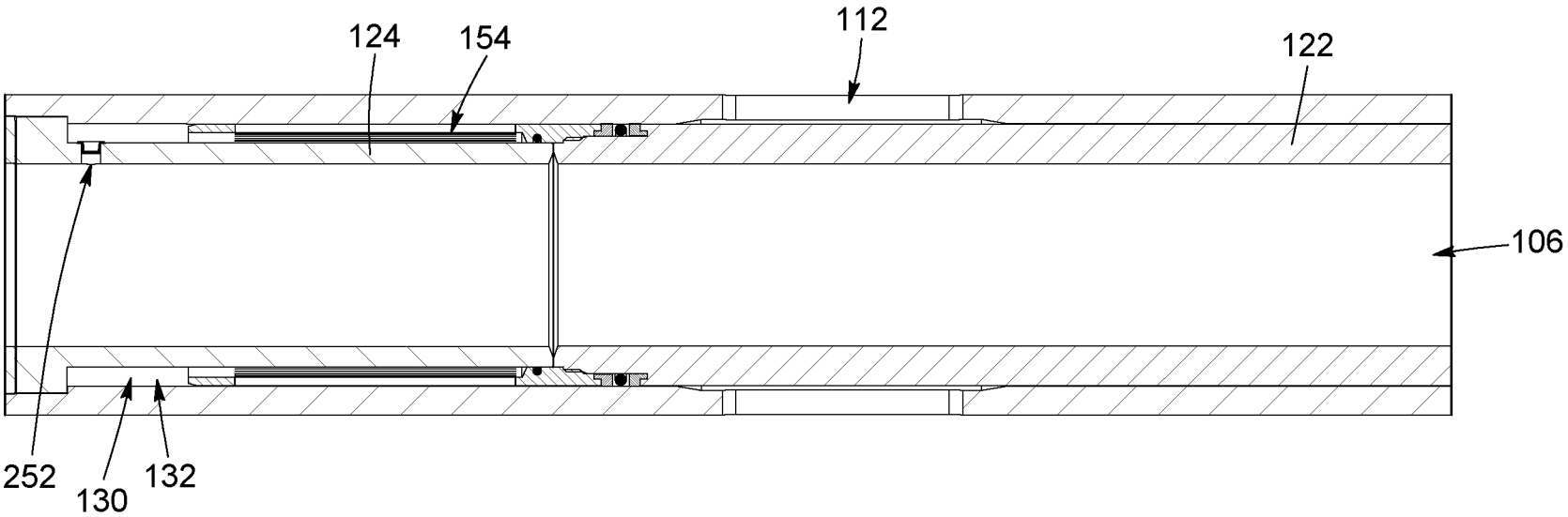
FIG. 40A is an enlarged view of a portion of the valve assembly shown in FIG. 40.

Now referring to FIGS. 39 to 45A, another implementation of the valve assembly is illustrated. In this implementation, the top sleeve 124 can be fixed (e.g., secured, immobile, etc.) relative to the housing, and the bottom sleeve can include the flow control device (e.g., the screen 154) provided at an uphole end thereof. As seen in FIGS. 40 and 40A, the valve assembly 100 is operated in the closed configuration, where the bottom sleeve 122 occludes the housing port 112 to prevent fluid communication between the central passage 106 and the reservoir. While in the closed position, the screen 154 is illustratively positioned between the top sleeve 124 and the outer wall 103. It is thus noted that the screen 154 can be positioned within the annular region 130, such as within the annular chamber 132 for protection thereof. In a similar fashion to previously described implementations, the top sleeve 124 is provided with an annular inlet, or vent 252, adapted to establish fluid communication between the central passage and the annular region 130 such that wellbore fluid within the central passage can flow within the annular region. As previously described, this initial ingress of fluid can pressurize the annular chamber 132 and prevent subsequent fluids or material (e.g., cement) from flowing into the chamber. In this implementation, fluid flowing along the central passage can go through the annular inlet and into the annular region 130.

In this implementation, the bottom sleeve can be shifted (e.g., in the downhole direction) to an open position (seen in FIGS. 41 and 41A) and enable operation of the valve assembly in the open configuration, and can subsequently be shifted back (e.g., in the uphole direction) to align the screen 154 with the housing port 112 (seen in FIGS. 42 and 42A) and enable operation of the valve assembly in the screened configuration. As will be described further below, the bottom sleeve 122 is adapted to move axially and radially (e.g., rotate about its longitudinal axis) within the valve housing when moving between the open, closed and screened positions.

As seen in FIGS. 39, 41, 43 and 45, the bottom sleeve 122 can include a guiding track 280 defined along an outer surface thereof, and the valve housing can include one or more guiding pins 282 configured to engage the guiding track 280. As will be understood, the bottom sleeve is actuatable to move back and forth along the central passage and the guiding pins 282 remain generally stationary to limit movement of the bottom sleeve in either directions. For example, the guiding track 280 can include an elongated slot 285 extending longitudinally along the bottom sleeve 122 having opposite ends defining stops against which the guiding pin 282 can abut, thereby limiting movement of the bottom sleeve 122 in the corresponding direction. In other words, moving the bottom sleeve in the closed position can cause the guiding pin to engage a downhole end of the elongated slot, and moving the bottom sleeve in the open position can cause the guiding pin to engage an uphole end of the elongated slot.

In this implementation, the guiding track 280 includes a plurality of elongated slots 285, dispersed radially about the bottom sleeve and extending substantially parallel to one another. The elongated slots 285 can include slots of varying lengths such that the bottom sleeve can be positioned at different locations along the central passage. As will be described below, the guiding track 280 can include angled surfaces 290 configured to offset the position of the guiding pin relative to the elongated slots as it slides along the angled surfaces. It is thus noted that the angled surfaces 290 can be adapted to rotate the bottom sleeve within the central passage as the bottom sleeve is moved to engage the angled surfaces with the guiding pin. As such, the guiding pin 282 can be made to engage different elongated slots 285 around the bottom sleeve to limit movement of the bottom sleeve in a given direction to position the screen in various, selected and/or desired locations. In this implementation, the bottom sleeve can have a symmetrical configuration, with a pair of guiding pins 282 engaging respective elongated slots on either side of the bottom sleeve, although other configurations are possible (e.g., a single guiding pin, three or more guiding pins, asymmetrical configuration, etc.).

Figure 41:
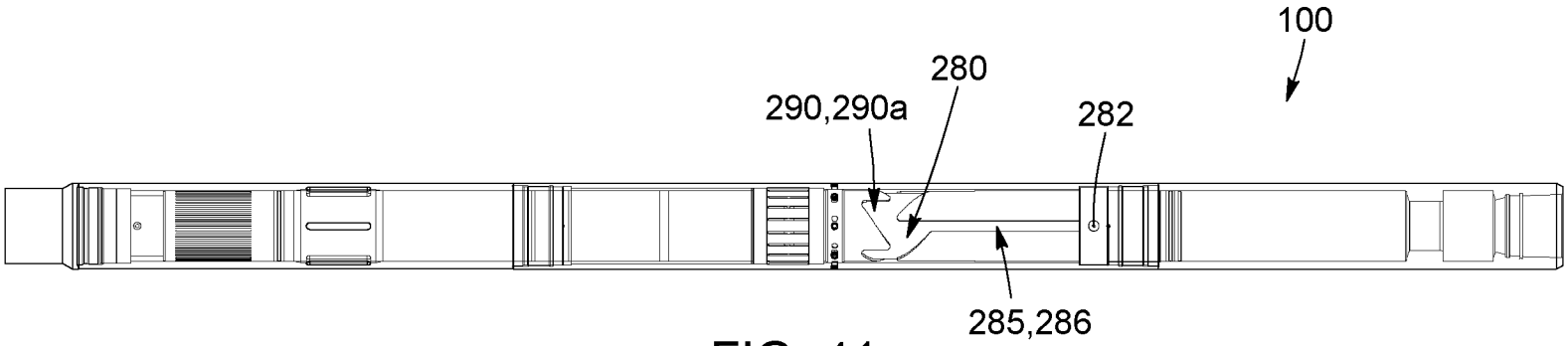
FIG. 41 is a top view of the valve assembly shown in FIG. 39, showing a guiding pin engaged in an elongated slot for positioning the valve assembly in the closed configuration, according to an implementation.
Figure 41A:
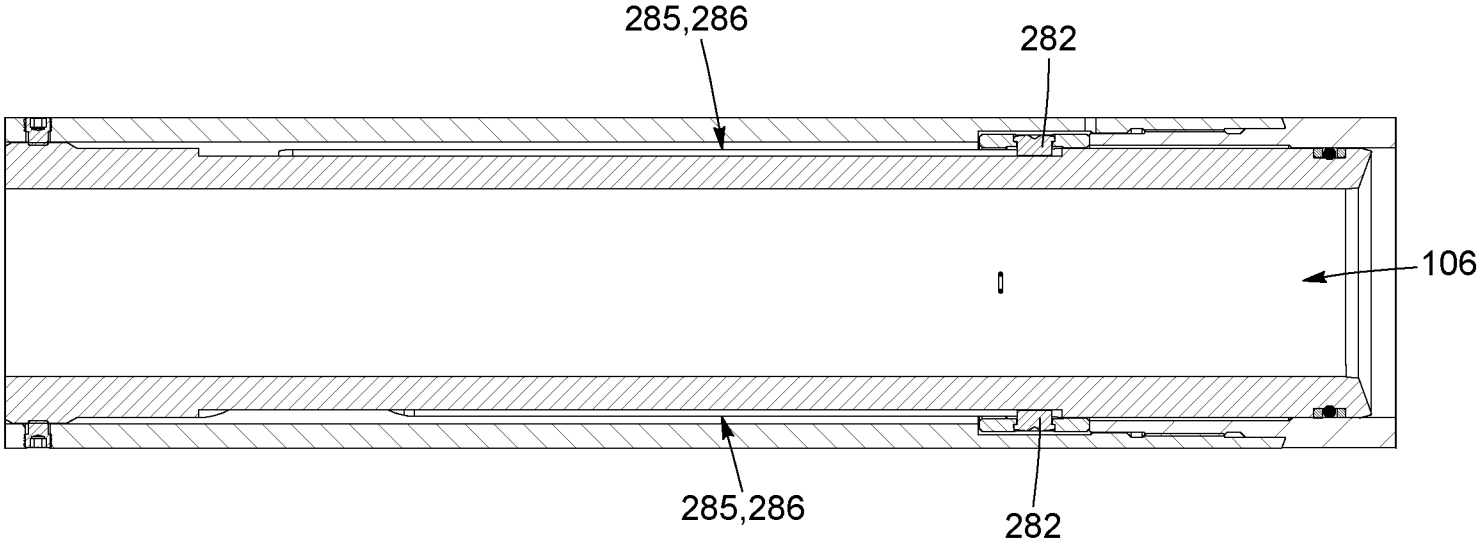
FIG. 41A is a cross-sectional view of the valve assembly shown in FIG. 41, showing a pair of guiding pins engaging a bottom end of respective elongated slots, according to an implementation.
Figure 42:
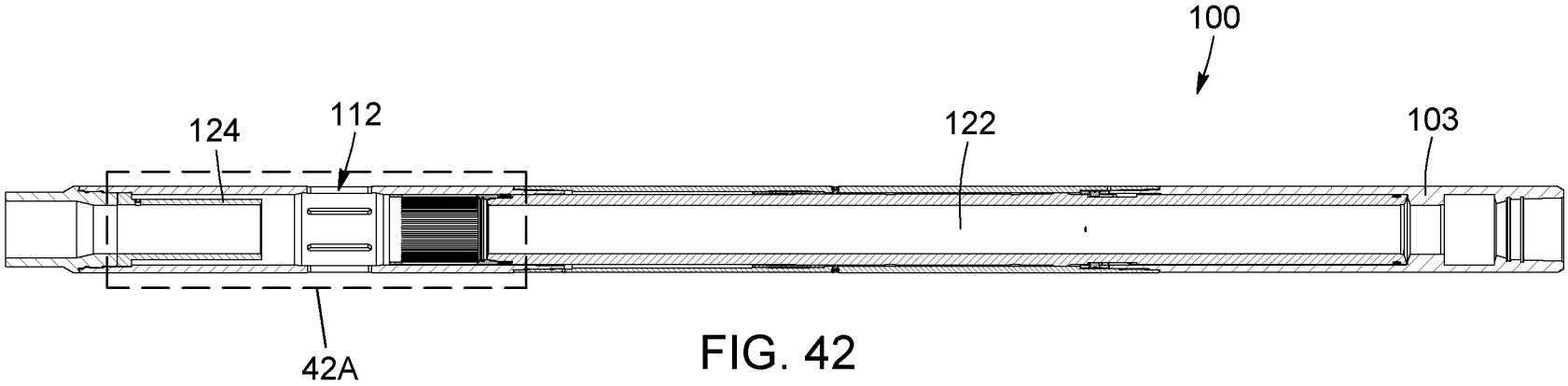
FIG. 42 is a cross-sectional view of the valve assembly shown in FIG. 39, showing the valve assembly in an open configuration, according to a possible implementation.
Figure 42A:
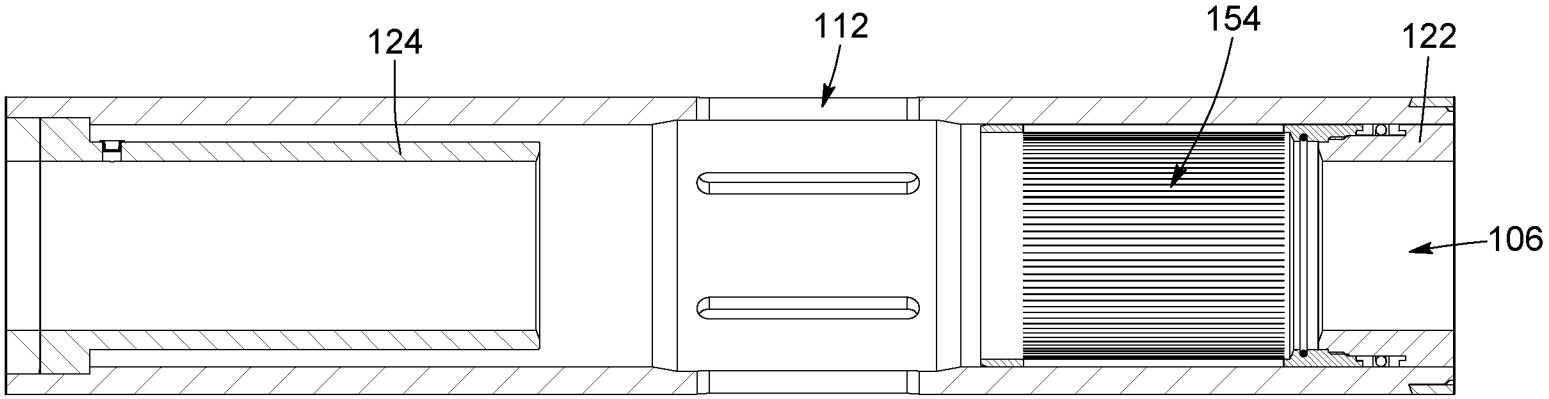
FIG. 42A is an enlarged view of a portion of the valve assembly shown in FIG. 42.
Figure 43:
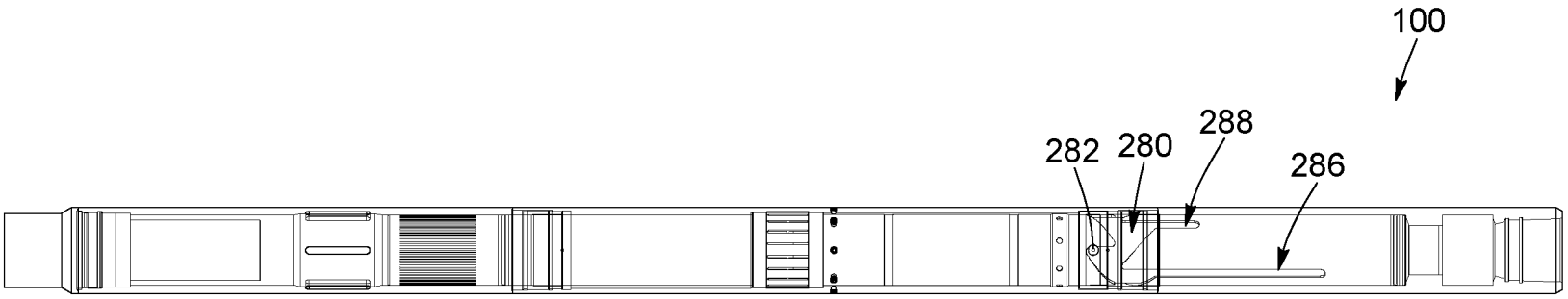
FIG. 43 is a top view of the valve assembly shown in FIG. 39, showing the guiding pin engaged in a corner of an angled surface for positioning the valve assembly in the open configuration, according to an implementation.
Figure 44:
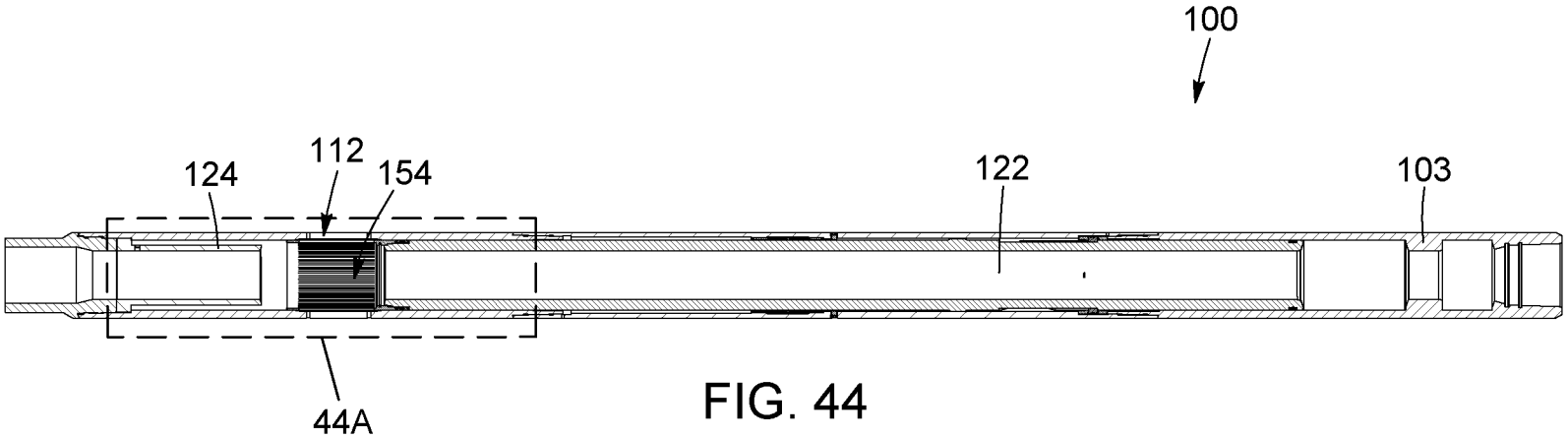
FIG. 44 is a cross-sectional view of the valve assembly shown in FIG. 39, showing the valve assembly in a screened configuration, according to a possible implementation.
Figure 44A:
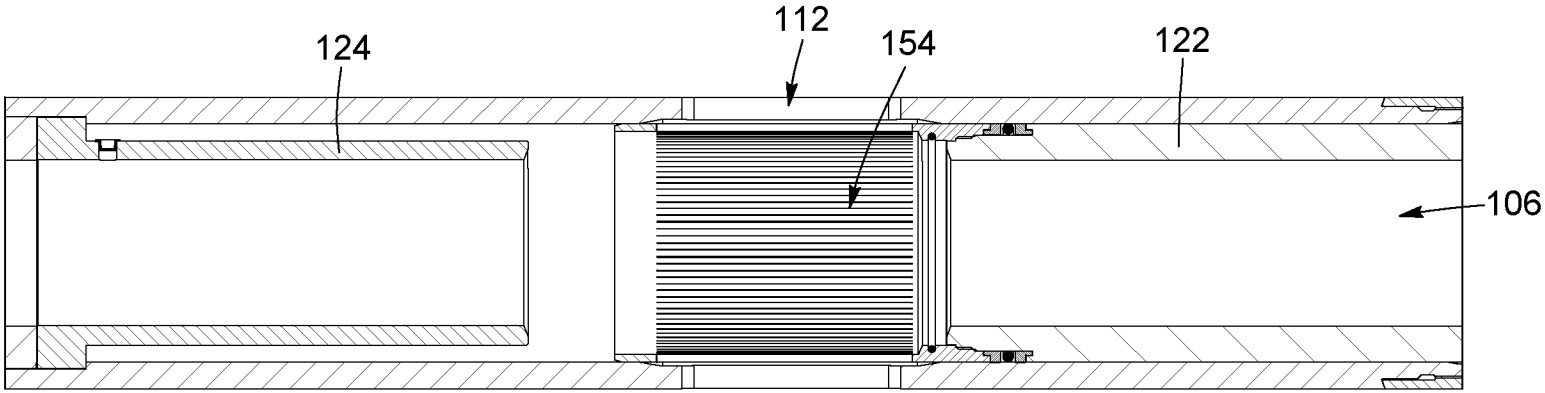
FIG. 44A is an enlarged view of a portion of the valve assembly shown in FIG. 44.
Figure 45:
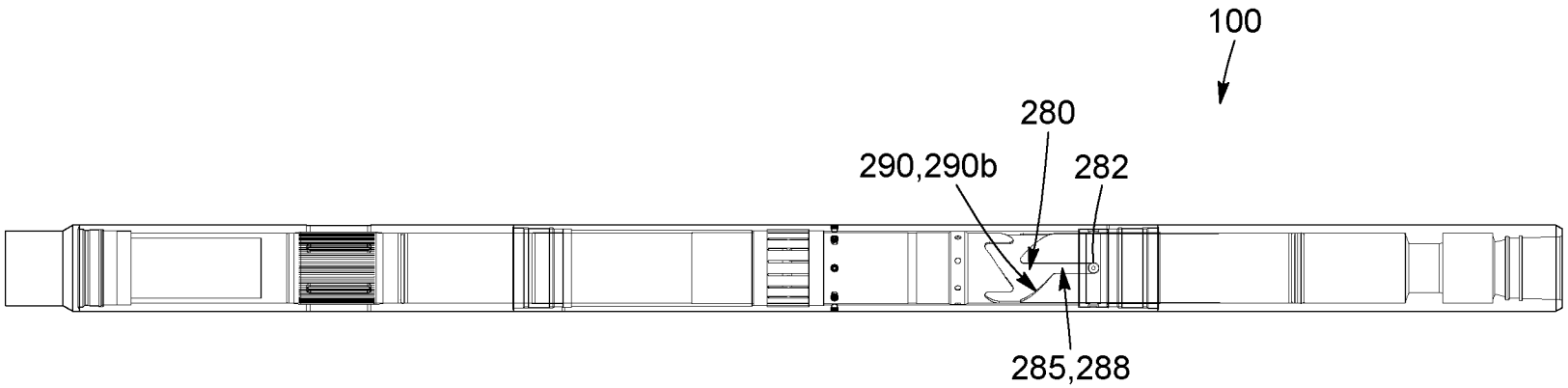
FIG. 45 is a top view of the valve assembly shown in FIG. 39, showing the guiding pin engaged in a second elongated slot for positioning the valve assembly in the screened configuration, according to an implementation.
Figure 45A:
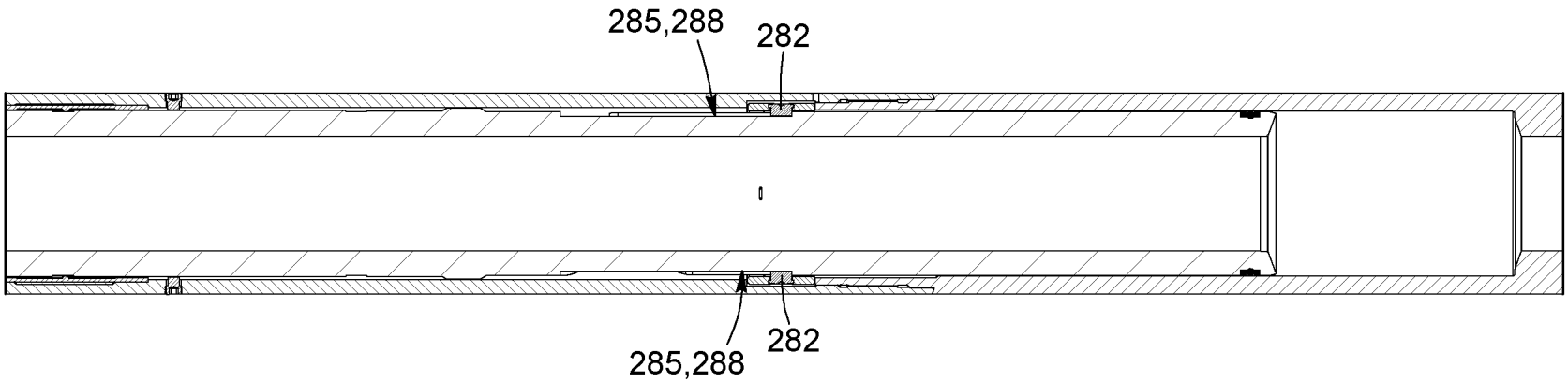
FIG. 45A is a cross-sectional view of the valve assembly shown in FIG. 45, showing a pair of guiding pins engaging respective second elongated slots, according to an implementation.

Still referring to FIGS. 39, 41, 43 and 45, the guiding track 280 includes first slots 286 having a first length, and second slots 288 having a second length. The first length can be greater than the second length such that engaging the guiding pins within the first slots to contact the downhole end thereof can position the bottom sleeve in the closed position (e.g., in the upholemost position of the bottom sleeve), as seen in FIGS. 41 and 41A. It is thus noted that engaging the guiding pins within the second slots, as seen in FIGS. 45 and 45A, can position the bottom sleeve in the screened position, where the screen is aligned with the housing port, as seen in FIGS. 44 and 44A. In this implementation, the first and second slots alternate each other around the bottom sleeve. However, it is appreciated that other configurations are possible.

Figure 43A:
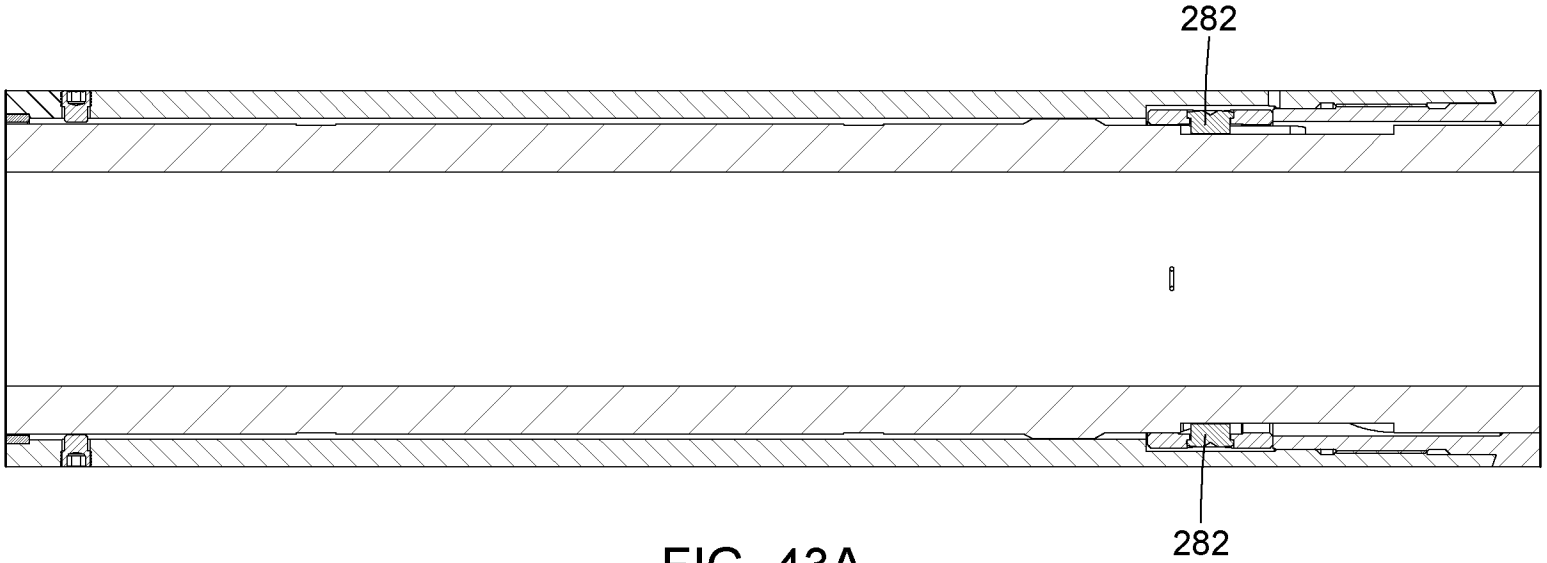
FIG. 43A is a cross-sectional view of the valve assembly shown in FIG. 43, showing a pair of guiding pins engaging respective corners, according to an implementation.

In this implementation, the angled surfaces 290 include a first set of angled surfaces 290*a* adapted to rotate the bottom sleeve when moving in the downhole direction, and a second set of angled surfaces 290*b* adapted to rotate the bottom sleeve when moving in the uphole direction. The first and second sets of angled surfaces extend in generally opposite directions such that moving the bottom sleeve back and forth (e.g., alternating downhole and uphole movements) rotates the bottom sleeve within the central passage in the same direction. As seen in FIGS. 43 and 43A, moving the bottom sleeve downhole causes the angled surfaces of the first set 290*a* to engage the guiding pins until the pin is positioned in a corner of the guiding track. The bottom sleeve is thus rotated to position the guiding pin between an adjacent pair of elongated slots (seen in FIG. 43). Then, the bottom sleeve can be shifted uphole, thereby engaging the angled surfaces of the second set with the guiding pins, which further rotates the bottom sleeve to align the guiding pins with an elongated slot (seen in FIG. 45).

Now referring to FIGS. 46 to 48A, another implementation of the valve assembly is illustrated. In this implementation, the valve assembly 100 includes a dual-sleeve assembly (e.g., a bottom sleeve 122 and a top sleeve 124) and further includes the flow-controlling sleeve 250 coupled to the top sleeve 124. The flow-controlling sleeve 250 includes the screen 154, which is installed between the top sleeve 124 and the outer wall 103 of the housing. It is thus noted that the screen 154 is at least partially mounted within the annular region 130, such as within the annular chamber 132 for protection thereof. The annular chamber can be in fluid communication with the central passage via interstices 135 defined between the top sleeve and the housing. The interstices are adapted to establish fluid communication between the central passage and the annular region 130 such that wellbore fluid within the central passage can flow within the annular region. Alternatively, the top sleeve can include vents configured to allow an ingress of fluid within the annular chamber. As previously described, this initial ingress of fluid can pressurize the annular chamber 132 and prevent subsequent fluids or material (e.g., cement) from flowing into the chamber.

Figure 46:
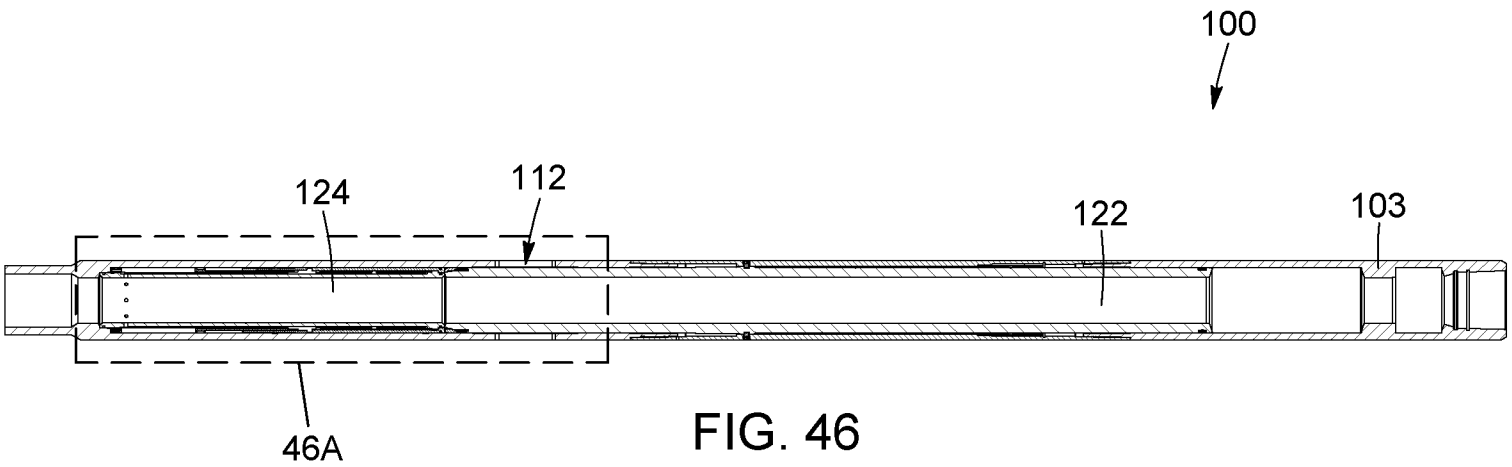
FIG. 46 is a cross-sectional view of an alternate implementation of the valve assembly, showing a dual-barrel valve assembly with an inflow control device coupled about a top barrel, according to an implementation.
Figure 46A:
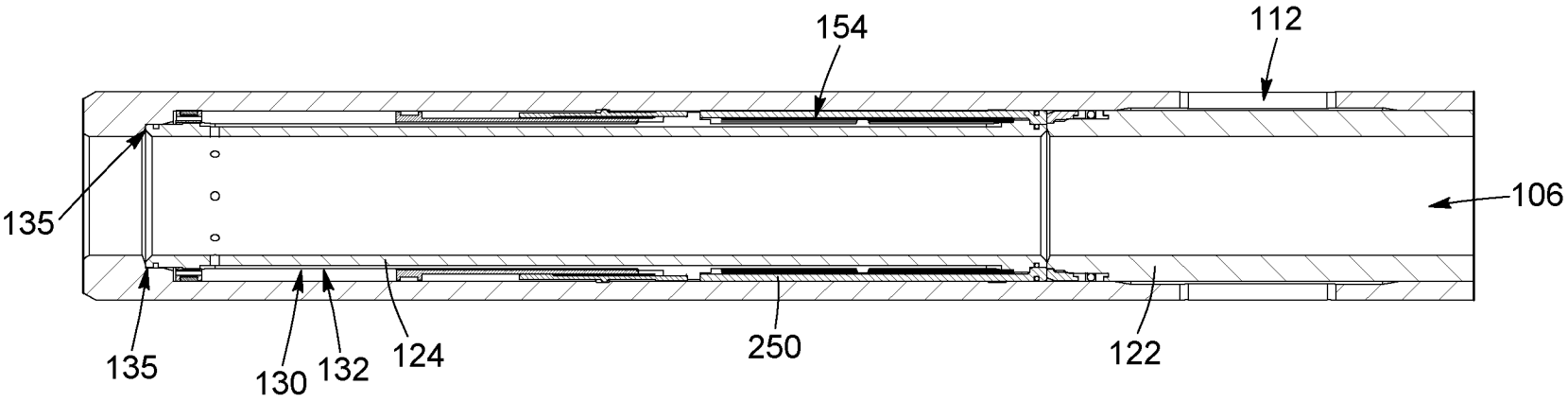
FIG. 46A is an enlarged view of a portion of the valve assembly shown in FIG. 46, showing the valve assembly in a closed configuration, according to a possible implementation.
Figure 47:
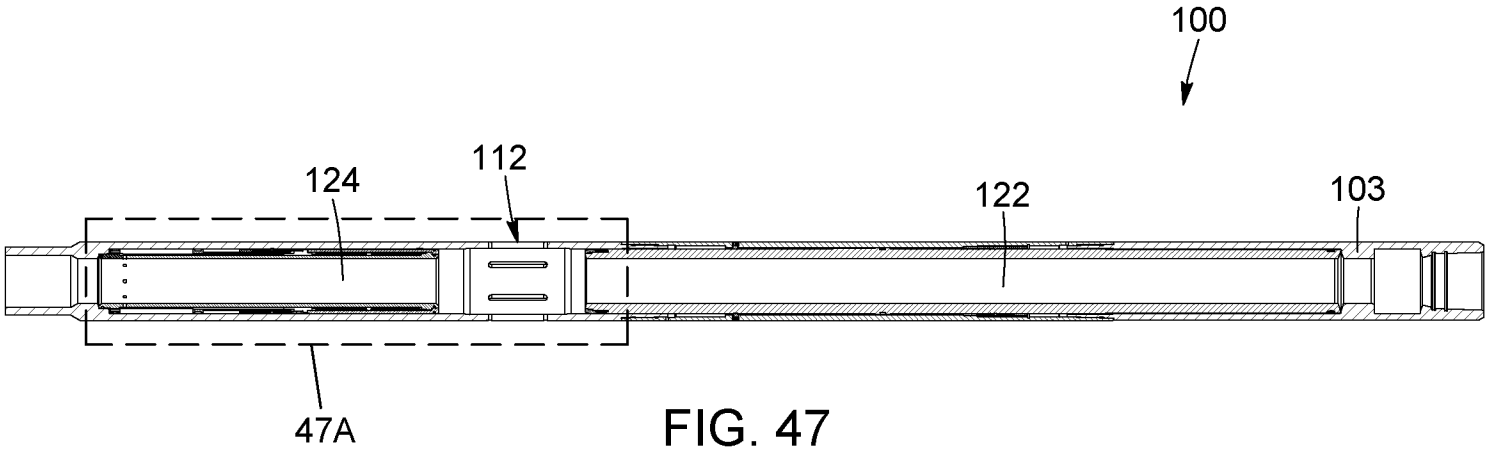
FIG. 47 is a cross-sectional view of the valve assembly shown in FIG. 46, showing the valve assembly in an open configuration, according to an implementation.
Figure 47A:
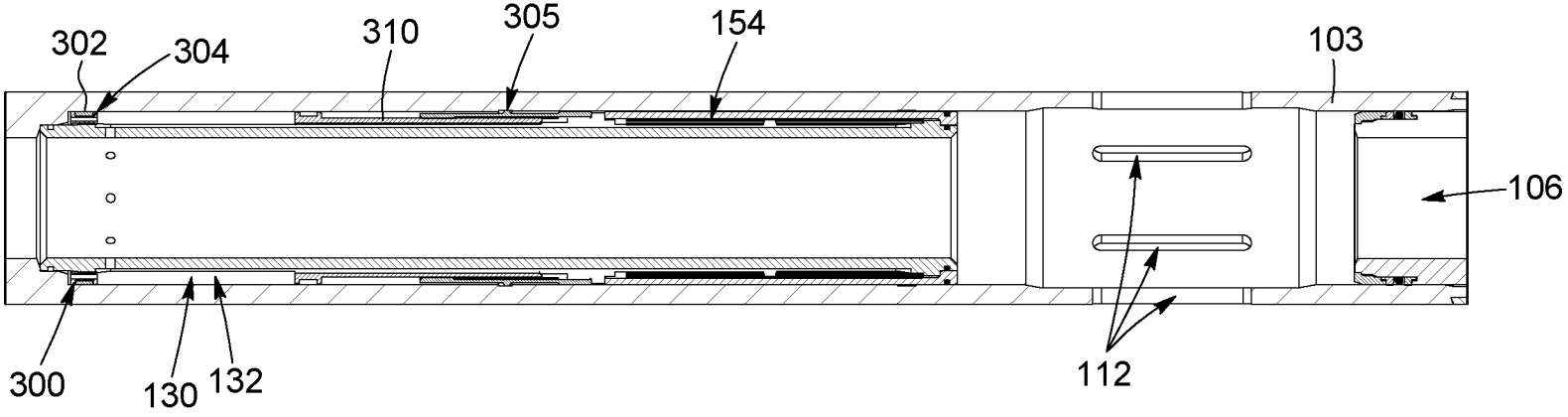
FIG. 47A is an enlarged view of a portion of the valve assembly shown in FIG. 47.
Figure 48:
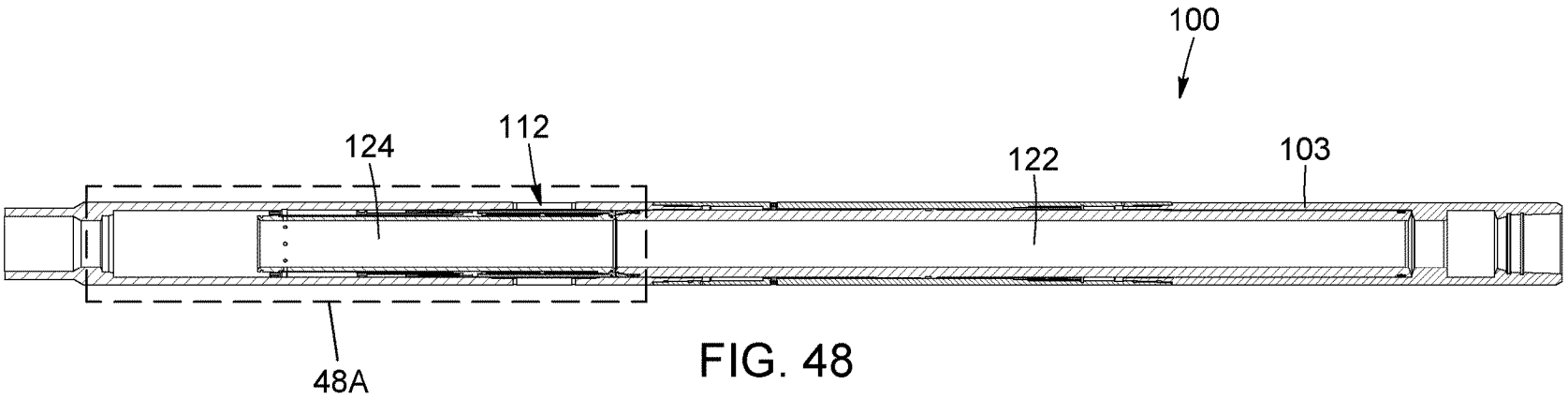
FIG. 48 is a cross-sectional view of the valve assembly shown in FIG. 46, showing the valve assembly in a flow-restricted configuration, according to an implementation.
Figure 48A:
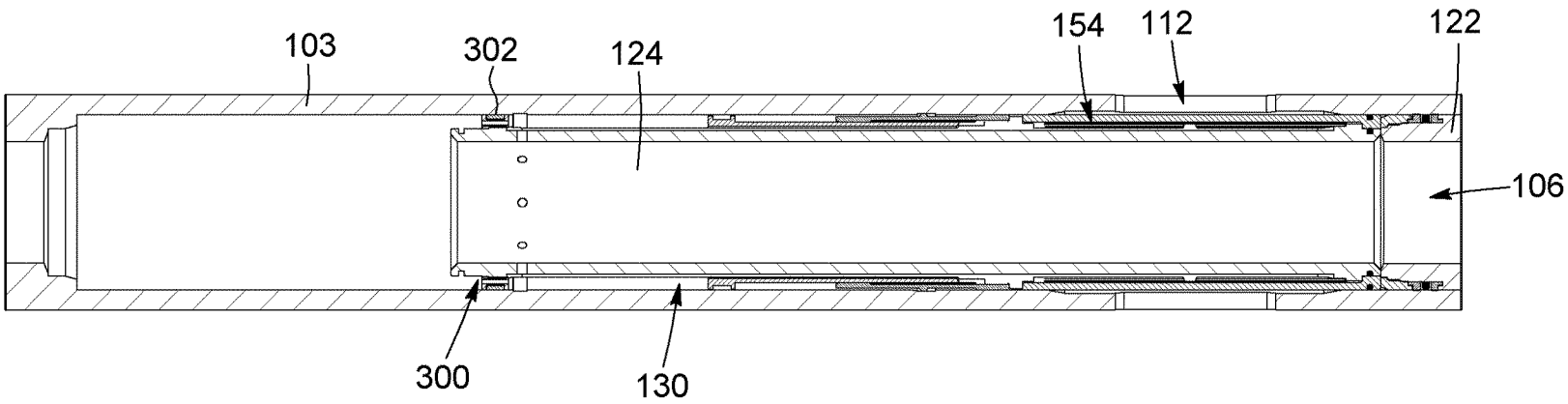
FIG. 48A is an enlarged view of a portion of the valve assembly shown in FIG. 48.

In FIGS. 46 and 46A, the valve assembly 100 is operated in the closed configuration, where the bottom sleeve 122 occludes the housing port 112 to prevent fluid communication between the central passage 106 and the reservoir. In a similar fashion to previously described implementations, the bottom sleeve can be shifted (e.g., in the downhole direction) to an open position (seen in FIG. 47) and enable operation of the valve assembly in the open configuration. Then, the top sleeve can be shifted downhole to operate the valve assembly in the screened configuration, where the screen 154 is aligned with the housing port 112 for enabling a screened production of reservoir fluids.

Similar to the implementation of FIG. 6A, the top sleeve 124 can be shaped and configured to sealingly engage the housing 102 at the downhole end thereof. As such, fluid flowing through the housing port 112 is substantially confined to flow through the annular chamber 132 and past the uphole end of the top sleeve 124 to reach the central passage 106. In this implementation, the flow control device further includes an ICD 300 (inflow control device) coupled about the top sleeve proximate the uphole end thereof. The ICD 300 can include a ring 302 disposed between the top sleeve and the housing and configured to restrict fluid flow therethrough. For example, the ring 302 can include a plurality of axial passages 304 extending therethrough. The top sleeve can be releasably connected to the housing via a latching mechanism (e.g., a collet 305) configured to engage annular grooves defined in the housing. In some implementations, the top sleeve further includes a collet shroud 310 installed in the annular region and configured to at least partially protect the collet 305 as production fluid flows along the annular chamber, for example.

Figure 49:
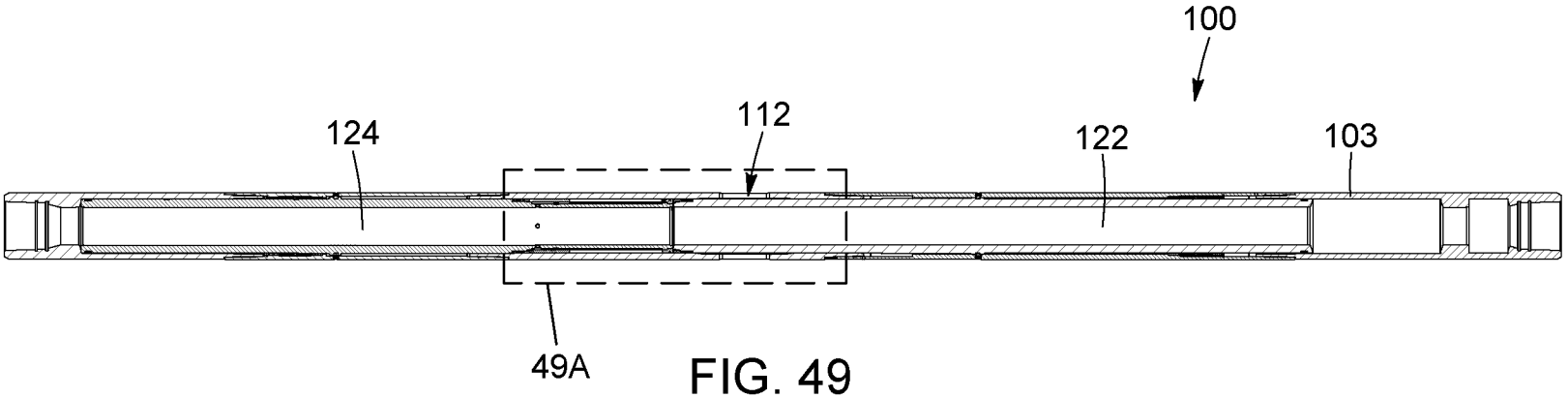
FIG. 49 is a cross-sectional view of an alternate implementation of the valve assembly, showing a dual-barrel valve assembly with an isolated flow control device coupled about a top barrel, according to an implementation.
Figure 49A:
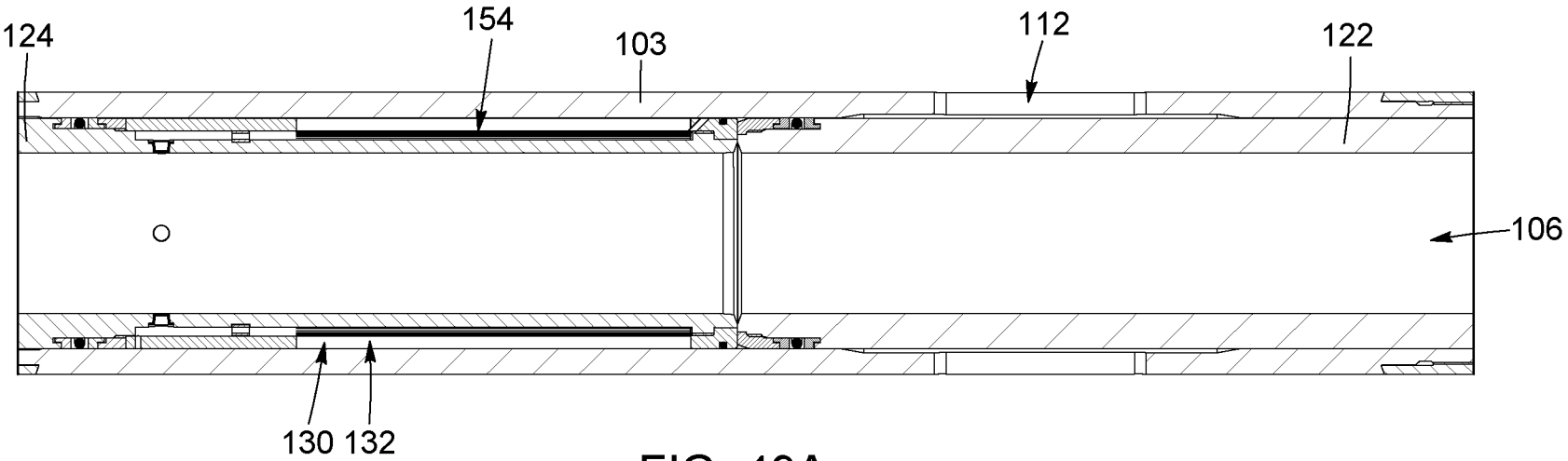
FIG. 49A is an enlarged view of a portion of the valve assembly shown in FIG. 49, showing the valve assembly in a closed configuration, according to a possible implementation.
Figure 50:
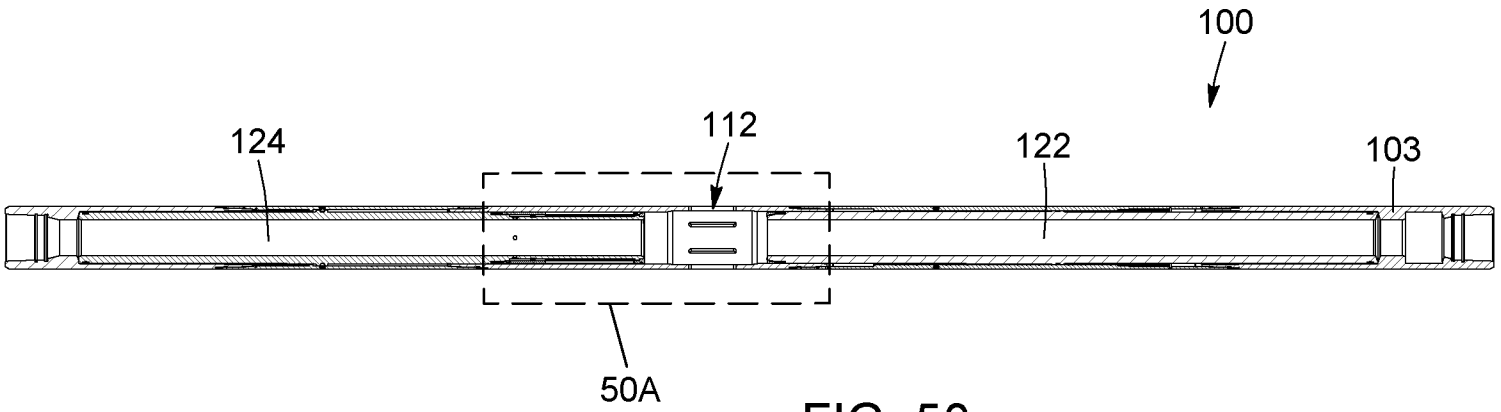
FIG. 50 is a cross-sectional view of the valve assembly shown in FIG. 49, showing the valve assembly in an open configuration, according to an implementation.
Figure 50A:
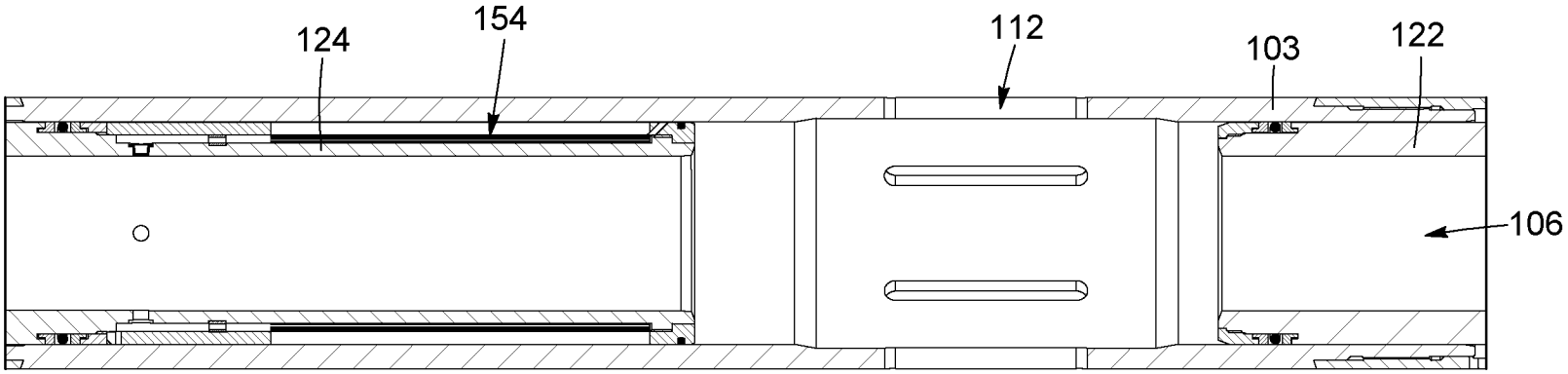
FIG. 50A is an enlarged view of a portion of the valve assembly shown in FIG. 50.
Figure 51:
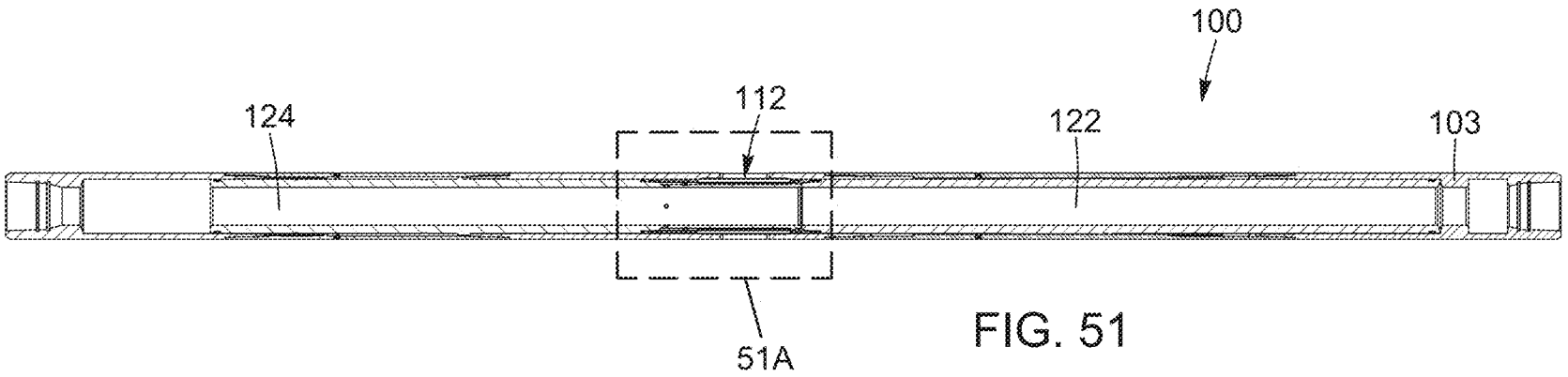
FIG. 51 is a cross-sectional view of the valve assembly shown in FIG. 49, showing the valve assembly in a flow-restricted configuration, according to an implementation.
Figure 51A:
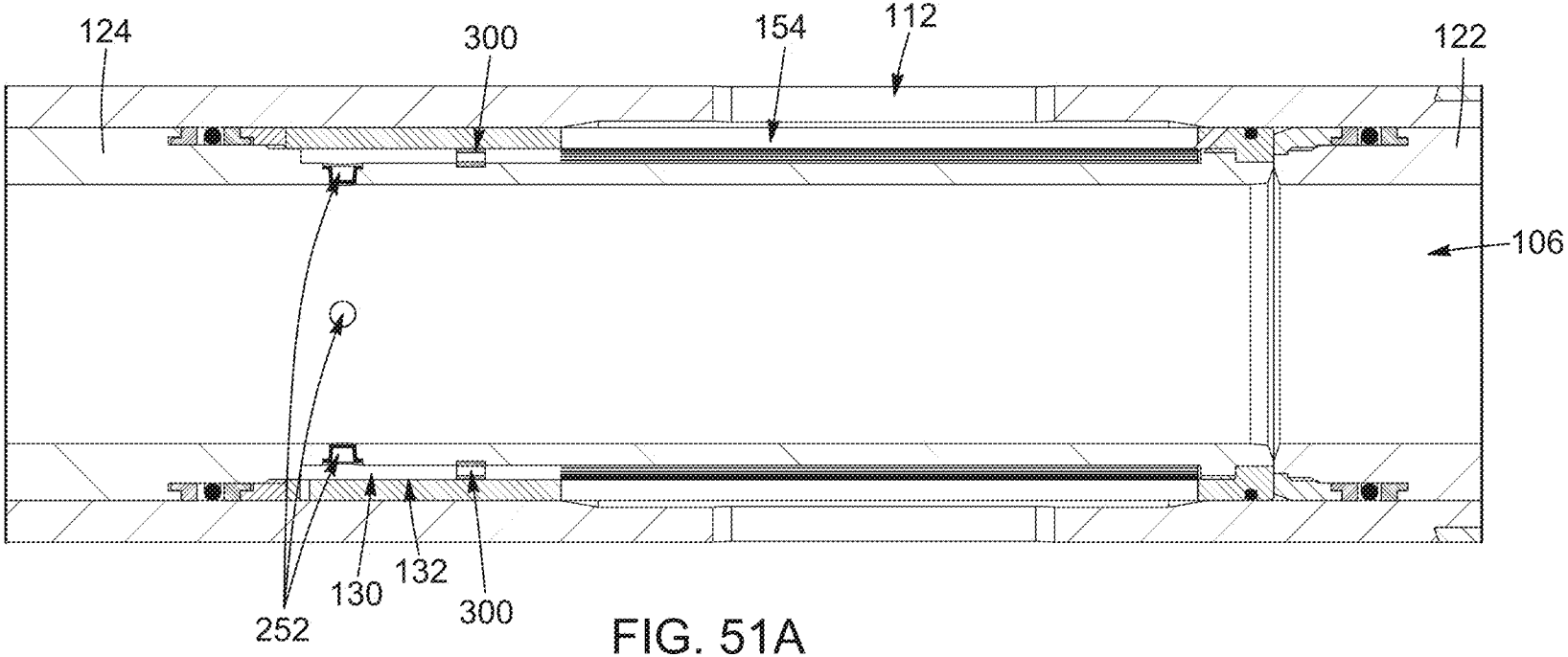
FIG. 51A is an enlarged view of a portion of the valve assembly shown in FIG. 51, showing an inflow control device coupled between the top barrel and the flow control device, according to an implementation.

The implementation of the valve assembly illustrated in FIGS. 49 to 51A is similar to the implementation of FIGS. 46 to 48A described above. From the closed configuration (FIGS. 49 and 49A), the bottom sleeve 124 is shifted downhole to operate the valve assembly in the open configuration (FIGS. 50 and 50A). Then, the top sleeve can be shifted downhole to align the screen 154, which is installed in the annular chamber, with the housing port 112. In this implementation, the uphole end of the top sleeve sealingly engages the tubular wall 103 such that production fluids are urged through the housing port 112, through the screen 154, along the annular chamber 132 and through the vents 252 to flow into the central passage 106. An ICD 300 can be installed along the annular region 130, such as within the annular chamber, such as between the screen 154 and the vents 252, for example.

Figure 52:
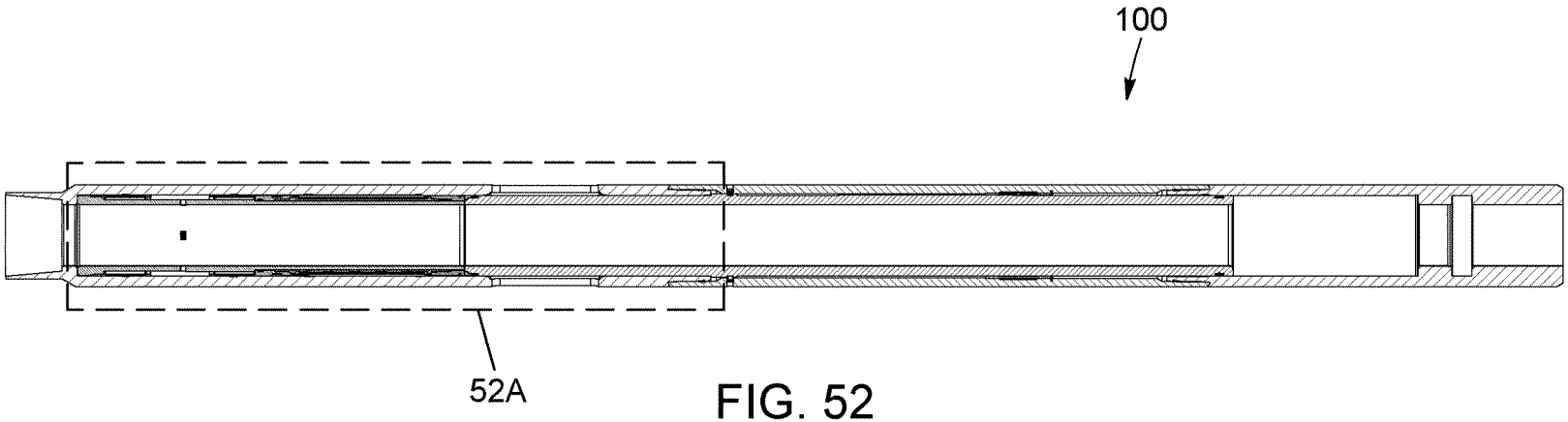
FIG. 52 is a cross-sectional view of an alternate implementation of the valve assembly, showing a dual-barrel valve assembly with a latching assembly for a top barrel and a screen, according to an implementation.
Figure 52A:
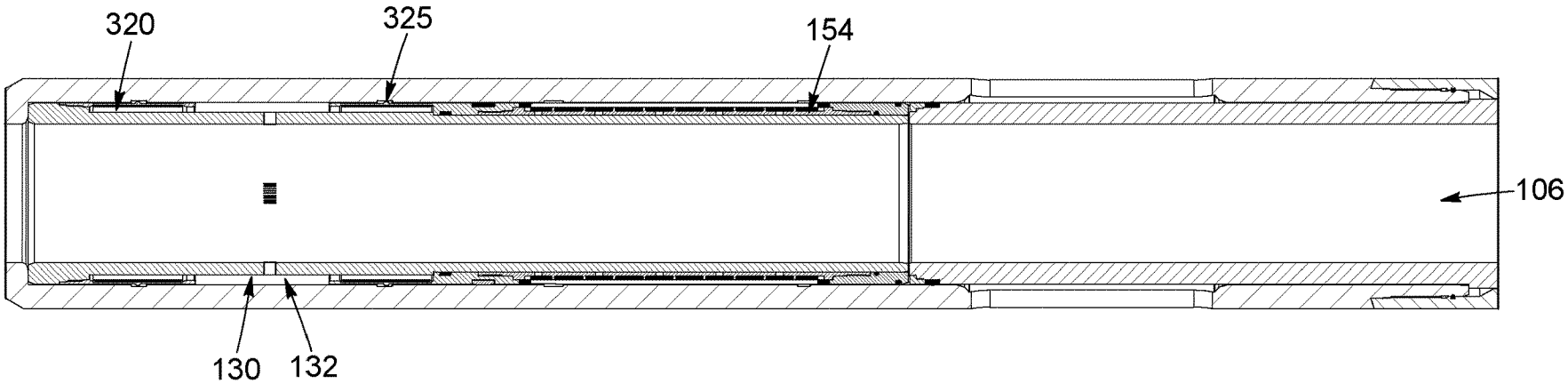
FIG. 52A is an enlarged view of a portion of the valve assembly shown in FIG. 52, showing the valve assembly in a closed configuration, according to a possible implementation.
Figure 53:
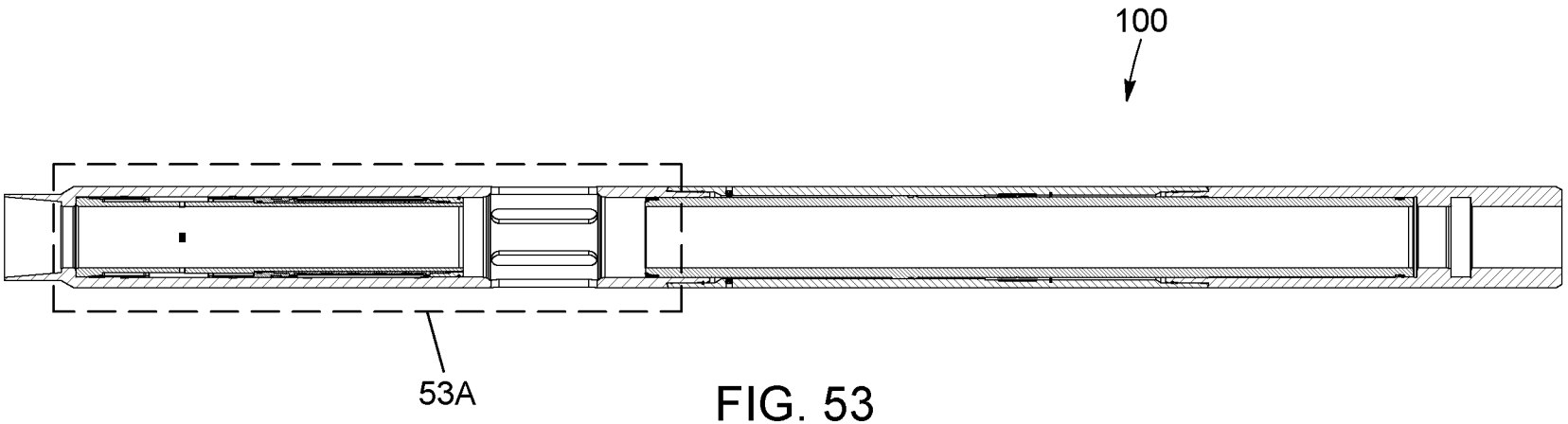
FIG. 53 is a cross-sectional view of the valve assembly shown in FIG. 52, showing the valve assembly in an open configuration, according to an implementation.
Figure 53A:
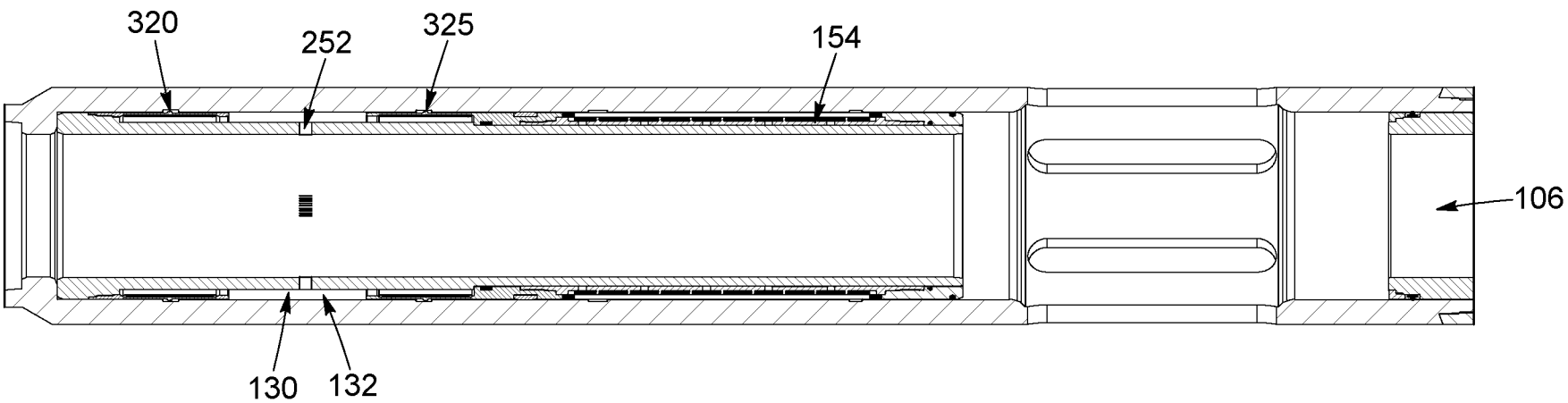
FIG. 53A is an enlarged view of a portion of the valve assembly shown in FIG. 53.
Figure 54:
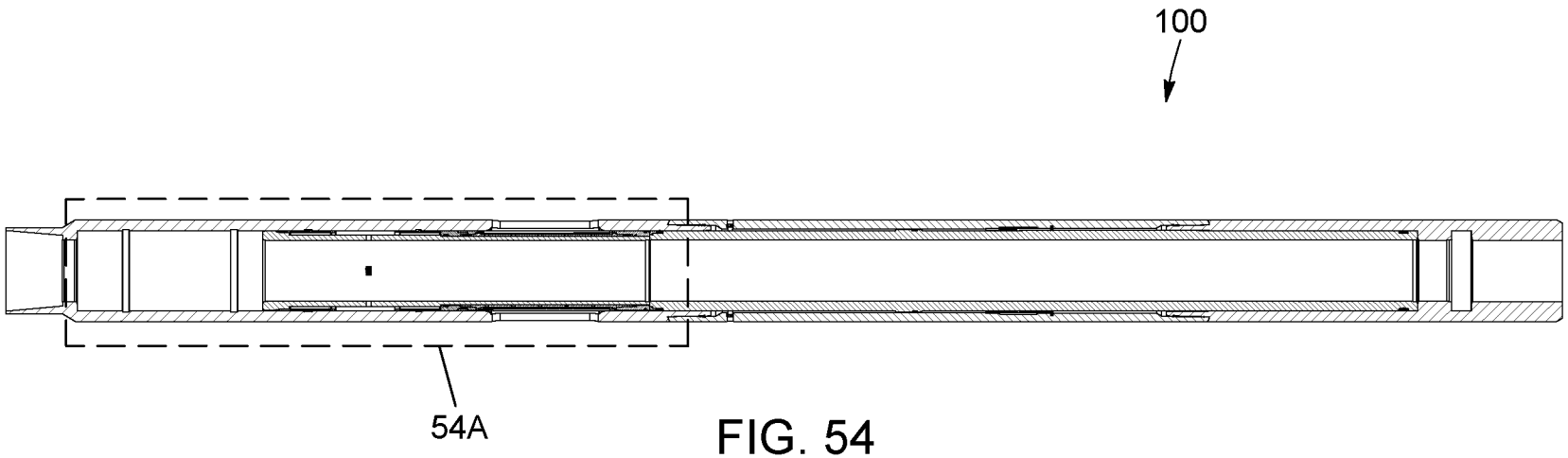
FIG. 54 is a cross-sectional view of the valve assembly shown in FIG. 52, showing the valve assembly in a flow-restricted configuration, according to an implementation.
Figure 54A:
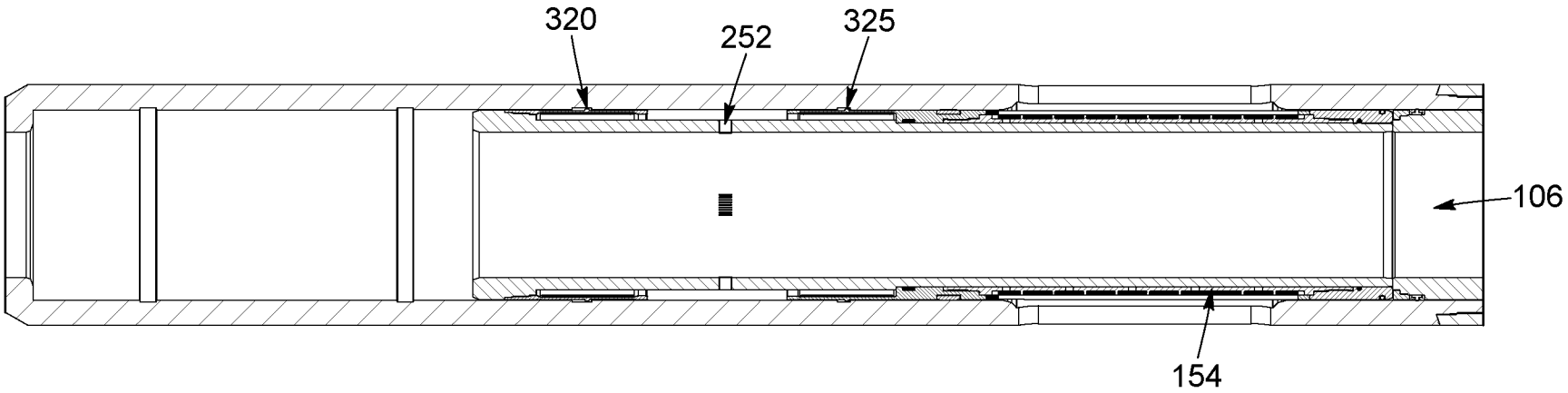
FIG. 54A is an enlarged view of a portion of the valve assembly shown in FIG. 54.
Figure 55:
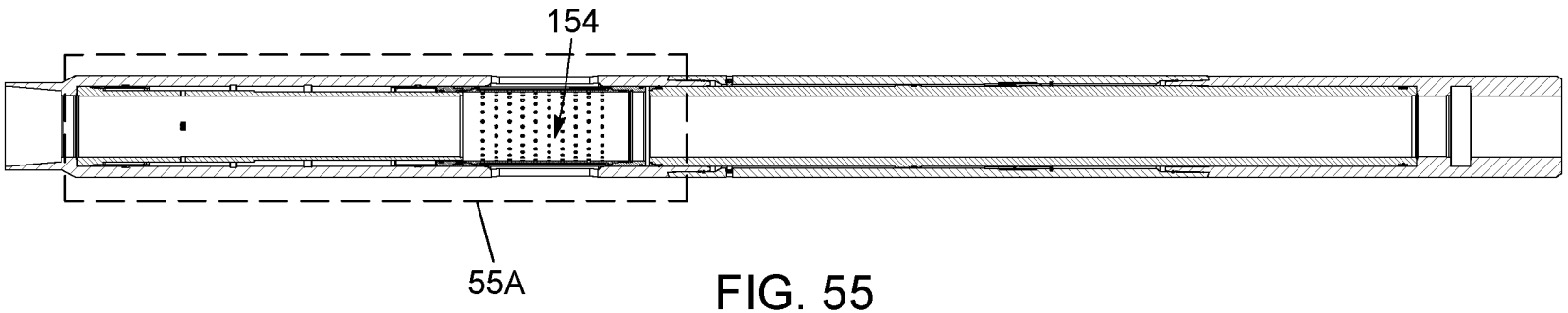
FIG. 55 is a cross-sectional view of the valve assembly shown in FIG. 52, showing the valve assembly in a screened configuration, according to an implementation.
Figure 55A:
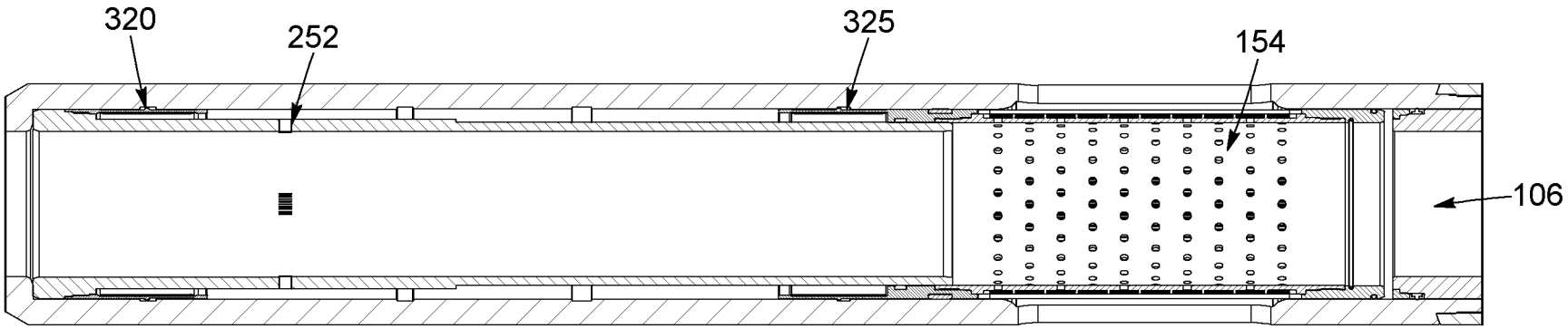
FIG. 55A is an enlarged view of a portion of the valve assembly shown in FIG. 55.

With reference to FIGS. 52 to 55A, another implementation of the valve assembly 100 is shown. In this implementation, the screen 154 is coupled to the top sleeve 124 and installed within the annular chamber 132. FIGS. 52 and 52A illustrate the valve assembly in the closed configuration. From there, the bottom sleeve 122 can be shifted downhole to open the housing port 112, thereby operating the valve assembly in the open configuration, as seen in FIGS. 53 and 53A. Then, the top sleeve can be shifted downhole to align the screen 154 with the housing port 112 (FIGS. 54 and 54A), and subsequently shifted back uphole, leaving the screen 154 in alignment with the housing port to operate the valve assembly in the screened configuration (FIGS. 55 and 55A). It is noted that, in this implementation, the screen 154 includes a plurality of radial openings. However, the screen can be provided with longitudinal slots (as described in relation with previous implementations), a combination of radial openings and longitudinal slots, or any other suitable configuration(s).

In this implementation, the top sleeve 124 includes a top sleeve latch 320 (e.g., a top sleeve collet) configured to releasingly engage the tubular wall 103 at predetermined locations. As such, the top sleeve can be coupled to the tubular wall in the run-in position (FIGS. 52, 53 and 55) and in the shifted position (FIG. 54). In addition, the screen 154 can be provided with a screen latch 325 (e.g., a screen collet) configured to releasingly engage the tubular wall 103 at predetermined locations. As such, the screen can be coupled to the tubular wall in the run-in position (FIGS. 52 and 53), and in an aligned position (FIGS. 54 and 55). The top sleeve can include a shoulder adapted to engage and push the screen when moving downhole. Therefore, shifting the top sleeve from the run-in position to the shifted position simultaneously moves the screen from the run-in position to the aligned position. However, the top sleeve is adapted to disengage the screen when moving uphole such that the top sleeve can be shifted back to the run-in position while leaving the screen in the aligned position.

Figure 56:
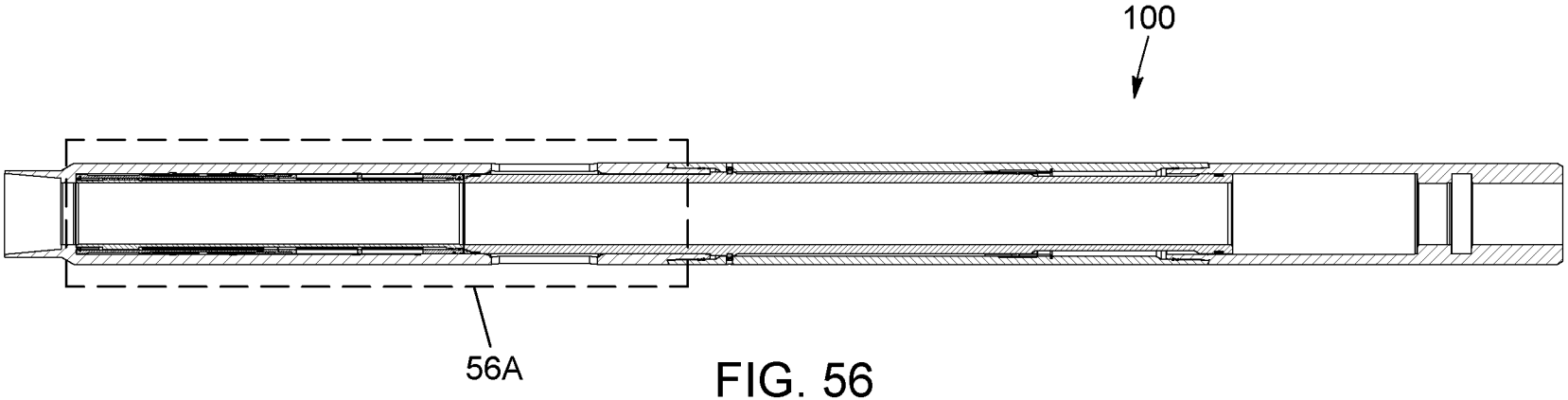
FIG. 56 is a cross-sectional view of an alternate implementation of the valve assembly, showing a dual-barrel valve assembly with a flow regulator, according to an implementation.
Figure 56A:
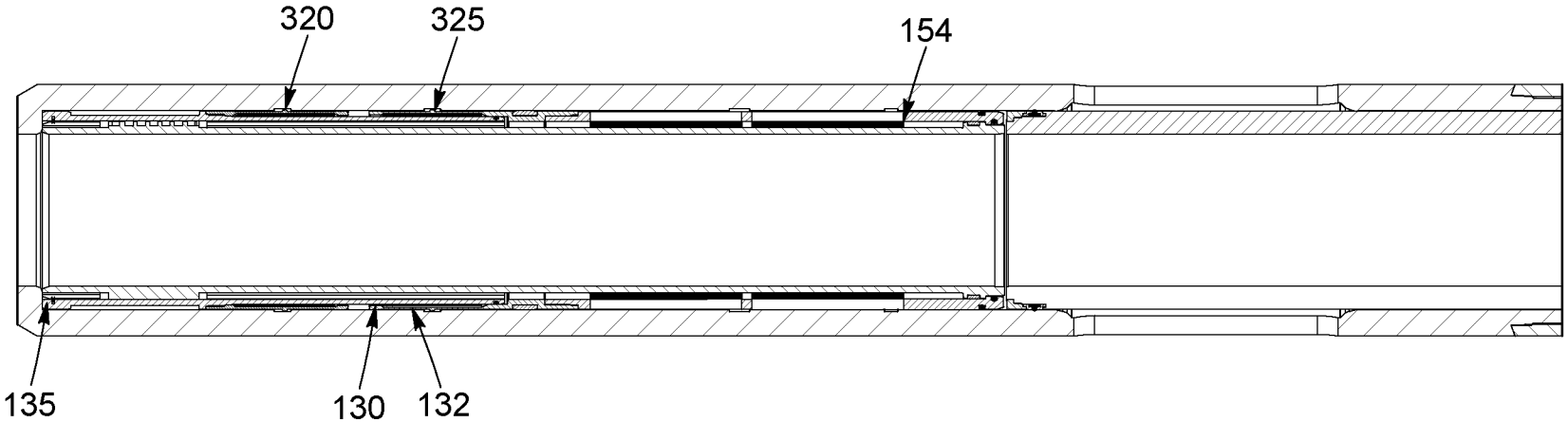
FIG. 56A is an enlarged view of a portion of the valve assembly shown in FIG. 56, showing the valve assembly in a closed configuration, according to a possible implementation.
Figure 57:
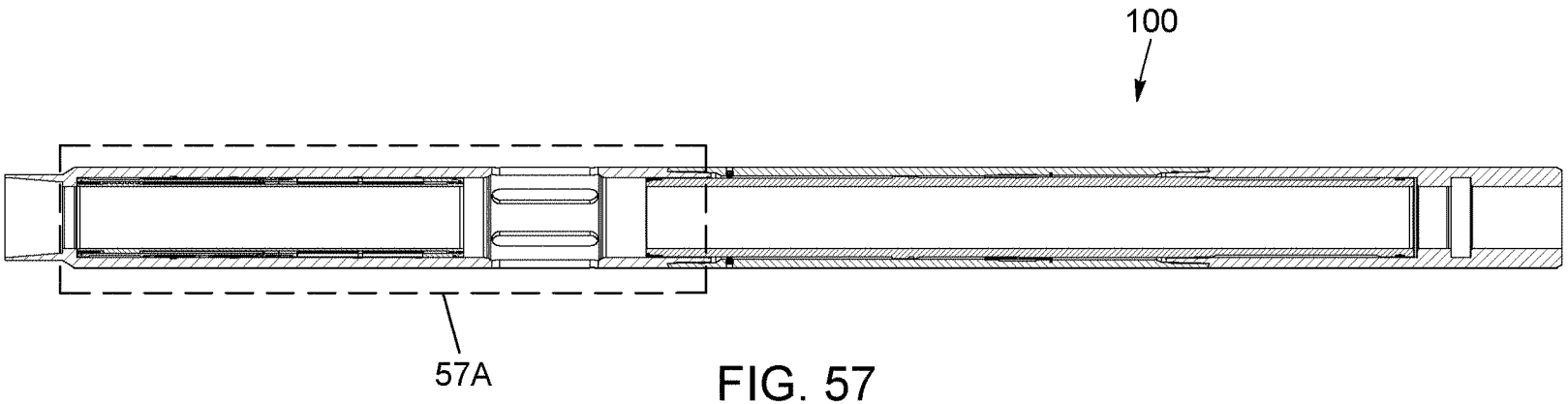
FIG. 57 is a cross-sectional view of the valve assembly shown in FIG. 56, showing the valve assembly in an open configuration, according to an implementation.
Figure 57A:
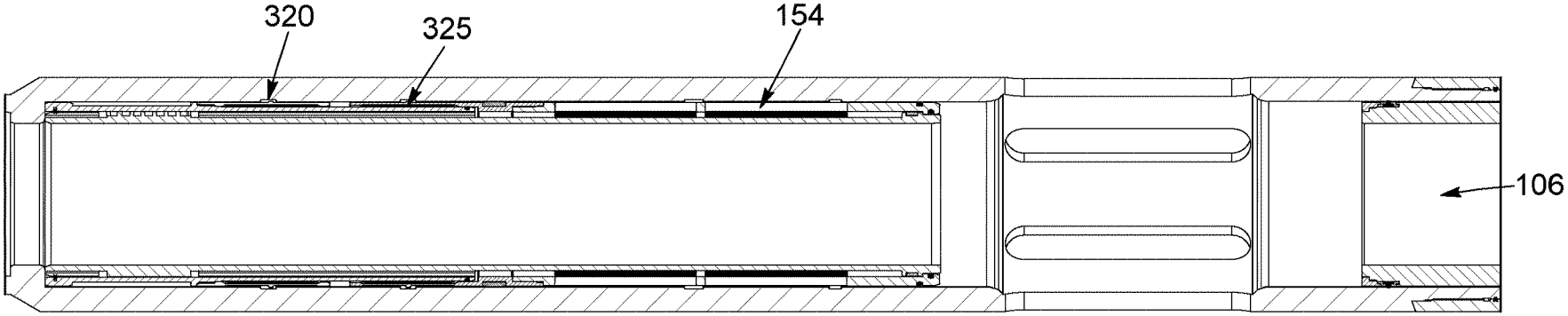
FIG. 57A is an enlarged view of a portion of the valve assembly shown in FIG. 57.
Figure 58:
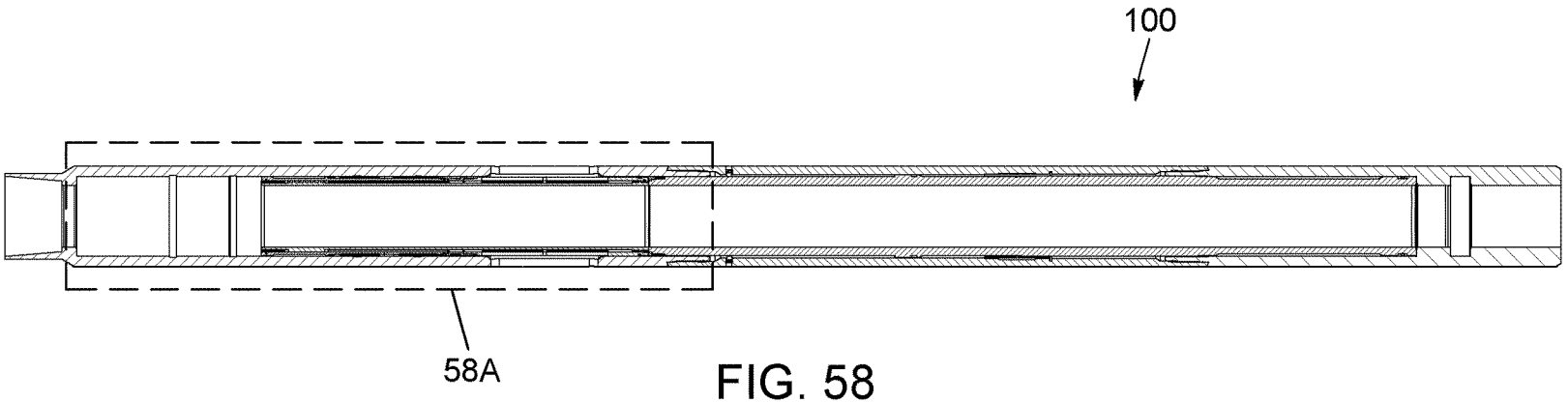
FIG. 58 is a cross-sectional view of the valve assembly shown in FIG. 56, showing the valve assembly in a flow-restricted configuration, according to an implementation.
Figure 58A:
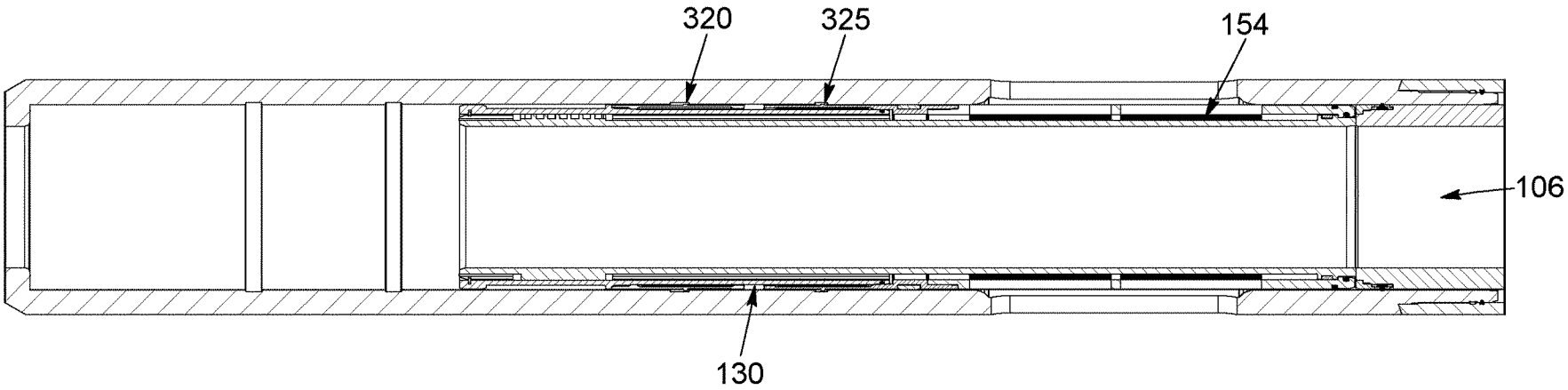
FIG. 58A is an enlarged view of a portion of the valve assembly shown in FIG. 58.
Figure 59:
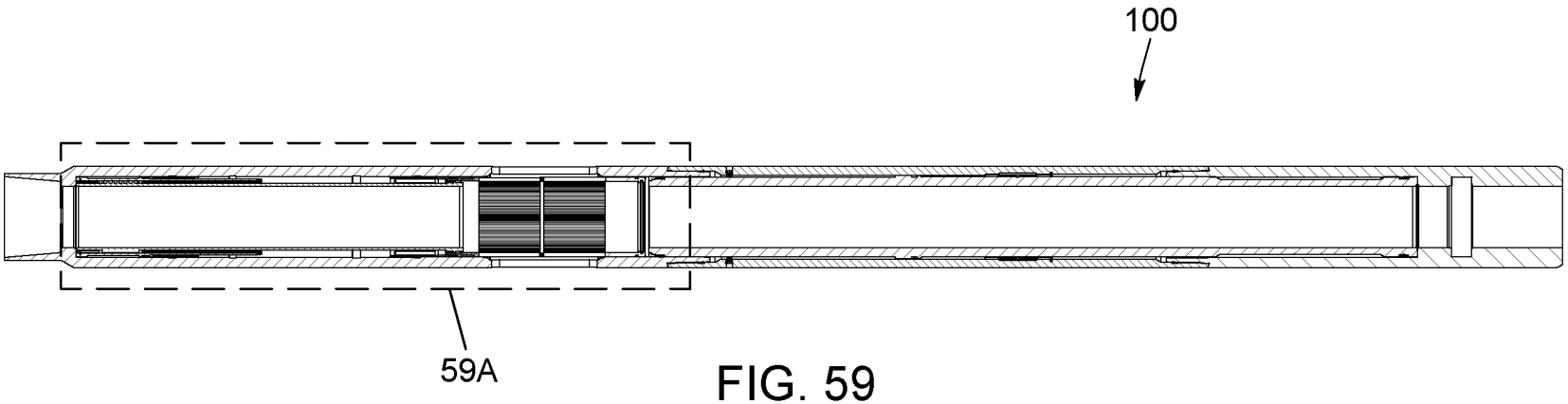
FIG. 59 is a cross-sectional view of the valve assembly shown in FIG. 56, showing the valve assembly in a screened configuration, according to an implementation.
Figure 59A:
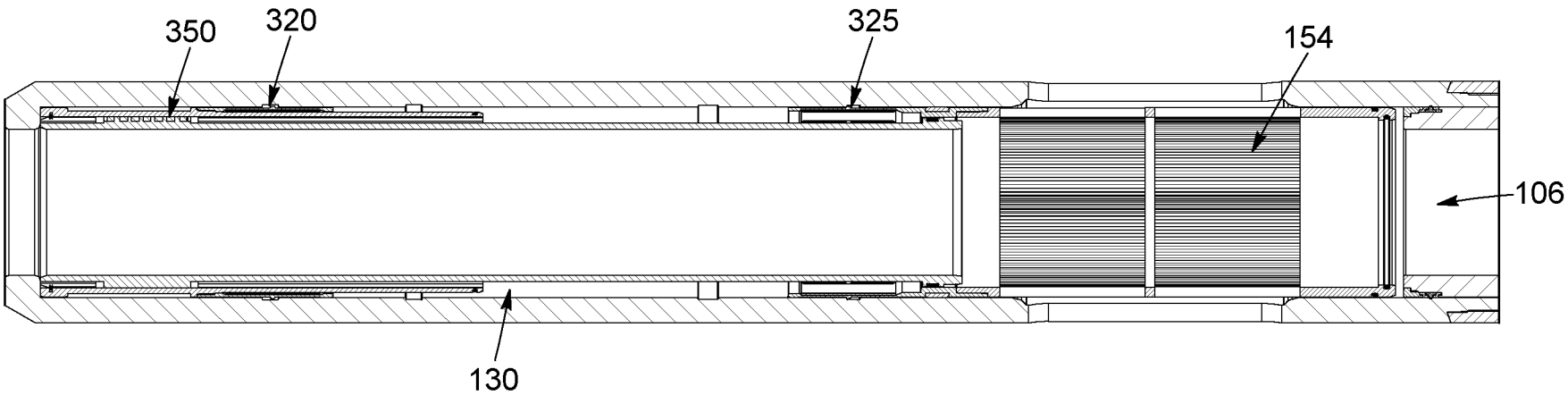
FIG. 59A is an enlarged view of a portion of the valve assembly shown in FIG. 59.

With reference to FIGS. 56 to 60, another implementation of the valve assembly 100 is shown. In this implementation, the screen 154 is coupled to the top sleeve 124 and installed within the annular chamber 132. FIGS. 56 and 56A illustrate the valve assembly in the closed configuration. From there, the bottom sleeve 122 can be shifted downhole to open the housing port 112, thereby operating the valve assembly in the open configuration, as seen in FIGS. 57 and 57A. Then, the top sleeve can be shifted downhole to align the screen 154 with the housing port 112 (FIGS. 58 and 58A) to operate the valve assembly in the flow-restricted configuration, and subsequently shifted back uphole, leaving the screen 154 in alignment with the housing port to operate the valve assembly in the screened configuration (FIGS. 59 and 59A). It should be noted that, in the flow-restricted configuration, production fluids are constrained or limited to flowing along the annular region prior to flowing into the central passage, whereas in the screened configuration, production fluids can flow from the reservoir to the central passage almost directly.

In this implementation, the top sleeve 124 includes a top sleeve latch 320 (e.g., a top sleeve collet) configured to releasingly engage the tubular wall 103 at predetermined locations. As such, the top sleeve can be coupled to the tubular wall in the run-in position (FIGS. 56, 57 and 59) and in the shifted position (FIG. 58). In addition, the screen 154 can be provided with a screen latch 325 (e.g., a screen collet) configured to releasingly engage the tubular wall 103 at predetermined locations. As such, the screen can be coupled to the tubular wall in the run-in position (FIGS. 56 and 57), and in an aligned position (FIGS. 58 and 59). The top sleeve can include a shoulder adapted to engage and push the screen when moving downhole. Therefore, shifting the top sleeve from the run-in position to the shifted position simultaneously moves the screen from the run-on position to the aligned position. However, the top sleeve is adapted to disengage the screen when moving uphole such that the top sleeve can be shifted back to the run-in position while leaving the screen in the aligned position.

Figure 60:
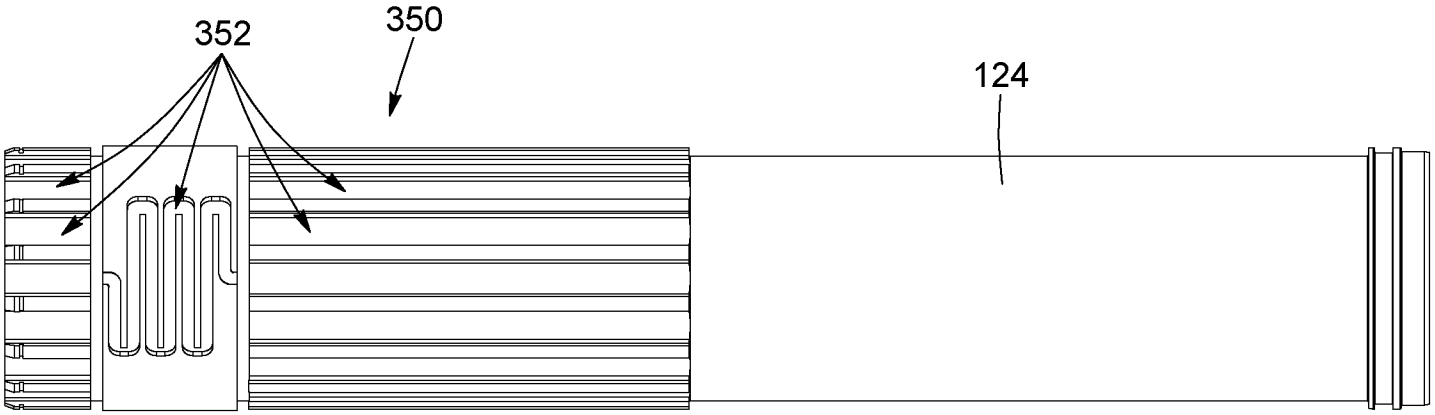
FIG. 60 is a side view of the flow regulator, showing a plurality of grooves defined along a tubular body, according to an implementation.
Figure 61:
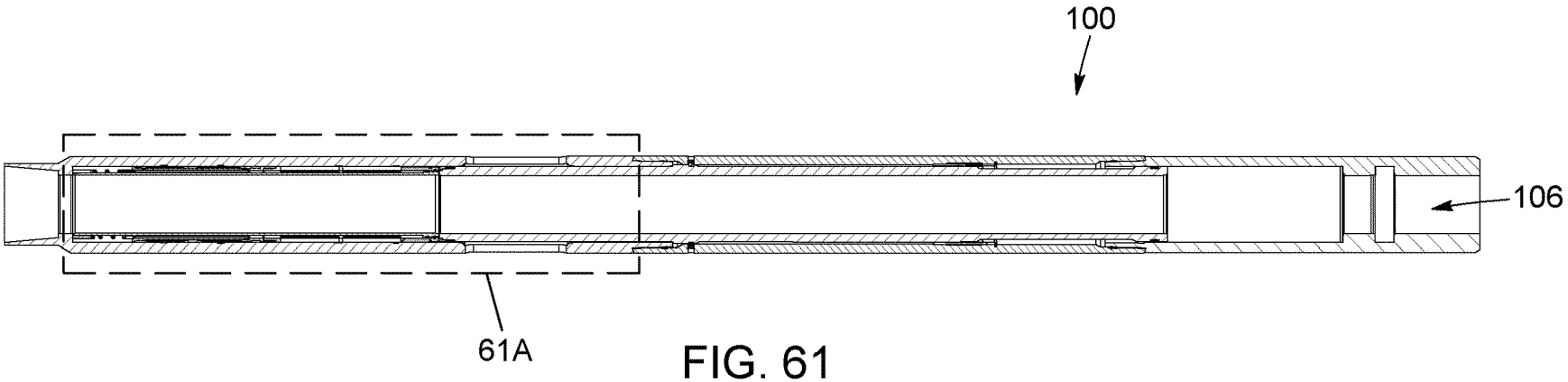
FIG. 61 is a cross-sectional view of an alternate implementation of the valve assembly, showing a dual-barrel valve assembly with a check valve, according to an implementation.
Figure 61A:
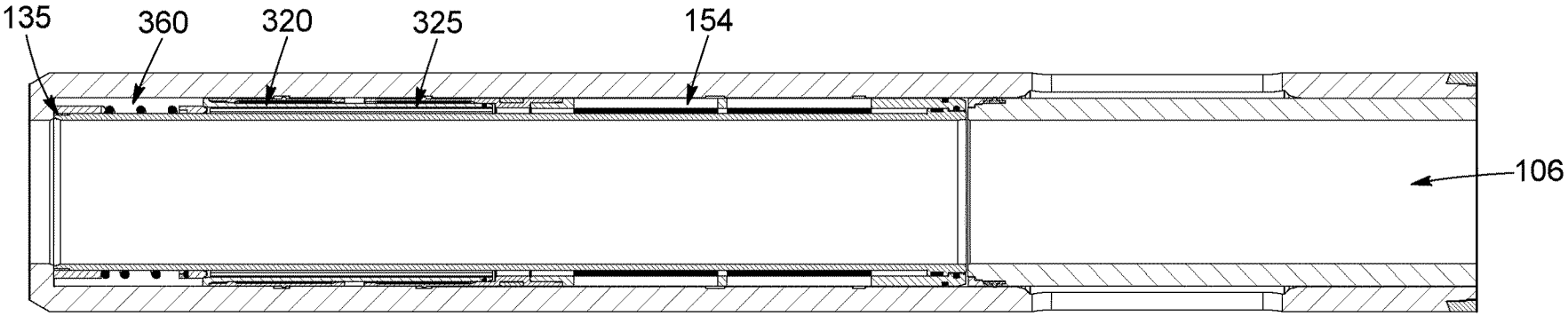
FIG. 61A is an enlarged view of a portion of the valve assembly shown in FIG. 61, showing the valve assembly in a closed configuration, according to a possible implementation.
Figure 62:
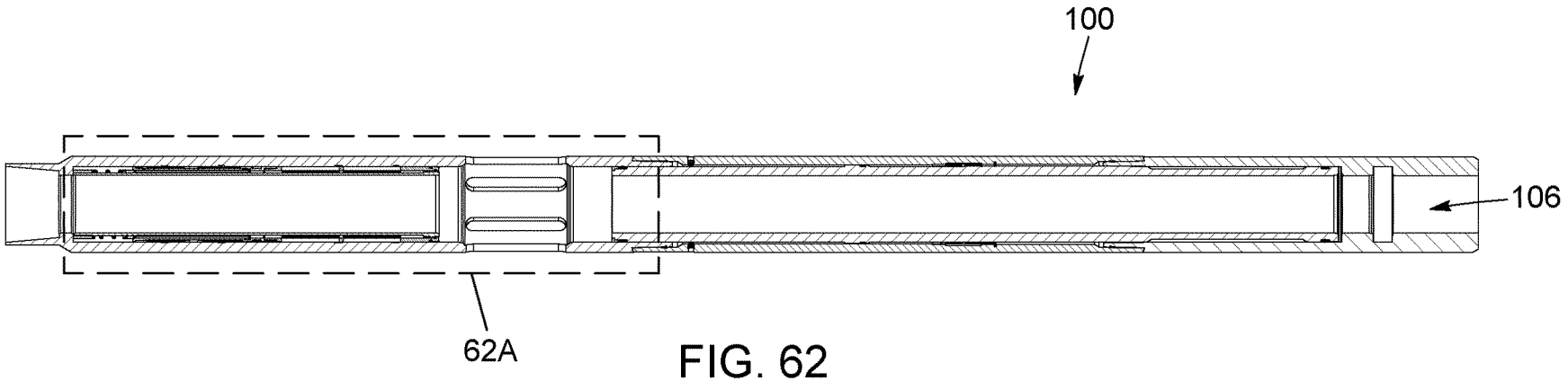
FIG. 62 is a cross-sectional view of the valve assembly shown in FIG. 61, showing the valve assembly in an open configuration, according to an implementation.
Figure 62A:
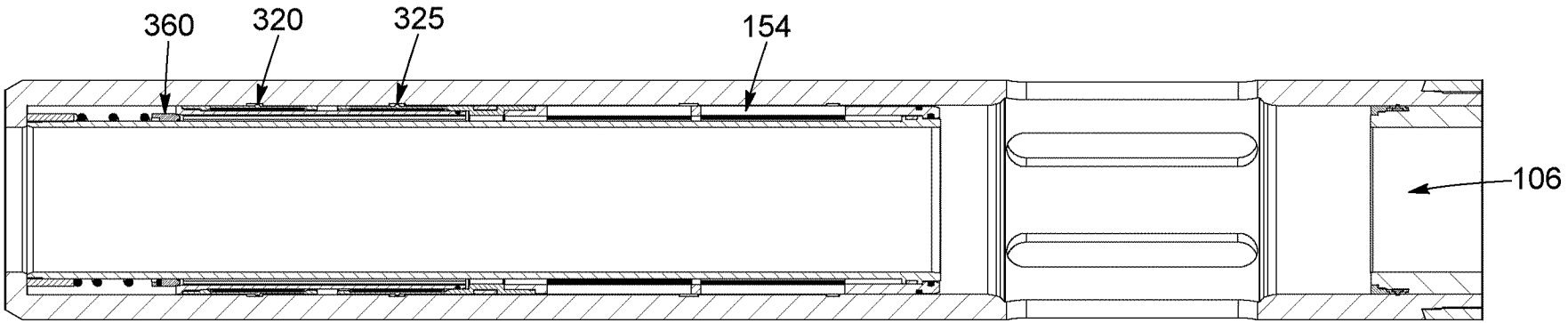
FIG. 62A is an enlarged view of a portion of the valve assembly shown in FIG. 62.
Figure 63:
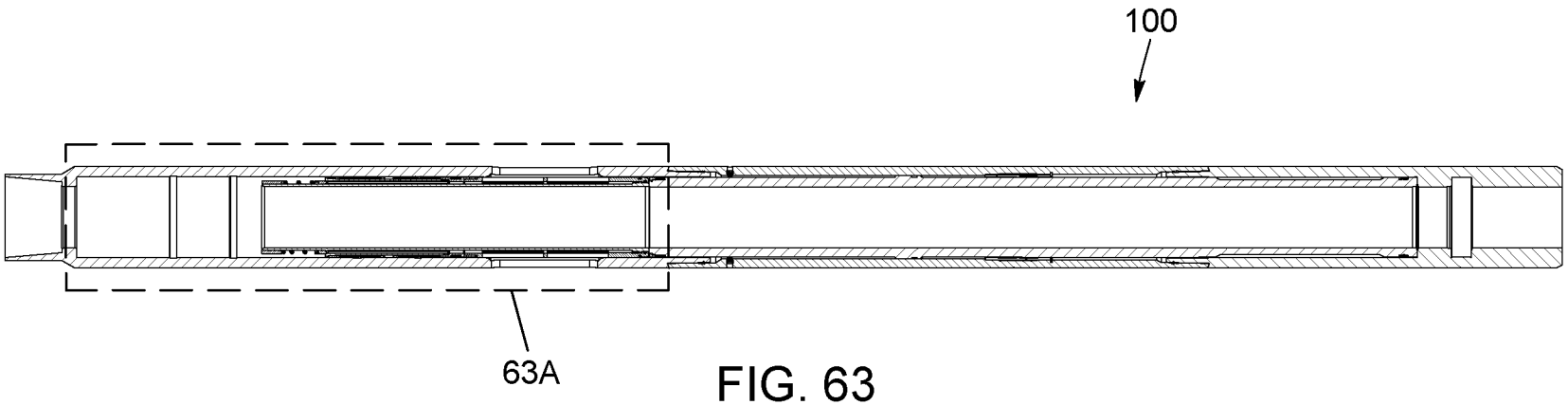
FIG. 63 is a cross-sectional view of the valve assembly shown in FIG. 61, showing the valve assembly in a flow-restricted configuration, according to an implementation.
Figure 63A:
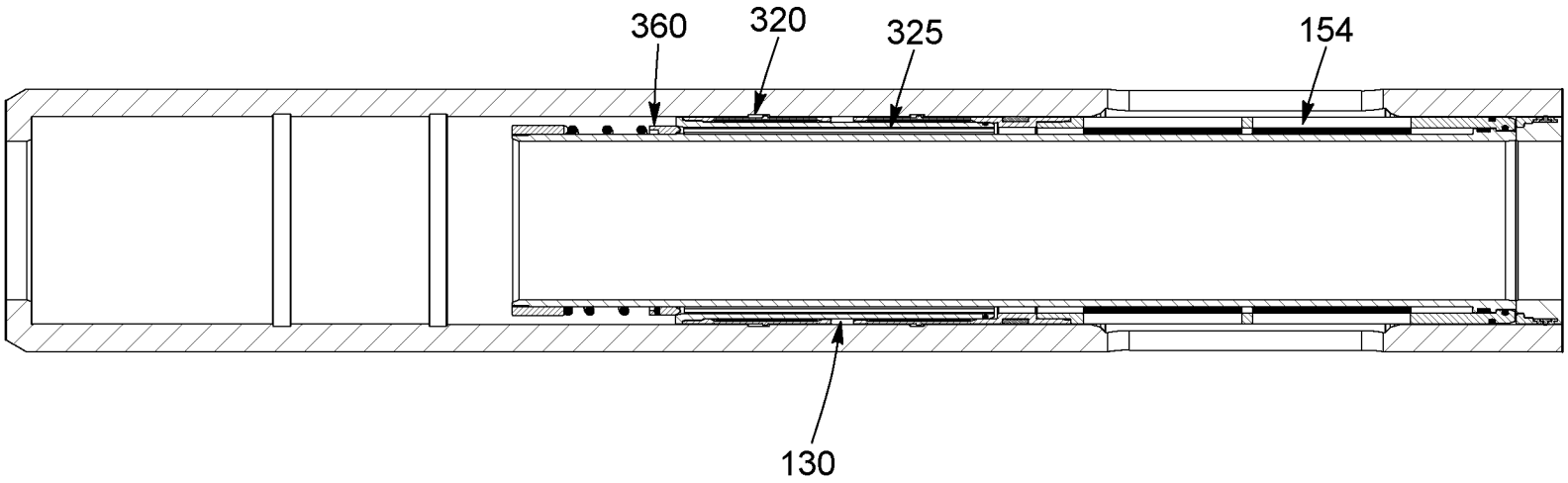
FIG. 63A is an enlarged view of a portion of the valve assembly shown in FIG. 63.

Moreover, the valve assembly 100 can include a flow regulator 350 provided along the annular region 130 adapted to at least partially control the fluid flowrate through the annular region when operating the valve assembly in the flow-restricted configuration. As seen in FIG. 60, the flow regulator 350 can be defined along the outer surface of the top sleeve and can include a plurality of grooves 352 cooperating with one another to restrict fluid flow through the regulator. In this implementation, the flow regulator 350 forms part of the top sleeve (e.g., the grooves are machined into a thickness of the top sleeve) and sealingly engages the inner surface of the valve housing. As such, the tubular wall of the housing overlays the grooves, restricting fluid flow along the various groove configurations. In this implementation, the grooves 352 include a combination of axial grooves and arcuate grooves adapted to regulate and/or restrict fluid flow from one side of the flow regulator to the other.

Figure 64:
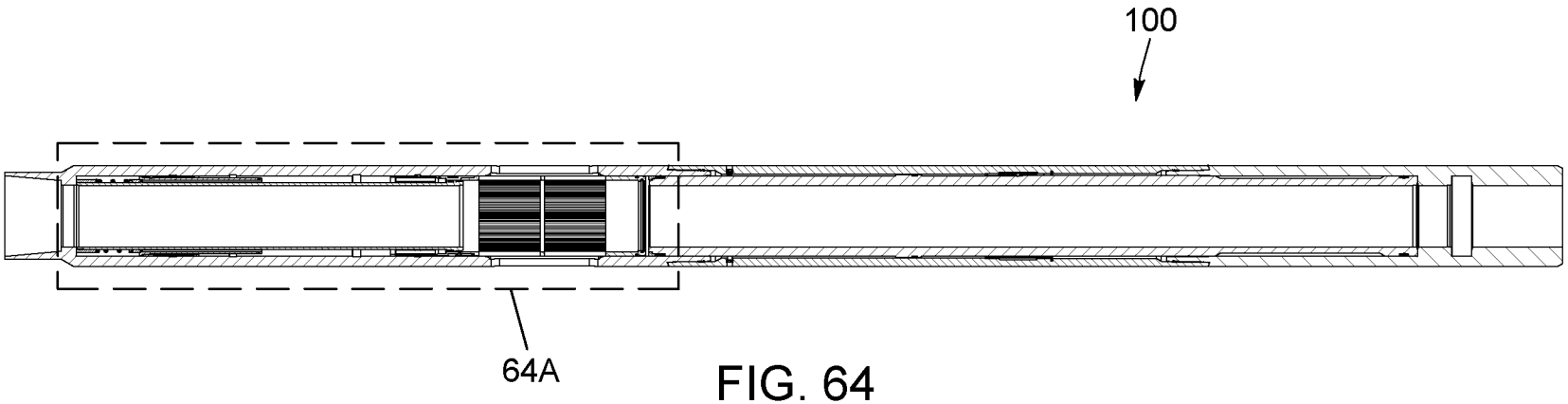
FIG. 64 is a cross-sectional view of the valve assembly shown in FIG. 61, showing the valve assembly in a screened configuration, according to an implementation.
Figure 64A:
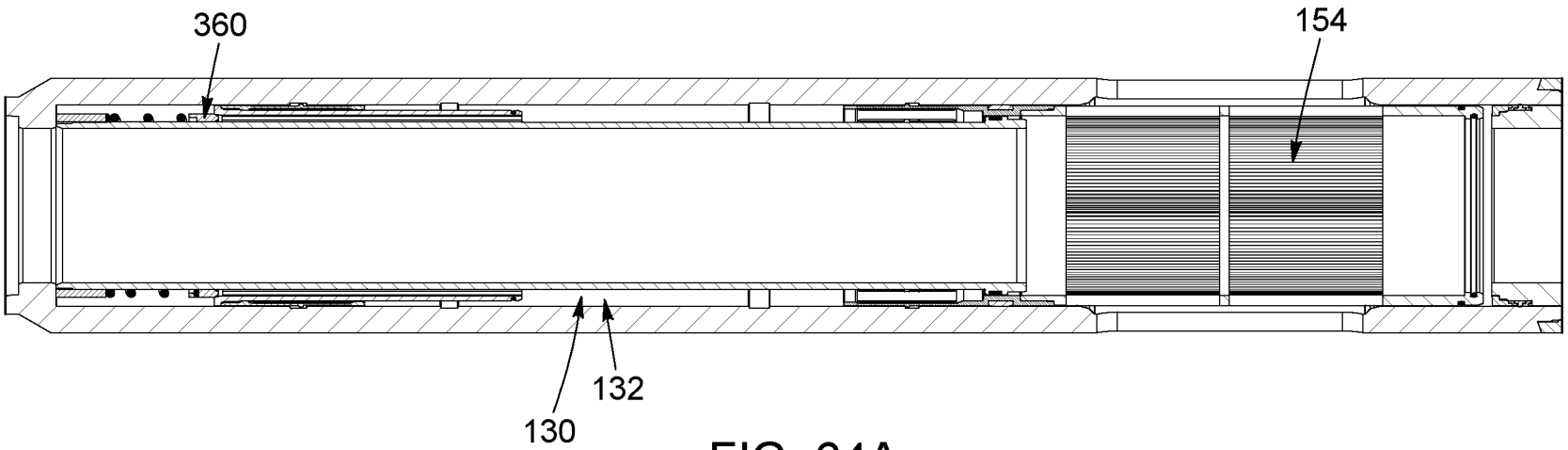
FIG. 64A is an enlarged view of a portion of the valve assembly shown in FIG. 64.

Now referring to FIGS. 61 to 64A, this implementation of the valve assembly 100 operates in a similar or corresponding manner as the implementation of FIGS. 56 to 60. More particularly, the valve assembly is operable in a closed configuration (FIG. 61), an open configuration (FIG. 62), a flow-restricted configuration (FIG. 63) and a screened configuration (FIG. 64). However, instead of the flow regulator 350, the top sleeve is provided with a check valve 360 installed within the annular region proximate a top end of the top sleeve for controlling the fluid flow along the annular region.

It is appreciated that the implementations of FIGS. 27 to 64A provides various implementations of a valve assembly which includes a flow control device which can be isolated within an annular region and/or an annular chamber that can be pressurized to prevent cement from damaging the flow-controlling sleeve and its components (e.g., the flow control device, the latching mechanism 165, etc.). The annular region and the annular chamber can be pressurized via fluid flowing therein via interstices 135 defined between two or more components of the valve assembly, or via vents 252 defined through the top sleeve, for example. Moreover, the flow control device of various implementations enables reservoir fluid to flow from the reservoir into the central passage. It is appreciated that the production flowpath does not necessarily include an annular flow area, which can reduce the overall production flowrates (e.g., when compared to the production flowrates through the volume of the central passage 106). Moreover, the described implementations can be configured to enable selectively switching between the various operational configurations. In other words, and for example, the valve assembly can be actuated between the open, closed and/or screened configurations, among others, as desired, and as described above.

It should also be noted that the implementations of FIGS. 27 to 64A can be run downhole (e.g., installed within the wellbore) with the sleeve assembly (e.g., the top and bottom sleeves) in a run-in position. The sleeves can be releasably secured to the valve housing in order to prevent accidental or undesired movement of the sleeves prior to the valve assemblies being in the desired location and/or configuration along the wellbore. For example, the sleeves can be pinned to the valve housing using shear pins, or via any other suitable fastening method or component which can be subsequently disengaged, disconnected, broken, etc.

It should be appreciated from the present disclosure that the various implementations of the valve assembly and related components enable providing a cementable valve assembly with a dead-ended chamber for housing a flow control device. The valve assembly can be cemented down the wellbore along with the wellbore string it is integrated with, where fluid communication with the dead-ended chamber is not blocked, but restricted, such that fluid within the wellbore (e.g., water, brine, drilling mud, etc.) can flow therein and pressurize the dead-ended chamber. Therefore, subsequent fluids or materials being pumped down the wellbore string (e.g., cementitious material) are prevented from entering the chamber. Once cemented in place, the valve assembly can be operated in various operational configurations, including a flow-restricted configuration, where the dead-ended chamber is integrated as part of the fluid pathway for production fluid, and where the flow control device is open to fluid flow from the reservoir to control the production fluid flow. It is appreciated that the flow control device comes "pre-packaged" with the valve assembly (e.g., within the annular region), and is thus not required to be run downhole as part of a separate tubing string to enable control of a flow of production fluid.

It should also be noted that, as previously mentioned, the annular chamber is initially pressurized via an ingress of wellbore fluids prior to cementing the wellbore string. The fluid which initially flows into the annular chamber can be residual fluid from drilling out the wellbore (e.g., brine, water, drilling mud, etc.). Therefore, it should be understood that, if the well is generally dry, an initial amount of fluid can be pumped downhole to pressurize the chamber (or be used as redundancy to make sure that the chamber is pressurized) before pumping cement downhole to secure the wellbore string. In some implementations, the annular region of the valve assembly can additionally be prepacked with fluid or a slurry material, such as grease, prior to running the valve assembly downhole. Having a prepacked annular region can help deter additional fluids from flowing therein. However, the annular region remains in fluid communication with the central passage such that initial wellbore fluid are still allowed to flow therein and pressurize the chamber, if need be, to prevent an inflow of cement into the annular region.

The present disclosure may be embodied in other specific forms without departing from the subject matter of the claims. The described example implementations are to be considered in all respects as being only illustrative and not restrictive. For example, in the implementations described herein, the flow control device includes both the check valve and the screen. However, it is appreciated that an implementation of the valve assembly can include only the screen or only the check valve. In implementations including only the screen, it is appreciated that defining an annular flowpath is not required since the screened production fluid can be made to flow directly into the central passage of the valve assembly.

In addition, in the above-described implementations, the annular region and annular chamber were defined about substantially the entire circumference of the top sleeve (e.g., 360 degrees around the top sleeve). However, it should be understood that the annular region and corresponding annular chamber can be defined as one or more independent sections dispersed around the top sleeve. In such implementations, the annular sections can extend by any suitable angle around the top sleeve, such as about 20, 30, 45, 60, 90 or 180 degrees, for example. The annular region can alternatively be defined as multiple flow channels, similar to the through channels of the ring portion, where individual channels are defined along generally the entire length of the top sleeve, with each channel being provided with its own flow control device.

Figure 65:
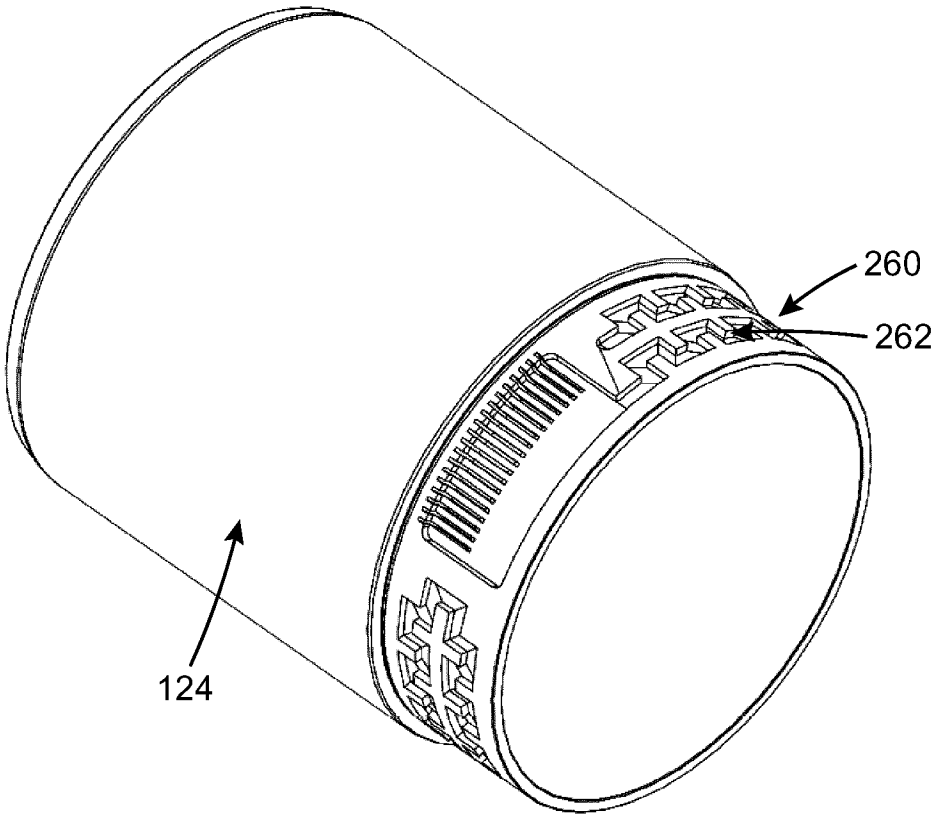
FIG. 65 is a perspective view of a valve sleeve provided with a flow restriction component in the form of a tortuous channel, according to an implementation.

Referring to FIG. 65, in some implementations, the flow control device can alternatively, or additionally, include a flow restriction component 260 that can take the form of a fluid channel 262 that can be a tortuous path that winds (e.g., boustrophedonically) across a portion of the top sleeve (e.g., defined in an outer surface of the ring portion). Shifting the top sleeve can align the fluid channel with the housing port for enabling fluid communication therewith. Once the sleeve is mounted within a valve housing, the fluid channel 262 is alignable with the housing port. This sleeve facilitates providing variable flow restriction for different valves using the same component designs. It may be desirable to provide different valves along a well with different levels of flow restriction. In some implementations, a flow control device, such as a check valve device could be incorporated into the fluid channels.

The present disclosure intends to cover and embrace all suitable changes in technology. The scope of the present disclosure is, therefore, described by the appended claims rather than by the foregoing description. The scope of the claims should not be limited by the implementations set forth in the examples, but should be given the broadest interpretation consistent with the description as a whole. Furthermore, in the present disclosure, an implementation is an example or embodiment of the valve assembly and surrounding components. The various appearances of "one implementation," "an implementation" or "some implementations" do not necessarily all refer to the same implementations. Although various features may be described in the context of a single implementation, the features may also be provided separately or in any suitable combination. Conversely, although the valve assembly may be described herein in the context of separate implementations for clarity, it may also be implemented in a single implementation. Reference in the specification to "some implementations", "an implementation", "one implementation", or "other implementations", means that a particular feature, structure, or characteristic described in connection with the implementations is included in at least some implementations, but not necessarily in all implementations.

As used herein, the terms "coupled", "coupling", "attached", "connected" or variants thereof as used herein can have several different meanings depending in the context in which these terms are used. For example, the terms coupled, coupling, connected or attached can have a mechanical connotation. For example, as used herein, the terms coupled, coupling or attached can indicate that two elements or devices are directly connected to one another or connected to one another through one or more intermediate elements or devices via a mechanical element depending on the particular context.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

In addition, although the optional configurations as illustrated in the accompanying drawings comprises various components and although the optional configurations of the valve assembly as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the implementation and use of the valve assembly, and corresponding parts, as briefly explained and as can be easily inferred herefrom, without departing from the scope of the disclosure.

The invention claimed is:

1. A valve assembly for integration within a wellbore string disposed along a wellbore defined within a subterranean reservoir, comprising:

a valve housing comprising a top sub, a bottom sub and an outer wall extending between the top and bottom subs, the outer wall defining a central passage therethrough and having a housing port extending through the outer wall for establishing fluid communication between the central passage and the reservoir; and a bottom sleeve operatively mounted within the valve housing and slidable within the central passage between a closed position where the bottom sleeve occludes the housing port, and an open position where the bottom sleeve is spaced from the housing port to establish fluid communication between the reservoir and the wellbore string through the housing port;

a top sleeve operatively mounted within the valve housing between the bottom sleeve and the top sub, the top sleeve and the valve housing defining an annular region therebetween with the top sleeve being provided with a sleeve port and being slidable within the valve housing between (i) a first position where the sleeve port is occluded by the outer wall of the valve housing and where a restricted flowpath is defined between the outer wall and the top sleeve at an uphole end thereof to enable an ingress of wellbore fluid into the annular region, and (ii) a second position where the sleeve port communicates with the housing port to define a fluid pathway along which reservoir fluids are flowable from the reservoir, through the housing port and the sleeve port, into the annular region, along the annular region toward the uphole end of the top sleeve and into the central passage of the valve housing; and a flow control device coupled to the top sleeve and operable to control a flow of fluids along the fluid pathway when the top sleeve is in the second position, where when in the first position, the top sleeve is in sealing engagement with the valve housing for defining a dead-end chamber within the annular region, the dead-end chamber being in fluid communication with the central passage via the restricted flowpath to enable fluid pressurization of the dead-end chamber and prevent cementitious material from flowing into the annular region, the flow control device being positioned within the dead-end chamber and being isolated from the cementitious material when the top sleeve is in the first position.

2. The valve assembly of claim 1, wherein the flow control device comprises a directional control valve device adapted to prevent fluid flow in at least one direction between the central passage and the reservoir, when the top sleeve is in the second position.

3. The valve assembly of claim 2, wherein the directional control valve device is adapted to prevent fluid flow from the central passage to the sleeve port via the annular region, and allow fluid flow from the sleeve port to the central passage via the annular region.

4. The valve assembly of claim 2, wherein the top sleeve comprises a sleeve mandrel defining a sleeve passage therethrough, a collet coupled to an uphole end of the sleeve mandrel and being adapted to releasably engage an inner surface of the outer wall, and a sleeve cap coupled to a downhole end of the sleeve mandrel, the sleeve cap being provided with the sleeve port, where at least one of the sleeve mandrel and the sleeve cap sealingly engages the outer wall to define the dead-end chamber.

5. The valve assembly of claim 4, wherein the sleeve mandrel comprises a ring portion extending into the annular region and engaging the inner surface of the outer wall, the ring portion defining a downhole annular region in fluid communication with the sleeve port, and an uphole annular region in fluid communication with the central passage, the ring portion comprises one or more through channels establishing fluid communication between the uphole and downhole annular regions.

6. The valve assembly of claim 5, wherein the directional control valve device comprises a displaceable member provided within the uphole annular region and being movable between an engaged position, where the displaceable member at least partially prevents fluid communication between the uphole and downhole annular regions, and a disengaged position, where fluid communication between the uphole and downhole annular regions is allowed, the directional control valve device further comprises a biasing member operatively coupled to the displaceable member for biasing the displaceable member into the engaged position.

7. The valve assembly of claim 6, wherein the displaceable member is movable from the engaged position to the disengaged position via fluid flow from the reservoir into the downhole annular region and the through channels.

8. The valve assembly of claim 5, wherein the directional control valve device comprises an axial check valve device, and wherein the displaceable member comprises a ring plug member slidably mounted about the sleeve mandrel, and the biasing member comprises a spring provided about the sleeve mandrel and operatively coupled between the ring plug member and the collet to bias the ring plug member into the engaged position.

9. The valve assembly of claim 5, wherein the directional control valve device comprises a radial check valve device, and wherein the displaceable member comprises a plurality of radial poppets provided about the ring portion for obstructing respective through channels when in the engaged position.

10. The valve assembly of claim 1, wherein the flow control device comprises a screen superposed with the sleeve port to allow fluid flow from the reservoir into the annular region, and prevent various particulates from entering the top sleeve and/or the central passage.

11. The valve assembly of claim 10, wherein the sleeve port comprises a plurality of elongate slots provided around the sleeve cap and opening on an outer surface of the sleeve cap, and wherein the screen comprises one or more circumferential openings defined along an interior surface of the sleeve cap and in fluid communication with the elongate openings through a bottom surface thereof.

12. The valve assembly of claim 11, wherein the circumferential openings are generally perpendicular relative to the elongate slots.

13. A valve assembly for integration within a wellbore string disposed along a wellbore defined within a subterranean reservoir, comprising:

a valve housing comprising an outer wall defining a central passage therethrough and having a housing port extending through the outer wall; and a bottom sleeve operatively mounted within the valve housing and slidable within the central passage between a closed position occluding the housing port, and an open position;

a top sleeve operatively mounted within the valve housing and defining an annular region therebetween, the top sleeve having a sleeve port and being slidable within the central passage between (i) a first position where a downhole end of the top sleeve sealingly engages an inner surface of the valve housing and defines an annular chamber within the annular region, and (ii) an operational position where the sleeve port is in fluid communication with the housing port to define a fluid pathway along which fluids are flowable from the reservoir through the annular chamber and into the central passage; and a flow control device provided within the annular region and being operable to control a flow of fluids along the fluid pathway when the top sleeve is in the operational position, the annular chamber being in fluid communication with the central passage for allowing wellbore fluid to flow into and pressurize the annular chamber to prevent subsequent fluid, particulates and/or slurry material from flowing into the annular chamber, and where the sleeve port and flow control device are positioned within the annular chamber when in the first position.

* * * * *